US009456285B2

(12) United States Patent
Bymaster et al.

(10) Patent No.: US 9,456,285 B2
(45) Date of Patent: Sep. 27, 2016

(54) CIC HEARING DEVICE

(71) Applicant: Sonova AG, Stäfa (CH)

(72) Inventors: Brett Bymaster, San Jose, CA (US); Herbert Bächler, Zürich (CH); Gerard van Oerle, Uster (CH)

(73) Assignee: Sonova AG, Stäfa (CH)

( * ) Notice: Subject to any disclaimer, the term of this patent is extended or adjusted under 35 U.S.C. 154(b) by 0 days.

(21) Appl. No.: 14/428,797

(22) PCT Filed: Sep. 18, 2012

(86) PCT No.: PCT/US2012/055886

§ 371 (c)(1),
(2) Date: Mar. 17, 2015

(87) PCT Pub. No.: WO2013/077932

PCT Pub. Date: May 30, 2013

(65) Prior Publication Data

US 2015/0256941 A1 Sep. 10, 2015

(51) Int. Cl.
*H04R 25/00* (2006.01)

(52) U.S. Cl.
CPC ..... *H04R 25/502* (2013.01); *H04R 25/30* (2013.01); *H04R 25/356* (2013.01); *H04R 25/602* (2013.01); *H04R 25/65* (2013.01); *H04R 25/604* (2013.01); *H04R 25/654* (2013.01); *H04R 25/658* (2013.01); *H04R 2225/023* (2013.01); *H04R 2225/31* (2013.01); *H04R 2225/33* (2013.01); *H04R 2460/03* (2013.01)

(58) Field of Classification Search
CPC .... H04R 25/00; H04R 25/35; H04R 25/353; H04R 25/356; H04R 25/50; H04R 25/502; H04R 25/505; H04R 2225/31; H04R 2225/33; H04R 2225/59; H04R 2460/03; H04R 25/30; H04R 25/60; H04R 25/602
See application file for complete search history.

(56) References Cited

U.S. PATENT DOCUMENTS

| | | | | |
|---|---|---|---|---|
| 2,762,870 | A | 9/1956 | Sziklai et al. | |
| 2,791,644 | A | 5/1957 | Sziklai | |
| 3,410,958 | A * | 11/1968 | Cohen | H03G 3/32 330/59 |
| 4,170,720 | A | 10/1979 | Killion | |
| 4,718,099 | A | 1/1988 | Hotvet et al. | |
| 4,719,430 | A * | 1/1988 | Cole | H03F 1/0261 330/255 |
| 4,882,761 | A | 11/1989 | Waldhauer et al. | |
| 4,901,030 | A * | 2/1990 | Webster | H03F 1/083 330/252 |
| 4,987,383 | A | 1/1991 | Mauthe et al. | |

(Continued)

OTHER PUBLICATIONS

Tremblay, A.J. "Modeling the Saturated Bipolar Transistor." Diss. McMaster University, 1981. Print. <http://digitalcommons.mcmaster.ca/opendissertations/163/>.

(Continued)

*Primary Examiner* — Curtis Kuntz
*Assistant Examiner* — Joshua Kaufman
(74) *Attorney, Agent, or Firm* — Henricks, Slavin & Holmes LLP

(57) ABSTRACT

CIC Hearing device (50, 1000, 1100) comprising electronics configured to receive an electrical signal as an input signal and generate an output signal provided to a receiver, the electronics including a variable gain amplifier with input buffering circuitry including a compound transistor, the electronics being configured to bias the compound transistor such that a quiescent current associated with the output signal is limited or controlled.

20 Claims, 18 Drawing Sheets

(56) References Cited

U.S. PATENT DOCUMENTS 5,083,312 A 1/1992 Newton et al.
5,111,506 A 5/1992 Charpentier et al.
5,128,566 A 7/1992 Killion et al.
5,131,046 A * 7/1992 Killion ..... H03G 9/18 330/254
5,144,675 A 9/1992 Killion et al.
5,278,912 A 1/1994 Waldhauer et al.
5,303,306 A 4/1994 Brillhart et al.
5,822,442 A 10/1998 Agnew et al.
5,838,807 A 11/1998 Andersson et al.
6,205,227 B1 3/2001 Mahoney et al.
6,310,960 B1 * 10/2001 Saaski ..... H01M 10/0431 381/322
6,533,062 B1 3/2003 Widmer et al.
6,670,792 B1 * 12/2003 Renehan ..... H02J 7/245 322/17
6,724,902 B1 4/2004 Shennib et al.
6,914,994 B1 7/2005 Shennib et al.
6,940,988 B1 * 9/2005 Shennib ..... H04R 25/60 181/130
7,092,543 B1 8/2006 Mahoney et al.
7,315,626 B2 * 1/2008 Pedersen ..... G06F 1/3203 381/312
7,424,123 B2 9/2008 Shennib et al.
7,580,537 B2 8/2009 Urso et al.
7,620,195 B2 11/2009 Bengtsson et al.
7,844,065 B2 11/2010 von Dombrowski et al.
7,987,977 B2 8/2011 Leedom et al.
8,625,829 B2 1/2014 Bachler
8,682,016 B2 3/2014 Wagner et al.
8,761,423 B2 6/2014 Wagner et al.
8,808,906 B2 8/2014 Wenzel et al.
2002/0005759 A1 * 1/2002 Wong ..... H03F 3/3071 330/267
2002/0109544 A1 * 8/2002 Butler ..... H03F 3/3069 330/3
2004/0179706 A1 9/2004 van Oerle
2004/0247148 A1 * 12/2004 Pedersen ..... G06F 1/3203 381/323
2005/0140610 A1 * 6/2005 Smith ..... G09G 3/3216 345/77
2006/0008110 A1 * 1/2006 van Halteren ..... H04R 3/14 381/417
2007/0104343 A1 * 5/2007 Bengtsson ..... H04R 25/305 381/323
2008/0174368 A1 * 7/2008 Chattin ..... H03F 1/52 330/263
2009/0220115 A1 9/2009 Lantrua
2010/0246865 A1 * 9/2010 Suurballe ..... H04R 25/558 381/314
2012/0041515 A1 2/2012 Meskens et al.
2013/0125387 A1 5/2013 Wenzel et al.
2014/0093104 A1 * 4/2014 Laplaca ..... H03F 3/26 381/120
2015/0256941 A1 * 9/2015 Bymaster ..... H04R 25/602 381/323

OTHER PUBLICATIONS

Toumazou, C. et al. (edited by) *Analogue IC Design: The Current-Mode Approach* The Institution of Engineering and Technology, pp. 1-21 (1990).

Sarpeshkar, R. et al., "A Low-Power Wide-Linear-Range Transconductance Amplifier," *Analog Integrated Circuits and Signal Processing* 13, 123-151 (1997).

Arbogast, T. et al., "A New Hearing Aid Class: The First 100% Invisible Extended-Wear Hearing Aid," *The Hearing Review,* Apr. 2009.

* cited by examiner

CIC HEARING DEVICE

CROSS-REFERENCE TO RELATED APPLICATIONS

This application is related to the following: U.S. application Ser. No. 13/303,406, entitled "CANAL HEARING DEVICES AND BATTERIES FOR USE WITH SAME" filed on Nov. 23, 2011 (now U.S. Pat. No. 8,682,016, issued on Mar. 25, 2014); U.S. application Ser. No. 13/303,576, entitled "CANAL HEARING DEVICES AND BATTERIES FOR USE WITH SAME" filed on Nov. 23, 2011 (now U.S. Pat. No. 8,761,423, issued on Jun. 24, 2014); U.S. application Ser. No. 13/303,684, entitled "CANAL HEARING DEVICES AND BATTERIES FOR USE WITH SAME" filed on Nov. 23, 2011 (now U.S. Pat. No. 8,808,906, issued on Aug. 19, 2014); and U.S. application Ser. No. 13/303,762, entitled "CANAL HEARING DEVICES AND BATTERIES FOR USE WITH SAME" filed on Nov. 23, 2011, the full disclosures of which are incorporated herein by reference.

TECHNICAL FIELD

The present inventions relate generally to hearing devices and methods and, in particular, to hearing devices and methods utilizing and/or facilitating utilization of very low or ultra-low power electronics/circuitry.

BACKGROUND ART

The external acoustic meatus (ear canal) 10 is generally narrow and contoured, as shown in the coronal view illustrated in FIG. 1. The adult ear canal 10 is axially approximately 25 mm in length from the canal aperture 12 to the tympanic membrane or eardrum 14. The lateral part of the ear canal 10, i.e., the part away from the tympanic membrane, is the cartilaginous region 16. The cartilaginous region 16 is relatively soft due to the underlying cartilaginous tissue, and deforms and moves in response to the mandibular or jaw motions, which occur during talking, yawning, eating, etc. The medial part of the ear canal 10, i.e., the part toward the tympanic membrane 14, is the bony region 18 (or "bony canal"). The bony region 18, which is proximal to the tympanic membrane 14, is rigid, roughly 15 mm long and represents approximately 60% of the canal length. The skin in the bony region 18 is thin relative to the skin in the cartilaginous region and is typically more sensitive to touch or pressure. There is a characteristic bend, which occurs approximately at the bony-cartilaginous junction 20, that separates the cartilaginous region 16 and the bony region 18, commonly referred to as the second bend of the ear canal.

Debris 22 and hair 24 in the ear canal are primarily present in the cartilaginous region 16. Physiologic debris includes cerumen or earwax, sweat, decayed hair and skin, and sebaceous secretions produced by the glands underneath the skin in the cartilaginous region. Non-physiologic debris is also present and may consist of environmental particles, including hygienic and cosmetic products that may have entered the ear canal. The bony portion of the ear canal does not contain hair follicles, sebaceous, sweat, or cerumen glands. Canal debris is naturally extruded to the outside of the ear by the process of lateral epithelial cell migration, offering a natural self-cleansing mechanism for the ear.

The ear canal 10 terminates medially with the tympanic membrane 14. Lateral of and external to the ear canal is the concha cavity 26 and the auricle 28, which is cartilaginous. The junction between the concha cavity 26 and cartilaginous region 16 of the ear canal at the aperture 12 is also defined by a characteristic bend 30, which is known as the first bend of the ear canal. Canal shape and dimensions can vary significantly among individuals.

As discussed in U.S. Pat. No. 6,940,988 to Shennib et al. ("Shennib et al."), conventional hearing devices that fit in the ear of individuals generally fall into one of 4 categories as classified by the hearing aid industry: (1) the Behind-The-Ear (BTE) type which, as the designation indicates, is worn behind the ear and is attached to an ear mold which fit mostly in the concha; (2) the In-The-Ear (ITE) type which fits largely in the auricle and concha areas, extending minimally into the ear canal; (3) the In-The-canal (ITC) type which fits largely in the concha area and extends into the ear canal (see, e.g., Valente M., *Strategies for Selecting and Verifying Hearing Aid Fittings*, Thieme Medical Publishing, pp. 255-256, 1994), and (4) the Completely-In-the-Canal (CIC) type which fits completely within the ear canal past the aperture (see, e.g., Chasin, M. *CIC Handbook*, Singular Publishing, p. 5).

Extended wear hearing devices are configured to be worn continuously, from several weeks to several months, inside the ear canal. Such devices may be miniature in size in order to fit entirely within the ear canal and are configured such that the receiver (or "speaker") fits deeply in the ear canal in proximity to the tympanic membrane 14. To that end, receivers and microphones that are highly miniaturized, but sufficiently sized to produce acceptable sound quality, are available for use is hearing devices. The in-the-canal receivers are generally in the shape of a rectangular prism, and have lengths in the range of 5-7 mm and girths of 2-3 mm at the narrowest dimension. Receivers with smaller dimensions are possible to manufacture, but would have lower output efficiencies and the usual challenges of micro-manufacture, especially in the coils of the electromagnetic transduction mechanism. The reduction in output efficiency may be unacceptable, in the extended wear hearing device context, because it necessitates significant increases in power consumption to produce the required amplification level for a hearing impaired individual. Examples of miniature hearing aid receivers include the FH and FK series receivers from Knowles Electronics and the 2600 series from Sonion (Denmark). With respect to microphones, the microphones employed in in-the-canal hearing devices are generally in the shape of a rectangular prism or a cylinder, and range from 2.5-5.0 mm in length and 1.3 to 2.6 mm in the narrowest dimension. Examples of miniature microphones include the FG and TO series from Knowles Electronics, the 6000 series from Sonion, and the 151 series from Tibbetts Industries. Other suitable microphones include silicon microphones (which are not yet widely used in hearing aids due to their suboptimal noise performance per unit area).

Recently introduced extended wear hearing devices are configured to be located in both the cartilaginous region 16 and the bony region 18 of the ear canal 10. A design exists for an extended wear hearing device intended to rest entirely within the bony region 18 and is disclosed in U.S. Patent Pub. No. 2009/0074220 to Shennib ("Shennib"). There are a number of advantages associated with the placement of a hearing device entirely within the ear canal bony region 18. For example, placement within the ear canal bony region 18 and entirely past the bony-cartilaginous junction 20 avoids the dynamic mechanics of the cartilagenous region 16, where mandibular motion, changes in the position of the pina, such as during sleep, and other movements result in significant ear canal motion that can lead to discomfort, abrasions, and/or migration of the hearing device. Another benefit of placement within the ear canal bony region 18 relates to the fact that sweat and cerumen are produced lateral to the bony-cartilaginous junction 20. Thus, placement within the bony region 18 reduces the likelihood of hearing device contamination. Sound quality is improved because "occlusion," which is caused by the reverberation of sound in the cartilaginous region 16, is eliminated. Sound quality is also improved because the microphone is placed relatively close to the tympanic membrane, taking advantage of the directionality and frequency shaping provided by the outer parts of the ear, so that sound presented to the hearing device microphone more closely matches the sound that the patient is accustomed to receiving at their tympanic membrane.

Operating close to the tympanic membrane allows the hearing instrument to generate a higher sound level while using less power than if the hearing aid were operated at a more distant location from the tympanic membrane. As discussed in Shennib et al., the efficiency of a hearing device is generally inversely proportional to the distance or residual volume between the receiver (speaker) end and the tympanic membrane, the closer the receiver is to the tympanic membrane, the less air mass there is to vibrate, and thus, less energy is required.

In relation to in-the-canal hearing devices, for example, as noted in U.S. application Ser. No. 13/303,406, the configuration of conventional hearing device batteries prevents batteries that have sufficient power capacity (measured in, for example, milliamp hours (mAh)) from being shaped in a manner that would enable an overall hearing device configuration which allows the hearing device to fit within the ear canal bony region in a significant portion of the adult population.

Thus, it would be helpful to be able to reduce the current/power consumption of a hearing device.

It would be helpful to be able to reduce the current/power consumption of a deep in the canal hearing device that includes a battery (power source) constituted of a single battery or a single cell battery. In relation to providing a deep canal extended wear hearing aid, for example, preferably all four of the following operational/performance criteria are satisfied.

1. Current Consumption: The hearing aid must consume a quantity of current commensurate with state of the art batteries, constrained by a volume equal to the available volume in a patient's ear canal, such that a "non-rechargeable" single battery or a single cell battery, provides an operating lifetime that meets or exceeds a minimum specified duration (amount of time). By way of example, for a 3 month lifetime, this current is less than 30 μA.
2. Compression Range: The hearing aid must amplify "quiet sounds" with a high gain on the order of 40 dB, while amplifying "loud sounds" with a small gain, or no gain at all. A "quiet sound" is defined as a sound on the order of 40 dB relative to 20 μPa, while a "loud sound" is defined as a sound on the order of 100 dB relative to 20 μPa. The required compression range is then 40 dB, adjusting the gain from a maximum of 40 dB in quiet environments to a minimum of 0 dB in loud environments.
3. Noise: The hearing aid must not add significant random noise to the amplified signal. To satisfy this requirement, an input referred integrated noise signal should be less than 30 dB relative to 20 μPa integrated from 200 Hz to 5 kHz.
4. Distortion: Low distortion is required, which is defined as less than 5% total harmonic distortion for both loud and quiet input signals as defined above.

It would be helpful to be able to reduce the current/power consumption of a hearing device that includes a rechargeable battery and/or increase the acoustical pressure generated by such a device.

It would be helpful to be able to improve one or more aspects of hearing device sound quality.

SUMMARY OF THE INVENTION

A hearing device in accordance with at least one of the present inventions includes a hearing device core including an acoustic-to-electric transducer or sensor that converts sound into an electrical signal, a receiver, and electronics configured to receive the electrical signal as an input signal and generate an output signal provided to the receiver, the electronics including a variable gain amplifier with input buffering circuitry including a compound transistor, the electronics being configured to bias the compound transistor such that a quiescent current associated with the output signal is limited or controlled.

An amplification method in accordance with at least one of the present inventions includes providing a variable gain amplifier with input buffering circuitry that includes a Sziklai pair, and biasing the Sziklai pair such that a quiescent current associated with an output signal generated by the variable gain amplifier is limited or controlled.

An amplifier for a hearing device in accordance with at least one of the present inventions includes electronics configured to receive an electrical signal as an input signal and generate an output signal for driving a receiver of the hearing device, the electronics including a variable gain amplifier with an input stage that includes a Sziklai pair, and circuitry adapted to bias the Sziklai pair such that a quiescent current associated with an output signal generated by the variable gain amplifier is limited or controlled.

A method of facilitating hearing for a hearing device that includes a variable gain amplifier and a receiver that is positionable in the ear canal, the method in accordance with at least one of the present inventions includes providing the receiver with a high impedance receiver winding, positioning the receiver or windings thereof in the ear canal in direct acoustic contact with the air cavity between the receiver and the tympanic membrane, and limiting or controlling a quiescent current associated with an output signal generated by the variable gain amplifier.

A hearing device in accordance with at least one of the present inventions includes a hearing device core including an acoustic-to-electric transducer or sensor that converts sound into an electrical signal, a receiver, and electronics configured to receive the electrical signal as an input signal and generate an output signal provided to the receiver, the electronics including a variable gain amplifier with circuitry utilizing a logarithmic compression scheme to provide gain compression. The circuitry includes an envelope filter and a variable gain element coupled thereto, and the envelope filter is configured to provide filtering to compensate for the real ear resonance.

An amplifier for a hearing device in accordance with at least one of the present inventions includes electronics configured to receive an electrical signal as an input signal and generate an output signal for driving a receiver of the hearing device, the electronics including a variable gain amplifier with circuitry configured to provide gain compression, the circuitry including an envelope filter and a variable gain element including a linearized zero biased transistor that provides gain.

A method for reducing hearing device power consumption in accordance with at least one of the present inventions includes, in circuitry that provides gain compression for a hearing device, filtering input signals to the hearing device utilizing an envelope detector configured such that as the amplitude of the input signals increases, a voltage on the emitter of a transistor associated with the envelope detector decreases reducing the current flowing out of an arrangement of transistors to provide gain compression.

A method for reducing hearing device power consumption in accordance with at least one of the present inventions includes, in circuitry that provides logarithmic compression for a hearing device, the circuitry including a variable gain element, linearizing a transistor of the variable gain element such that current fed into the transistor and circuitry effecting the linearization is limited or controlled.

A method for reducing hearing device power consumption in accordance with at least one of the present inventions includes, in circuitry that provides gain compression for a hearing device, the circuitry including an envelope filter, configuring a variable resistance element at an output of the envelope filter such that both gain compression and limiting are controlled by adjusting the variable resistance element.

A method for biasing a microphone of a hearing device including adjustable source degeneration circuitry in accordance with at least one of the present inventions includes controlling an adjustable component of the adjustable source degeneration circuitry depending upon a detected signal envelope associated with sounds impinging upon the microphone.

An apparatus for biasing a hearing device microphone in accordance with at least one of the present inventions includes electronics configured to receive an electrical signal as an input signal and generate an output signal for driving a hearing device receiver, the electronics including adjustable source degeneration circuitry coupled to the hearing device microphone and configured to adjust signal noise responsive to detected sounds impinging upon the hearing device microphone to ensure that a transistor of the adjustable source degeneration circuitry stays in the active region.

A hearing device in accordance with at least one of the present inventions includes a hearing device core including an acoustic-to-electric transducer or sensor that converts sound into an electrical signal, a receiver, and electronics configured to receive the electrical signal as an input signal and generate an output signal provided to the receiver, the electronics including a compound transistor that receives the input signal and generates a current, and circuitry configured for analog processing of the current.

An amplifier for a hearing device in accordance with at least one of the present inventions includes electronics configured to receive an electrical signal as an input signal and generate an output signal for driving a receiver of the hearing device, the electronics including an input buffering stage including a Sziklai pair that receives the input signal and generates a current, and circuitry configured for analog processing of the current to provide the output signal.

A method of improving sound quality in a hearing device that includes an acoustic-to-electric transducer or sensor and a receiver in accordance with at least one of the present inventions includes receiving an input signal provided by the acoustic-to-electric transducer or sensor that represents sound, generating a current from the input signal, and analog processing the current to generate an output signal provided to the receiver.

A method of improving sound quality for a hearing device in accordance with at least one of the present inventions includes filtering an input signal provided to a hearing device, the filtering including one or more of the following: filtering directly at the input of a variable gain amplifier of the hearing device, varying one or more adjustable components of a filtering circuit in response to changes in gain, utilizing a filtering circuit that generates a corner frequency independently of gain, utilizing an adjustable high pass filter which is removed as the level of the input signal increases, varying an adjustable component of a filtering circuit depending upon an overall detected signal envelope, and varying an adjustable component of a filtering circuit in response to an output of circuitry utilized to provide gain compression.

A hearing device in accordance with at least one of the present inventions includes a hearing device core including an acoustic-to-electric transducer or sensor that converts sound into an electrical signal, a receiver, and electronics configured to receive the electrical signal as an input signal and generate an output signal provided to the receiver, the electronics including a variable gain amplifier with filtering circuitry that filters directly at the input of the variable gain amplifier.

An input circuit for a hearing device in accordance with at least one of the present inventions includes electronics configured to receive an electrical signal as an input signal and generate an output signal for driving a receiver of the hearing device, the electronics including a variable gain amplifier with filtering circuitry that filters at the input of the variable gain amplifier, the filtering circuitry including an adjustable high pass filter that generates a low frequency corner, the electronics being configured such that the low frequency corner is adjustable independently of gain.

A hearing device in accordance with at least one of the present inventions includes a hearing device core including an acoustic-to-electric transducer or sensor that converts sound into an electrical signal, a receiver, a battery constituted of a single battery or a single cell battery, and electronics configured to receive the electrical signal as an input signal and generate an output signal provided to the receiver, the electronics including a variable gain amplifier configured such that a quiescent current associated with the output signal is less than 10 μA.

A hearing device in accordance with at least one of the present inventions includes a hearing device core including an acoustic-to-electric transducer or sensor that converts sound into an electrical signal, a receiver, a rechargeable battery, and electronics configured to receive the electrical signal as an input signal and generate an output signal provided to the receiver, the electronics including a variable gain amplifier configured such that a quiescent current associated with the output signal is less than 40 μA.

DISCLOSURE OF INVENTION

Example embodiments described herein generally involve hearing devices and methods utilizing and/or facilitating utilization of very low or ultra-low power electronics/circuitry.

Figure 1:
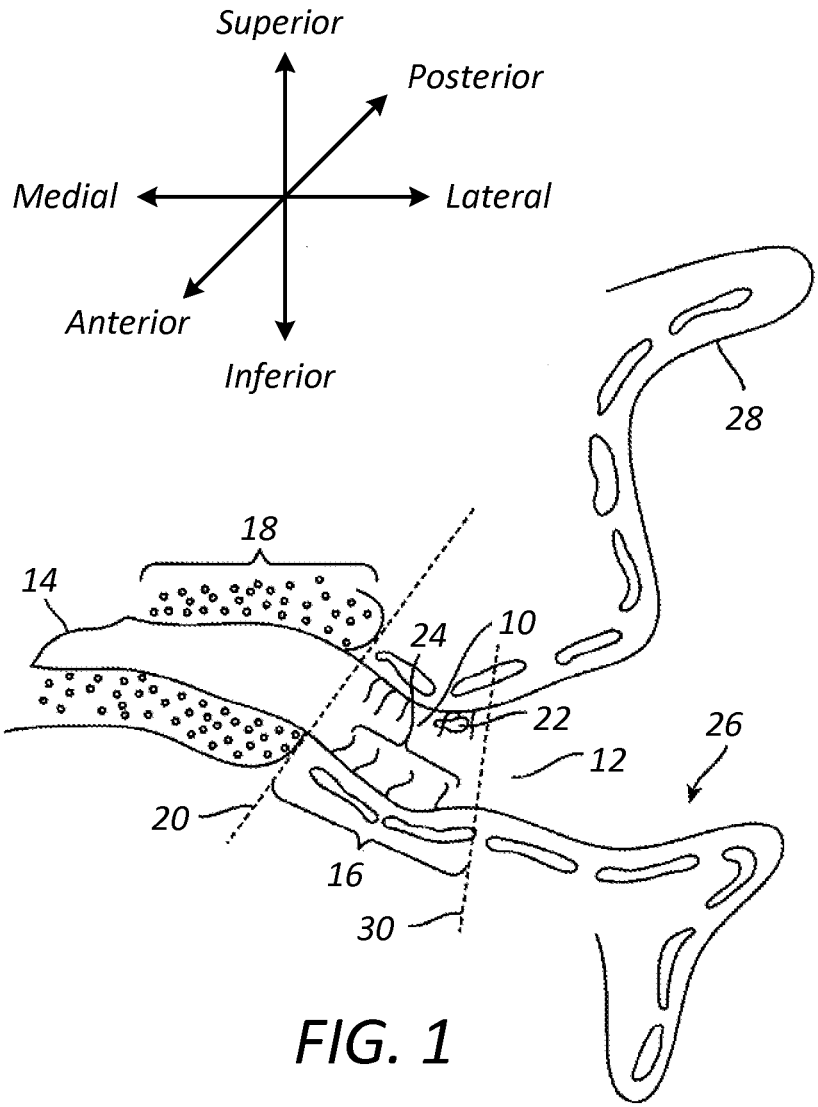
FIG. 1 is a section view showing the anatomical features of the ear and ear canal.

Referring to FIG. 1, it should also be noted that as used herein, the term "lateral" refers to the direction and parts of hearing devices which face away from the tympanic membrane, the term "medial" refers to the direction and parts of hearing devices which face toward the tympanic membrane, the term "superior" refers to the direction and parts of hearing devices which face the top of the head, the term "inferior" refers to the direction and parts of hearing devices which face the feet, the term "anterior" refers to the direction and parts of hearing devices which face the front of the body, and the "posterior" refers to the direction and parts of hearing devices which face the rear of the body.

Figure 2:
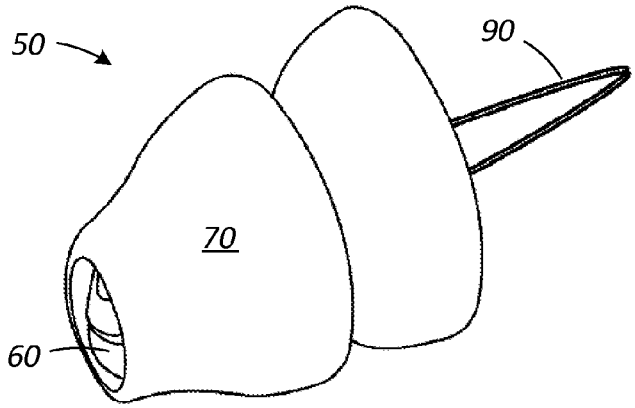
FIG. 2 is a perspective view of an example embodiment of a hearing device.
Figure 3:
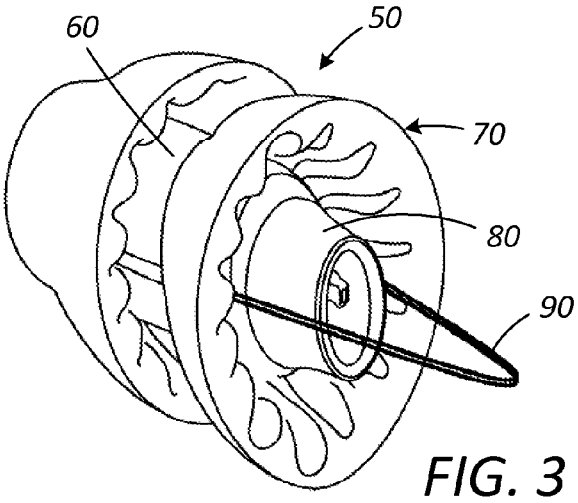
FIG. 3 is another perspective view of the hearing device illustrated in FIG. 2.
Figure 4:
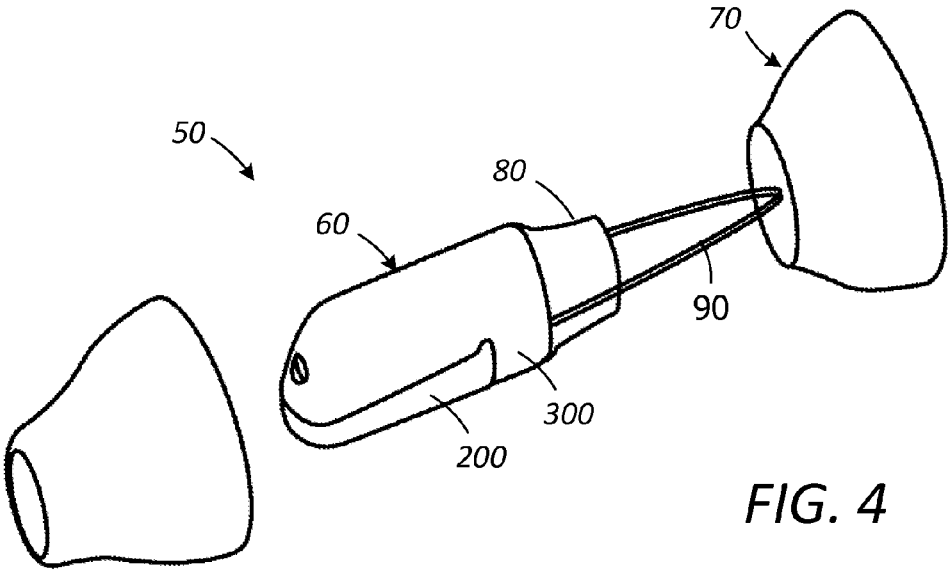
FIG. 4 is an exploded perspective view of the hearing device illustrated in FIG. 2.

As illustrated in FIGS. 2-4, in an example embodiment, a hearing device 50 includes a core 60 and a seal apparatus 70. A contamination guard 80 may be mounted on the lateral end of the core 60. A handle 90, which may be used to remove the hearing device 50 from the ear canal, may also be provided in some implementations. Generally speaking, the core 60 includes the battery and acoustic components, the seal apparatus 70 is a compliant device that secures the core in the bony region of the ear canal and provides acoustic attenuation to mitigate occurrence of feedback, and the contamination guard 80 protects the core from contaminants such as debris, cerumen, condensed moisture, and oil.

Figure 5:
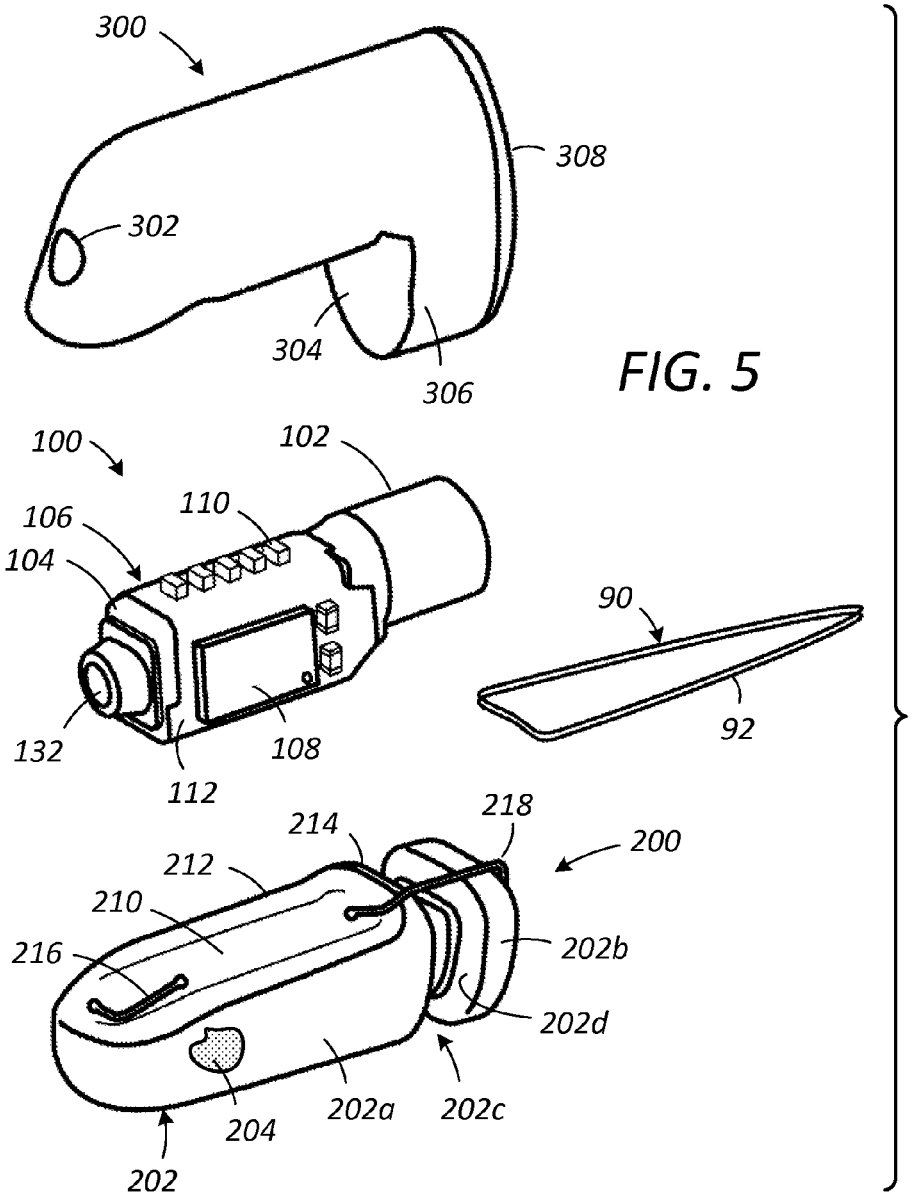
FIG. 5 is an exploded perspective view of a portion of the hearing device illustrated in FIG. 2.
Figure 5A:
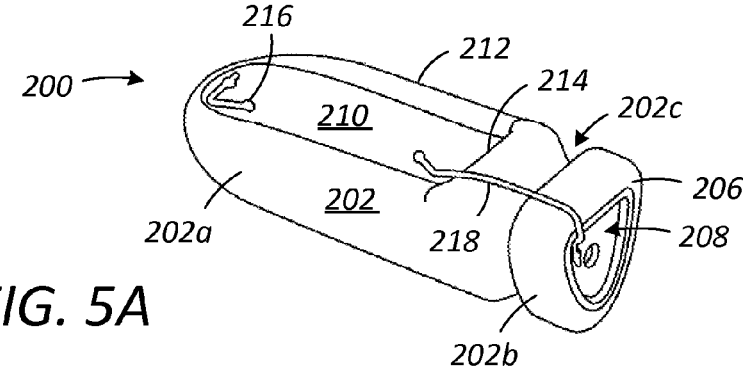
FIG. 5A is a perspective view of an example battery.

With respect to the core 60, and referring to FIGS. 5 and 5A, the core in this example implementation includes an acoustic assembly 100, a battery 200 and encapsulant 300 that encases some or all of the acoustic assembly and battery. In this example embodiment, the acoustic assembly 100 has a microphone 102, a receiver 104 and a flexible circuit 106 with an integrated circuit or amplifier 108 and other discrete components 110 (e.g., capacitors) carried on a flexible substrate 112. The battery 200 has an anode can 202 (or "battery can") that holds the anode material and cathode assembly. In particular, the anode can 202 includes an anode portion 202*a* for anode material 204 and a cathode portion 202*b* for a cathode assembly 208. In this example embodiment, the anode can 202 is also provided with an inwardly contoured region 202*c* (or "neck") that defines an external retention ledge 202*d*, i.e., a retention ledge that is accessible from the exterior of the anode can, at the anode/cathode junction. The cathode portion 202*b* includes a crimped region 206. The inwardly contoured region 202*c* and retention ledge 202*d* are associated with the battery assembly process. To that end, the inwardly contoured region 202*c* defines a longitudinally extending gap that is sufficiently sized to receive a crimp tooling. The inwardly contoured region 202*c* also creates an anchor region for the encapsulant 300 and the external retention ledge 202*d* serves as a connection point for the handle 90 which, in this illustrated embodiment, consists of a pair of flexible cords 92.

The acoustic assembly 100 may be mounted to the battery 200 and, in this illustrated embodiment, the anode can 202 is provided with an acoustic assembly support surface 210 with a shape that corresponds to the shape of the adjacent portion of the acoustic assembly 100 (here, the receiver 104). The support surface 210 may in some instances, including the illustrated embodiment, be a relatively flat, recessed area defined between side protrusions 212 and a lateral end protrusion 214. The protrusions 212 and 214 align the acoustic assembly 100 relative to the battery and also shift some of the battery volume to a more volumetrically efficient location. In other implementations, the protrusions 212 and 214 may be omitted. The battery 200 is connected to the flexible circuit 106 by way of anode and cathode wires 216 and 218. The battery may, in other implementations, be connected to a similar flexible circuit via tabs (not shown) of the flexible circuit that attach to the battery.

In this example embodiment, the anode can 202 also has a shape that somewhat corresponds to a truncated oval (or D-shape) in cross-section, which contributes to the overall shape of the core 60. The anode can 202 may also taper at the free end (i.e., the left end in FIGS. 5 and 5A).

It should be noted here that the spatial relationships of components of the acoustic assembly 100 to one another, and the spatial relationship of the acoustic assembly to the battery 200 is as follows in this illustrated example embodiment. The microphone 102 and the receiver 104 each extend along the long axis of the core 60, i.e. in the "medial-lateral" direction, with the lateral end of the receiver being closely adjacent to the medial end of the of the microphone. Put another way, the microphone 102 and the receiver 104 are arranged in in-line fashion in the medial-lateral direction, close to one another (e.g., about 0.1 to 0.5 mm between the two) with the medial end of the receiver at the superior medial end of the hearing device and the lateral end of the microphone at the lateral end of the hearing device core 60. The contamination guard 80 may, if present, extend laterally of the core 60. Such an arrangement results in a thinner core, as compared to hearing devices where the receiver and microphone are arranged side by side. In this example embodiment, the core 60 also does not have, and does not need, a sound tube that extends medially from the receiver, as is found in some conventional hearing devices, such as the hearing device disclosed in Shennib. The direct drive of the air cavity between the receiver and tympanic membrane by a short spout or port provides for higher fidelity sound transmission than a sound tube, which can introduce significant distortion.

In other implementations, e.g. an implantation where the receiver sound port does not protrude from the housing, there may be a short sound tube (e.g., less than 2 mm in length) that extends through, or is simply defined by, the encapsulant. Due to this minimal length, the short sound tube will not adversely affect acoustic transmission in the manner that longer sound tubes may. By way of example, for a core that includes a sound tube, the receiver sound port can be an opening in the receiver housing, and a short sound tube extends to the medial end of the encapsulant. The sound tube may simply be a passage through the encapsulant, or may be a tube that extends through the encapsulant.

In example embodiments, the size, shape and configuration of the hearing device core, and the flexibility of the seal, are such that the hearing device is positionable within the ear canal bony region with the entire microphone medial of the bony-cartilaginous junction and the receiver sound port either communicating directly with an air volume between the hearing device and the tympanic membrane or communicating with the air volume through a short sound tube.

As noted above, the acoustic assembly 100 has a microphone 102, a receiver 104 and a flexible circuit 106 with an integrated circuit or amplifier 108 and other discreet components 110 on a flexible substrate 112. The microphone 102 may have a housing, with a sound port at one end and a closed end wall at the other, a diaphragm within the housing, and a plurality of electrical contacts on the end wall that may be connected to the flexible circuit 106. A suitable microphone for use in this example embodiment may be, but is not limited to, a 6000 series microphone from Sonion.

The receiver 104 may have a housing, with a plurality of elongated side walls and end walls, a sound port, a diaphragm, and a plurality of electrical contacts 136 that may be connected to the flexible circuit 106. Referring to FIG. 5, in this example embodiment, the receiver 104 has a sound port 132 that protrudes from the housing. A suitable receiver for use in this example embodiment may be, but is not limited to, an FK series receivers from Knowles Electronics. In this example embodiment, the acoustic assembly 100 includes a receiver housing 124 which is rectangular in shape and the side walls which are planar in shape. The battery support surface 210 is, therefore, also planar. Other embodiments may employ receivers with other housing shapes and, in at least some instances, the battery support surface will have a corresponding shape.

The flexible circuit 106 may be draped over one or both of the microphone 102 and receiver 104 and, in this illustrated embodiment, the flexible circuit is draped over the receiver with a thin portion located between the microphone and receiver. Such an arrangement reduces the length of the hearing device core 60 without substantially increasing its girth, i.e. the dimensions in the anterior-posterior and superior-inferior directions that are perpendicular to the medial-lateral direction.

With respect to the spatial relationship of the acoustic assembly 100 and battery 200, the acoustic assembly and battery are mounted one on top of the other, i.e. one is superior to the other and acoustic assembly and battery abut one another. The longitudinal axes of the acoustic assembly 100 and battery 200 are also parallel to one another. The battery 200 is relatively long, i.e., is essentially coextensive with the acoustic assembly 100 from the medial end of the core 60 to the lateral end of the core, which allows the girth of the battery to minimized without sacrificing battery volume and capacity. Also, referring to FIG. 8, a contour is provided in the illustrated embodiment that matches (or at least substantially matches) the typical angle of the tympanic membrane 14 in the superior-inferior direction, such that the lateral most tip of the battery 200 extends more laterally than the lateral most tip of the receiver (note the location of the encapsulant sound aperture 302). As such, when combined, the acoustic assembly 100 and battery 200 facilitate the construction of a rigid core that is relatively tall and thin. See U.S. application Ser. No. 13/303,406. The cross-sectional aspect ratio in planes perpendicular to the medial-lateral axis (i.e., the longitudinal axis) along the length of the core 60 is relatively high, i.e. at least about 1.6.

The encapsulant 300 in this illustrated embodiment encases the acoustic assembly 100, but for the locations where sound enters the microphone 102 and exits the receiver 104 and portions of acoustic assembly that are secured directly to the battery 200. The encapsulant 300 also encases the cathode portion 202*b* of the anode can 202, but for the lateral end where air enters, and contoured region 202*c* of the anode portion 202*a*. In other embodiments, a thin layer of encapsulant may also encase the anode portion 202*a* of the anode can 202. Thus, the exterior surface of the encapsulant 300 and, in at least some instances, the exterior surface of a portion of the battery 200 defines the exterior of the core 60. In this example embodiment, there is no housing into which the acoustic assembly 100 and battery 200 are inserted and, as used herein, the term "encapsulant" does not represent a separate housing into which the acoustic assembly 100 and battery 200 are inserted. The acoustic assembly 100 is instead protected from contamination and physical force (e.g., during handling) by the encapsulant 300 and the battery 200. In contrast to this illustrated embodiment, essentially all of the combined volume of the acoustic assembly 100 and battery 200 would be located within a housing if a housing was present, and the thickness of the housing walls would therefore add to the length and girth of the core. As such, the use of encapsulant 300 in place of a housing results in a core with a smaller length and girth than would be the case if a separate housing was employed. Also, as is the case with the anode can 202, the encapsulant 300 may have a smooth, rounded outer surface. This may be accomplished by simply employing an encapsulant mold with such a surface. In summary, due to the configuration of the core 60 (e.g., the relative locations of the components of the acoustic assembly 100 and the battery 200, as well as and the use of encapsulant 300 in place of a housing), the core is a closely packed unitary structure that can be manufactured in an oval shape, or other shapes (e.g., elliptical, tear drop, egg) that are well-suited for the bony region of ear canal, within the dimensions and ratios described below. Other benefits associated with the use of encapsulant include ease of manufacture, as it is not necessary to build a housing (which is a very small device) and position various structures therein, acoustic isolation of microphone and receiver, and superior contamination resistance.

With respect to the material for the encapsulant 300, suitable encapsulating materials include, but are not limited to, epoxies and urethanes, and are preferably medical grade. In example embodiments, the encapsulant 300 has an outer surface and an inner volume of encapsulating material that occupies the spaces between the components and, in some areas, the space between the components and the outer surface of the encapsulant. In this example embodiment, the encapsulant 300 also has a lateral end that is slightly medial (e.g. about 0.3 mm) of the lateral end of the microphone 102 and anode can cathode portion 202*b* so that the microphone port and cathode air port are not occluded. For example, the encapsulant 300 surrounds a portion of the acoustic assembly 100 (e.g., the microphone 102) and a portion of the battery 200 (e.g., the anode can cathode portion 202*b*). In example embodiments, the encapsulant 300 surrounds a portion of the acoustic assembly 100 (e.g., the receiver 104 and flex circuit 106). In other implementations, the entire acoustic assembly 100 and entire battery 200, but for the receiver sound port 132 and the lateral end surfaces of the microphone 102 and cathode assembly 208, may be encased in encapsulating material.

As indicated in U.S. application Ser. No. 13/303,406, for a hearing device which includes a rigid core and a compliant seal apparatus (e.g., hearing device 50), dimensions other than medial-lateral length and certain ratios are of paramount importance if it is desirable for the hearing device to fit into a large percentage of the intended user population. To that end, and referring to FIGS. 6 and 7, in this example embodiment, the core 60 is generally oval-shaped in cross-section (i.e., oval-shaped in the girth plane), which corresponds to the superimposed projection of the cross-sectional shapes of the ear canal to the bony portion and presents smooth rounded surfaces to the ear canal. The core 60 has a dimension along the medial-lateral axis ($D_{ML}$), a dimension along the anterior-posterior (or minor) axis ($D_{AP}$), and a dimension along the superior-inferior (or major) axis ($D_{SI}$). With respect to size, in example embodiments, the core has an anterior-posterior dimension of 3.75 mm or less ($D_{AP} \leq 3.75$ mm), and a superior-inferior dimension of 6.35 mm or less ($D_{SI} \leq 6.35$ mm). See U.S. application Ser. No. 13/303,406. These dimensions are chosen to fit approximately 75% of the adult population, with smaller dimensions needed to fit smaller ear canals. Put another way, in those instances where the medial-lateral dimension is about 12 mm ($D_{ML} \approx 12$ mm), the ratio $D_{AP}/D_{ML} \leq 0.31$ and the ratio $D_{SI}/D_{ML} \leq 0.53$. The medial-lateral dimension may range from about 10-12 mm, with the other dimensions remaining the same, and the ratios will vary accordingly. Thus, in those instances where the medial-lateral dimension is about 10 mm ($D_{ML} \approx 10$ mm), the ratio $D_{AP}/D_{ML} \leq 0.38$ and the ratio $D_{SI}/D_{ML} \leq 0.64$. When a core with such dimensions and ratios is employed in conjunction with a seal apparatus (e.g., the core 60 with seal apparatus 70), the resulting hearing device will have an adult geometrical fit rate of approximately 75%. See U.S. application Ser. No. 13/303,406. In other words, for approximately 75% of the population, the hearing device core and seals will fit entirely within the ear canal bony portion and the maximum pressure on the ear canal bony portion imparted by the hearing device will be less than the venous capillary return pressure of the epithelial layer of the canal.

Figure 8:
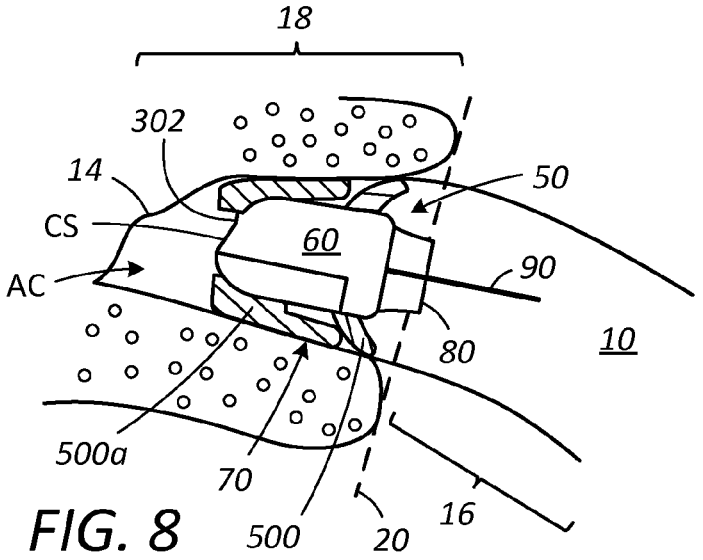
FIG. 8 is a partial section view showing the hearing device illustrated in FIG. 2 within the ear canal.
Figure 8A:
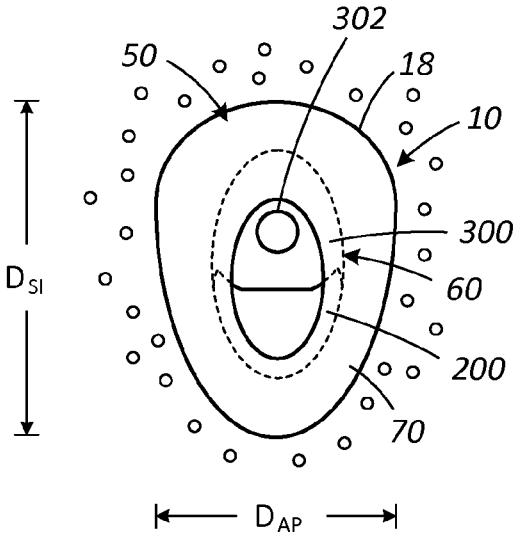
FIG. 8A is an end view showing the hearing device illustrated in FIG. 2 within the ear canal.

FIGS. 8 and 8A show the hearing device 50, sized and shaped in the manner described in the preceding paragraph, positioned within the ear canal bony portion 18 such that the core 60 is entirely within the bony portion and the seal apparatus 70 is compressed against the bony portion. The core 60 is also entirely past the second bend of the ear canal and the bony-cartilaginous junction 20. The encapsulant sound aperture 302, which is located at the medial end of the core 60 and at the receiver sound port, faces and is in close proximity to the tympanic membrane 14 (i.e., about 4 mm from the umbo of the tympanic membrane). The benefits of such placement are discussed in the Background section above. For example, high fidelity sound is achieved because the receiver is in direct acoustic contact with the air cavity AC (FIG. 8) between the tympanic membrane 14 and the medial surface of the seal apparatus 70. The lateral portion of the contamination guard 80, which is a flexible structure as discussed below, may be entirely within the ear canal bony region 18 or partially within both the bony region and the cartilaginous region 16. Concerning fit rate, for 75% of the adult population, the ear canal bony region 18 has a minimum dimension in the superior-inferior direction of at least 4.2 mm and a minimum dimension in the anterior-posterior direction of at least 6.8 mm. See U.S. application Ser. No. 13/303,406.

It should be noted here that the present cores are not limited to oval shapes that are, for the most part, substantially constant in size in the anterior-posterior dimension and the superior-inferior dimension. For example, other suitable cross-sectional shapes include elliptical, tear drop, and egg shapes. Alternatively, or in addition, the core size may taper down to a smaller size, in the anterior-posterior dimension and/or the superior-inferior dimension, from larger sizes at the lateral end to smaller sizes at the medial end, or may vary in size in some other constant or non-constant fashion at least somewhere between the medial and lateral ends.

With respect to the flexible circuit 106, the flexible substrate 112 includes a main portion (not shown) that carries the integrated circuit 108 and the majority of the other discreet components 110. The flexible circuit 106 or a portion thereof may be secured to the receiver 104 with an adhesive (for example). Suitable flexible substrate materials include, but are not limited to, polyimide and liquid crystal polymer (LCP). The flexible circuit 106 includes or is provided with electrical contacts (e.g., carried by tabs or other portions of the circuit)) that may be soldered or otherwise connected to contacts on the microphone 102 and the receiver 104. In example embodiments, the hearing device includes or is provided with a switch or other input mechanism associated with the acoustic assembly. For example, the flexible circuit 106 can include a tab or other portion that carries a switch or other input mechanism which can be utilized to control one or more aspects of the operation of the core 60 (e.g., volume setting). The switch is located, for example, at the lateral end of the core 60.

In this illustrated embodiment, the switch is a magnetically actuated switch. The user simply places a magnet close proximity to the core 60 to actuate the switch. One example of such a switch is a reed switch. A magnetic shield may be positioned between the magnetically actuated switch and the battery 200. Other types of user actuated switches may also be employed in place of, or in conjunction with, the magnetically actuated switch. Such switches include, but are not limited to, light-activated switches (e.g., visible or infrared light-activated) and RF-activated switches.

Figure 6:
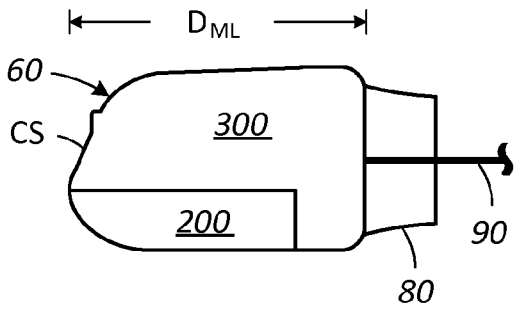
FIG. 6 is a side view of a portion of the hearing device illustrated in FIG. 2.
Figure 7:
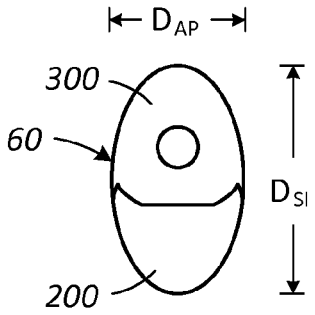
FIG. 7 is a medial end view of a portion of the hearing device illustrated in FIG. 2.

In this example embodiment, the acoustic assembly 100 is a unitary structure that may be mounted onto the battery 200 and the medial ends of the acoustic assembly and battery are at least substantially aligned and the lateral ends of the acoustic assembly and battery are at least substantially aligned. There may be a slight difference in medial-most end points to accommodate the cant (i.e., the slant) of the tympanic membrane. For example, the medial-most end points of the acoustic assembly 100 and battery 200 might be offset from one another by about 0.5 to 1.5 mm. The result, as shown in FIGS. 6 and 8, is the ability to form a canted lateral outer surface CS which slants at an angle that may be the same as, or at least substantially similar to, that of the tympanic membrane 14. Additionally, although the medial end of the acoustic assembly 100 is slightly lateral of the medial end of the battery 200 in the illustrated embodiment, this may be reversed in those instances where the hearing device is intended to be oriented differently within the bony region. The medial and/or lateral ends of the acoustic assembly 100 and battery 200 may also be even with one another (i.e., aligned within a tolerance of 0.1 mm).

The acoustic assembly 100 may be secured to the battery 200 with, for example, a layer of adhesive that is located between the receiver 104 and the support surface 210. After the acoustic assembly 100 has been secured to the battery 200, the anode and cathode wires 216 and 218 (FIG. 5A) may be connected to the flexible circuit 106 with, for example, solder to complete a sub-assembly. Alternatively, flex tabs (not shown) could connect to the battery.

Although the present hearing devices are not limited to any particular seal apparatus, in this example embodiment, the seal apparatus 70 includes a lateral seal 500 and a medial seal 500*a* (sometimes referred to as "seal retainers"). The seals 500 and 500*a*, which support the core 60 within the ear canal bony portion 18 (FIGS. 8 and 8A), are configured to substantially conform to the shape of walls of the ear canal, maintain an acoustical seal between a seal surface and the ear canal, and retain the hearing device 50 securely within the ear canal. The seal apparatus 70 may also be used to provide a biocompatible tissue contacting layer and a barrier to liquid ingress.

As noted above, the battery 200 has an anode can 202 with an anode portion 202*a* for anode material 204 and a cathode portion 202*b* for a cathode assembly 208. A portion of the anode can 202, i.e., the cathode portion 202*b*, is crimped over and around the cathode assembly 208 in general and the cathode base 226 in particular, at the crimp 206. The insulating grommet 224 is compressed against the cathode base 226 by the crimp 206 to create a seal.

The battery 200 can be a metal-air battery in which the anode material 204 include a metal (e.g., an amalgamated zinc powder with organic and inorganic compounds including binders and corrosion inhibitors). Other metals suitable as anode material for the metal-air battery include, but are not limited to, lithium, magnesium, aluminum, iron and calcium. Other battery chemistries, such as lithium primary, lithium-ion, silver zinc, nickel-metal-hydride, nickel zinc, nickel cadmium, may be used as the power source.

Although not limited to any particular dimensions and metals, the overall length of the zinc-air battery 200 is about 10 mm long, with about 8.85 mm of the total length being occupied by the can anode portion 202*a* and the inwardly contoured region 202*c*, and about 1.15 mm of the total length being occupied by the can cathode portion 202*b*. Other lengths include those within the range of 10-12 mm. The width is about 3.75 mm and the height, from the support surface 210 to the opposite surface is about 2.60 mm. So sized, and unlike a conventional button cell, the zinc-air battery 200 will provide sufficient capacity (e.g., at least 70 mAh) and sufficiently low internal impedance (e.g., less than 250 Ohms) to power a relatively low power continuously worn DIC hearing device for periods exceeding one month. In at least some implementations, the cross-sectional area of the cathode portion 202*b* will not exceed 7 $mm^2$, and the cross-sectional area of the inwardly contoured region 202*c* will not exceed 2.5 $mm^2$ at its narrowest portion. It should also be noted here that the aspect ratio of the present battery, i.e., the ratio of the longest dimension (here, from free end of the anode portion 202*a* to the crimped end of the cathode portion 202*b*) to the maximum dimension of the cross-section (here, the width of the cathode portion 202*b* or the anode portion 202*a* adjacent to the contoured region 202*c*) may be at least 2.0 and, in some instances, may range from 2 to 5, or may range from 2 to 10, depending on the internal impendence requirements of the battery.

The battery 200 is a primary (or "unrechargeable") battery. However, in other implementations, a secondary (or "rechargeable") battery may be employed.

Additional information concerning the specifics of example cores, seal apparatuses, contamination guards, magnetic shields, batteries, and encapsulants suitable for one or more of the hearing devices herein may be found in U.S. application Ser. No. 13/303,406, which is incorporated herein by reference.

Figure 9:
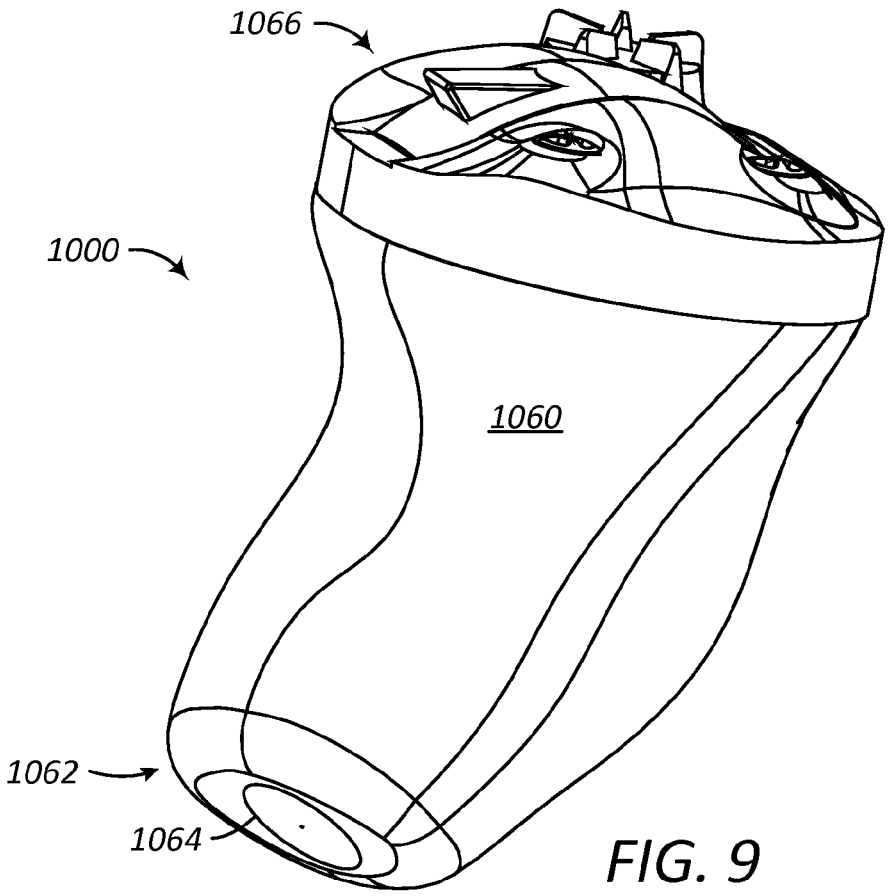
FIG. 9 is a perspective view of an example embodiment of a hearing device that includes a rechargeable battery.
Figure 9A:
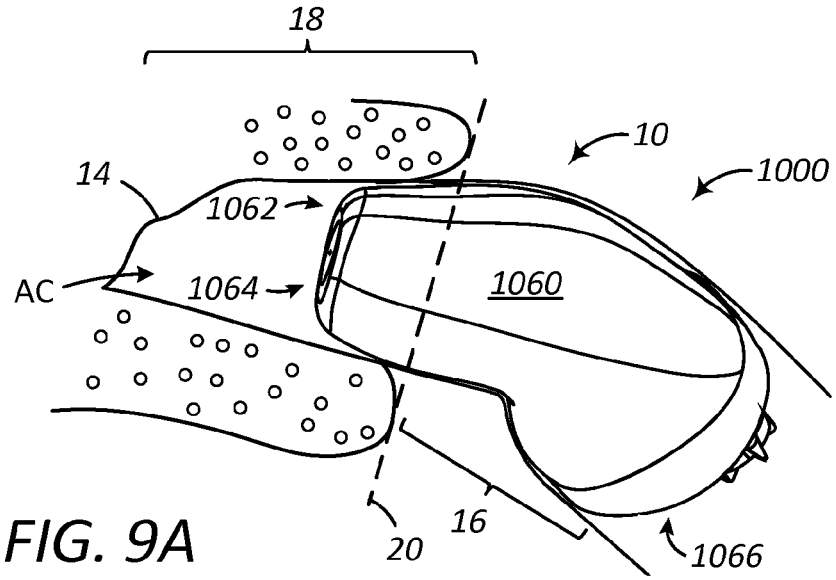
FIG. 9A is a partial section view showing the hearing device illustrated in FIG. 9 placed within the ear canal partially past the bony-cartilaginous junction.

As illustrated in FIGS. 9-9A, in another example embodiment, a hearing device 1000 includes a core 1060 with a medial portion 1062 that includes a sound aperture 1064. At the other end, a lateral portion 1066 (of the core 1060) includes an acoustic sensor engagement/support structure 1068. In this example embodiment, the hearing device 1000 does not include, or require, a seal apparatus (such as seal apparatus 70) and, as shown in FIG. 9A, the hearing device core 1060 includes an exterior portion 1070 that is shaped and/or sized to support the hearing device 1000 within the ear canal 10. In example embodiments, the hearing device core 1060 is provided in the form of a hard shell (e.g., a shell that is custom fit to the ear canal of the user). By way of example, the hearing device core 1060 is made from a hard biocompatible plastic.

Digital manufacturing technologies can be utilized to build the hearing device core. The shell (e.g., made of polyamide) can have an individually customized outer shape. The shape of the user's ear may be determined by direct three-dimensional scanning of the ear canal (and adjacent portions as may be required) or by producing an impression of the ear which subsequently undergoes scanning. The scanning process may be carried out optically, e.g., by laser scanning. The digital data obtained by the scanning process is then used to create the hard shell by an additive or incremental layer-by-layer build up process. Such processes are also known as "rapid prototyping". An example of an additive build-up process is a layer-by-layer laser sintering process of powder material (e.g., polyamide powder). Such processes are also known as "selective laser sintering" (SLS). The basic principle therein is the repeated deposition of a thin layer of material on a surface, with the desired sectional shape then being stabilized, i.e., hardened, by laser action. Other additive layer-by-layer build-up processes are laser stereo-lithography or photo-polymerization. Additional information regarding additive layer-by-layer build-up processes for producing customized shells for hearing aids can be found, for example, in U.S. Pat. No. 6,533,062 to Widmer et al. and U.S. Pat. No. 7,844,065 to von Dombrowski et al., which are incorporated herein by reference.

It should be noted that the present cores are not limited to those with an exterior portion that is custom-shaped and/or sized. For example, the hearing device cores can include other cross-sectional shapes (e.g., such as previously described). Alternatively, or in addition, the core size may taper down to a smaller size, in the anterior-posterior dimension and/or the superior-inferior dimension, from larger sizes at the lateral end to smaller sizes at the medial end, or may vary in size in some other constant or non-constant fashion at least somewhere between the medial and lateral ends.

A contamination guard, if present, may be mounted, for example, on the lateral end of the core 1060. A handle (e.g., such as handle 90), which may be used to remove the hearing device 1000 from the ear canal, may also be provided in some implementations.

FIG. 9A shows the hearing device 1000, sized and shaped in the manner described above, positioned partially within both the ear canal bony region 18 and the cartilaginous region 16 (i.e., positioned on both sides of the bony-cartilaginous junction 20. The sound aperture 1064, which is located at the medial end of the core 1060, faces and is in close proximity to the tympanic membrane 14 (i.e., about 6-8 mm from the umbo of the tympanic membrane). The benefits of such placement are discussed in the Background section above. For example, high fidelity sound is achieved because the receiver is in direct acoustic contact with the air cavity AC (FIG. 9A) between the tympanic membrane 14 and the medial portion 1062 of the hearing device core 1060.

Additionally, as compared to the previously described example embodiment, the larger distance (of ~6-8 mm), in some instances, obviates the need for or decreases the amount of deep canal inside surface dimensions/mapping information required (e.g., no deep impression needed as to areas within the aforementioned distance from the tympanic membrane). Notwithstanding the increase in distance, because of the close proximity of the tympanic membrane, the devices can still productively utilize energy efficient electronics/circuitry (as discussed below in greater detail). Additionally, as compared to the previously described example embodiment, the larger distance (of ~6-8 mm) allows such a hearing device to utilize a lower impedance receiver (as discussed below in greater detail). Moreover, in example embodiments, the hearing device core 1060 is configured such that, when the hearing device 1000 is implanted, the medial portion 1062 is positioned at the larger distance (of ~6-8 mm) and the lateral portion 1066 is positioned sufficiently deep within the ear to allow a person to use a telephone (i.e., position the hand-held receiver portion of the telephone at a distance sufficiently close without it being brought into contact with or otherwise interfere with the hearing device).

In other example embodiments, the hearing device core 1060 is configured such that, when the hearing device 1000 is implanted, the medial portion 1062 is positioned at a distance other than ~6-8 mm from the tympanic membrane. Moreover, in some implementations, positioning of the hearing device core 1060 or a portion thereof is not limited to a particular location in, or in relation to, the ear canal.

Figure 10:
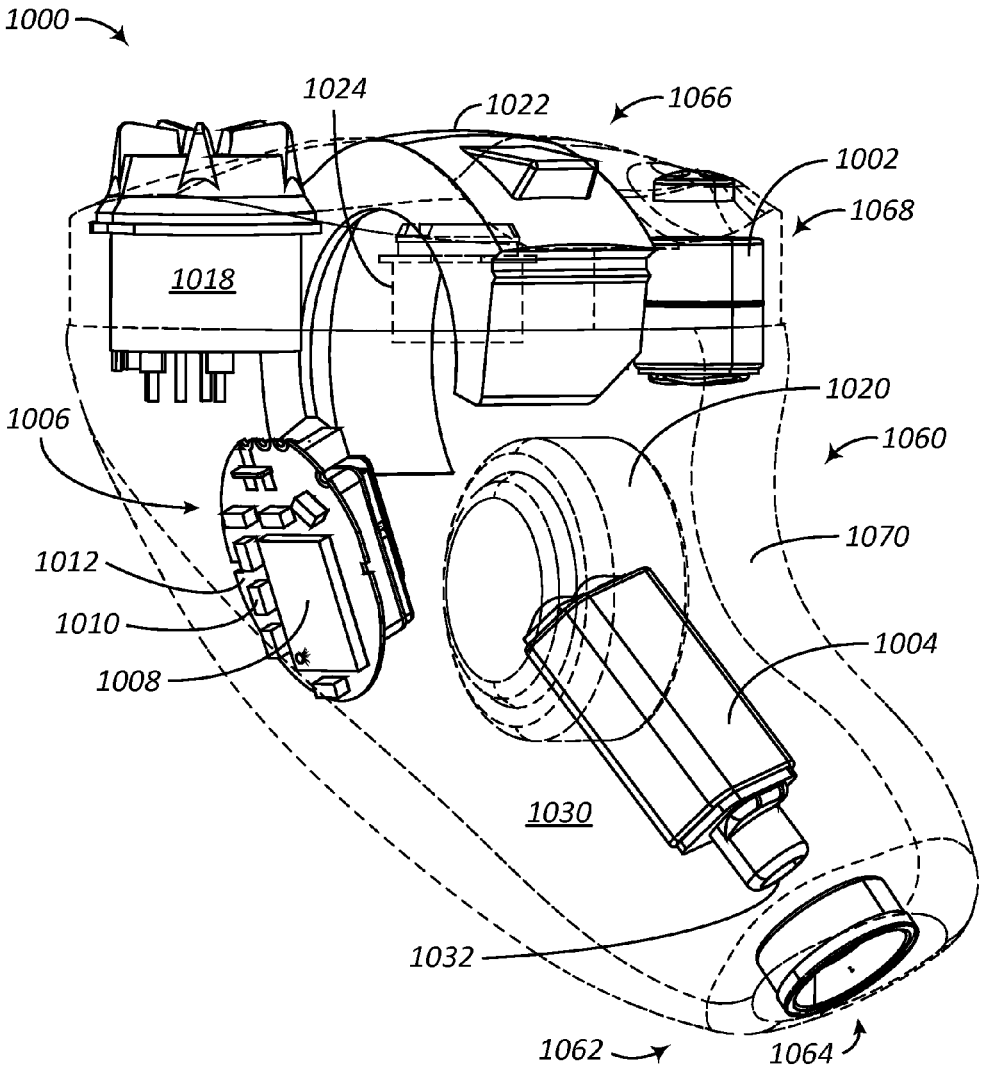
FIG. 10 is a section view showing the hearing device illustrated in FIG. 9.

Referring additionally to FIG. 10, in this example embodiment, the hearing device 1000 includes a microphone 1002, a receiver 1004 and electronics/circuitry 1006 including an integrated circuit or amplifier 1008 and other discrete components 1010 (e.g., capacitors) carried on a substrate 1012. In example embodiments, the electronics/circuitry 1006 additionally and/or alternatively include a folded flex circuit. In this example embodiment, the hearing device 1000 additionally includes a connector or interface port 1018 (optional), a power source/power source assembly 1020 (e.g., a rechargeable battery), and encapsulant 1030. The electronics/circuitry 1006 includes or is provided with electrical connections (not shown) to the microphone 1002, the receiver 1004, the connector or interface port 1018 (if included), and the power source/power source assembly 1020. In this example embodiment, the power source/power source assembly 1020 is shown having an external housing that is generally cylindrical in shape; however, it should be understood that the assembly 1020 and/or components thereof can be provided in other shapes and/or arrangements.

The microphone 1002, the receiver 1004, and the electronics/circuitry 1006 may be referred to as an "acoustic assembly". In example embodiments, the hearing device 1000 includes or is provided with one or more switches or other input mechanisms associated with the acoustic assembly. For example, a switch or other input mechanism is utilized to control one or more aspects of the operation of the hearing device 1000 (e.g., volume setting). The switch can be located, for example, at the lateral end of the core 1060 (e.g., as part of the electronics/circuitry 1006 or a peripheral component). The switch can be part of the connector or interface port 1018, or operatively connected to the electronics/circuitry 1006 via the connector or interface port 1018.

The one or more switches or other input mechanisms can include a magnetically actuated switch (e.g., a reed switch). The user simply places a magnet in close proximity to the core 1060 to actuate the switch. A magnetic shield may be positioned between the magnetically actuated switch and the power source/battery. Other types of user actuated switches may also be employed in place of, or in conjunction with, a magnetically actuated switch. Such switches include, but are not limited to, light-activated switches (e.g., visible or infrared light-activated) and RF-activated switches.

In this example embodiment, the lateral portion 1066 of the hearing device core 1060 includes a cover 1022, which is removable and/or repositionable in relation to the core, and the hearing device 1000 additionally includes a connector or charge port 1024 beneath the cover 1022 (e.g., as shown). The hearing device core 1060 includes or is provided with electrical connections (not shown) between the power source/power source assembly 1020 and the connector or charge port 1024, the latter also being referred to as a "recharge port". The cover 1022 can be coupled or connected to the hearing device core 1060, for example, with a hinge or other suitable mechanism.

A recharge interface (e.g., magnetic and/or electrical) for recharging one or more components of the power source/power source assembly 1020 can be part of the connector or charge port 1024, or operatively connected to the power source/power source assembly 1020 via the connector or charge port 1024. For implementations involving a rechargeable battery, the removable cover is used to access the charging port, and the battery can be positioned within the hearing device core 1060, the shape of which can vary for each user based on their individual ear impression (or otherwise obtained ear dimensions). For hearing device implementations that do not include a rechargeable battery, the connector or charge port 1024 can be omitted, relocated, or "merged" with a different connector or port (e.g., connector or interface port 1018) and, in some instances, the power source/power source assembly 1020 is positioned beneath the cover 1022 to provide access to the power source/power source assembly 1020 and/or a component thereof.

Further with regard to the acoustic assembly, the microphone 1002 may have a housing, with a sound port at one end and a closed end wall at the other, a diaphragm within the housing, and electrical contacts (not shown) that may be connected to the electronics/circuitry 1006. A suitable microphone for use in this example embodiment may be, but is not limited to, a 6000 series microphone from Sonion. Additionally, although the microphone housing in this example embodiment is cylindrical in shape, other shapes may be employed. In this example embodiment, the microphone 1002 is secured by or in relation to the lateral portion 1066 of the core 1060 by the acoustic sensor engagement/support structure 1068. In other implementations, the hearing device core 1060 includes multiple microphones.

The receiver 1004 may have a housing, with a plurality of elongated side walls and end walls, a sound port, a diaphragm, and electrical contacts (not shown) that may be connected to the electronics/circuitry 1006. In this example embodiment, the receiver 1004 has a sound port 1032. A suitable receiver for use in this example embodiment may be, but is not limited to, an FK series receivers from Knowles Electronics. In this example embodiment, the receiver housing is rectangular in shape and the side walls are planar in shape. In other embodiments, a portion of the receiver housing may provide a battery support surface. Other embodiments may employ receivers with other housing shapes and, in at least some instances, the battery support surface will have a corresponding shape.

The encapsulant 1030 in this illustrated embodiment encases the acoustic assembly, but for the locations where sound enters the microphone 1002 and exits the receiver 1004 and, in some implementations, locations adjacent to the electronics/circuitry 1006 and/or the power source/power source assembly 1020 and portions of acoustic assembly that are secured directly to other portions of the hearing device 1000. With respect to the material for the encapsulant 1030, suitable encapsulating materials include, but are not limited to, epoxies and urethanes, and are preferably medical grade.

In example embodiments, the hearing device core 1060 can be configured such that the receiver sound port 1032 either communicates directly with an air volume between the hearing device and the tympanic membrane or communicates with the air volume through a short sound tube (e.g., such as previously discussed). In this example embodiment, the sound port 1032 of the receiver 1004 is positioned (as shown in FIG. 10) a short distance from the sound aperture 1064 of the hearing device core 1060. Alternatively, the hearing device core 1060 can be configured such that the sound port 1032 is positioned closer to the sound aperture 1064 (e.g., protrudes medially, such as previously discussed).

In example implementations, the hearing device core 1060 does not have, and does not need, a sound tube that extends medially from the receiver, as is found in some conventional hearing devices, such as the hearing device disclosed in Shennib. The direct drive of the air cavity between the receiver and tympanic membrane by a short spout or port provides for higher fidelity sound transmission than a sound tube, which can introduce significant distortion.

In other implementations, e.g. an implantation where the receiver sound port does not protrude from the housing, there may be a short sound tube (e.g., less than 2 mm in length) that extends through, or is simply defined by, the encapsulant. Due to this minimal length, the short sound tube will not adversely affect acoustic transmission in the manner that longer sound tubes may. By way of example, for a core that includes a sound tube, the receiver sound port can be an opening in the receiver housing, and a short sound tube extends to the medial end of the encapsulant. The sound tube may simply be a passage through the encapsulant, or may be a tube that extends through the encapsulant.

In example embodiments, the size, shape and configuration of the hearing device core are such that at least a portion of the hearing device core is positionable within the ear canal bony region and the receiver sound port is either communicating directly with an air volume between the hearing device and the tympanic membrane or communicating with the air volume through a short sound tube.

The power source/power source assembly 1020 can include a rechargeable battery, which may be a nickel-metal-hydride (NiMH), nickel cadmium, lithium, or any other type of rechargeable battery. In example embodiments, the power source/power source assembly 1020 includes a single battery or a single cell battery. In other implementations, the power source/power source assembly 1020 includes one or more batteries at least one of which is rechargeable.

In example embodiments, the power source/power source assembly 1020 can include a metal-air battery. Various battery chemistries, including but not limited to lithium primary, lithium-ion, silver zinc, nickel-metal-hydride, nickel zinc, and nickel cadmium, may be used as the power source or as a component thereof.

Although not limited to any particular dimensions and metals, a battery (or other power source) of the power source/power source assembly 1020 is required in example embodiments provide sufficient capacity (e.g., at least 70 mAh) and have a sufficiently low output impedance (e.g., with a magnitude of impedance of up to 200 Ohms at audio frequencies) to power a hearing device for minimum amounts of time (e.g., periods exceeding one month and, in some instances, three months). It should also be noted that in some implementations the aspect ratio and/or the dimensions and arrangements of components of a battery may be specified, provided in different ranges, or vary depending on the output impendence of the battery and/or other requirements.

For hearing devices/systems having a battery/power source (e.g., a rechargeable battery) configured to be generally inaccessible to a user (e.g., located deep within the device core and/or locked in position by encapsulant or other device structure), device size can be reduced in some instances because a swing out or other mechanism for exchanging batteries is not required (to facilitate the handling of very small batteries). In example implementations, hearing devices/systems are configured such that no battery handling is required by the user (e.g., providing a more user-friendly rechargeable hearing device/system).

For hearing devices/systems utilizing rechargeable technologies (such as NiMH, which do not require air as a activator), a shell or portion of the hearing device core can be closed completely (to provide water-resistant hearing devices or portions thereof). Moreover, a closed battery/power source decreases the likelihood of battery leakage.

Figure 11:
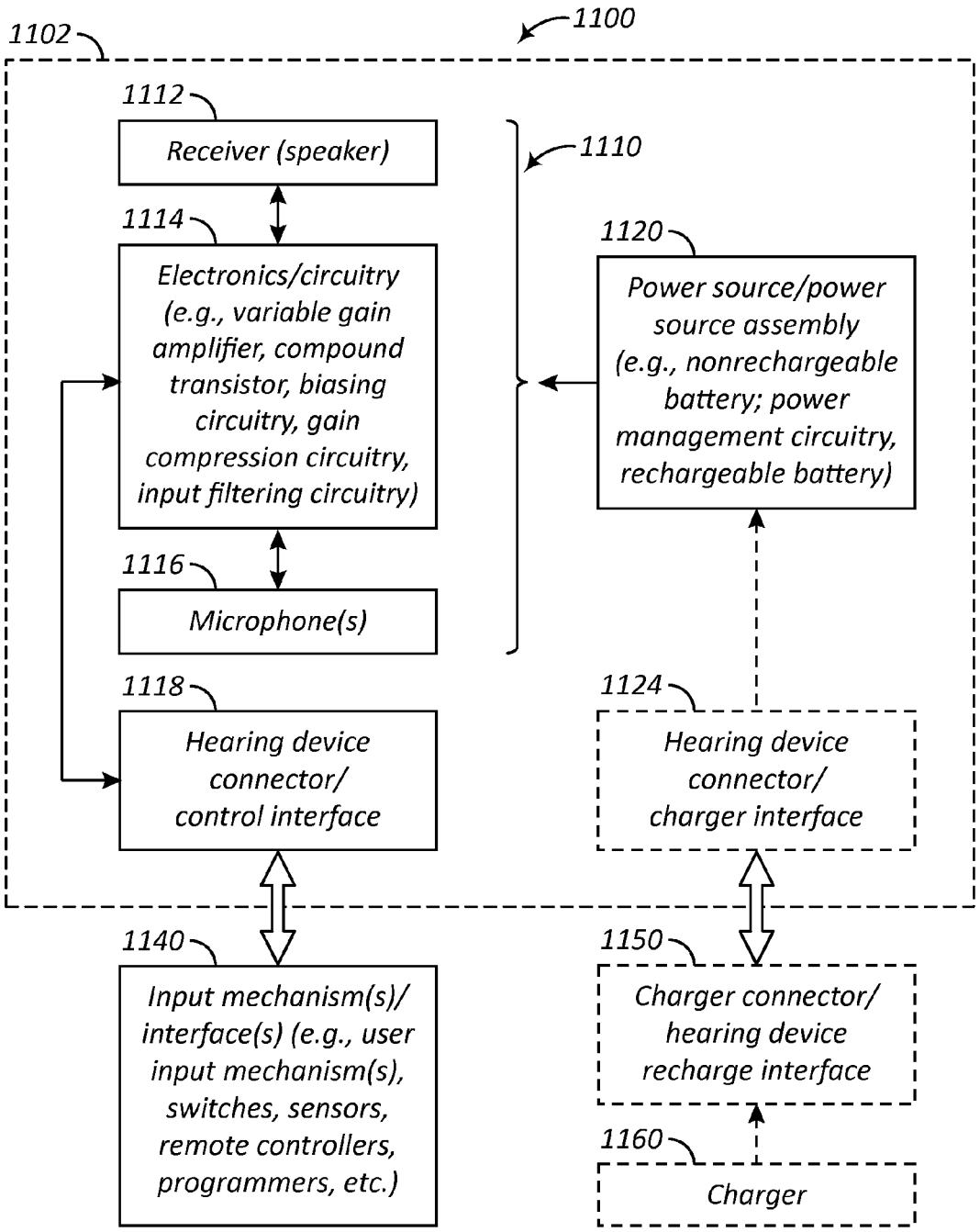
FIG. 11 is a high-level diagram of an example hearing device system.
Figure 12:
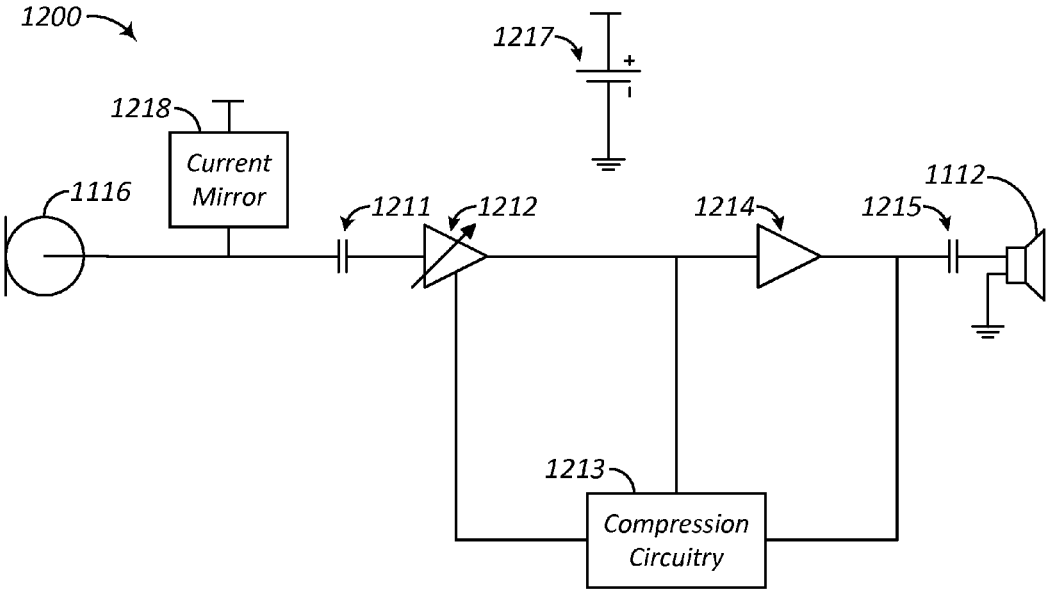
FIG. 12 is an electrical schematic showing an example embodiment of circuitry/electronics for a hearing device, the circuitry/electronics including a variable gain amplifier and compression circuitry.

FIG. 11 is a diagram of an example hearing device system 1100, which includes a hearing device core 1102 (e.g., such as the hearing device core 60 or the hearing device core 1060) and additional components external to the core. Referring to FIG. 11, the hearing device core 1102 in this example implementation includes an acoustic assembly 1110, a power source/power source assembly 1120, and an encapsulant 1030 (FIG. 10) that encases some or all of the acoustic assembly 1110 and the power source/power source assembly 1120. In this example embodiment, the acoustic assembly 1110 includes a receiver (speaker) 1112 (e.g., such as the receiver 104 or the receiver 1004), electronics/circuitry 1114 (e.g., variable gain amplifier, compound transistor, biasing circuitry, gain compression circuitry, input filtering circuitry), and microphone(s) 1116 (e.g., one or more microphones, such as the microphone 102 or the microphone 1002). In particular, it should be noted that in example embodiments the integrated circuit or amplifier 108 and the integrated circuit or amplifier 1080 can be implemented utilizing the electronics/circuitry 1114 or portions thereof (as described below in greater detail). In example embodiments, the electronics/circuitry 1114 are provided as one or more integrated circuits (e.g., as a "chip set") and can include, for example, an application-specific integrated circuit (ASIC) fabricated utilizing design processes and technologies familiar to those of skill in the art. In example embodiments, the electronics/circuitry 1114 of the hearing device system 1100 are configured to operate on a voltage that is generated by a state of the art single cell battery, approximately 1.0 V to 1.5 V.

In a system implementation involving a rechargeable battery, the power source/power source assembly 1120 can include, for example, power management circuitry and a rechargeable battery. For example, the power source assembly 1120 can include a driver unit (e.g., located in a housing common with the rechargeable battery). In this example embodiment, the hearing device core 1060 as illustrated includes a hearing device connector/control interface 1118 (e.g., for providing user inputs to the electronics/circuitry 1114) and additionally, for system implementations involving a rechargeable battery, a hearing device connector/charger interface 1124 (e.g., for establishing an electrical connection to an external charger and/or power source). In this example embodiment, and external to the hearing device core 1060, the system 1100 includes input mechanism(s)/interface(s) 1140 and additionally, for system implementations involving a rechargeable battery, a charger connector/hearing device recharge interface 1150 and a charger 1160 (e.g., power management circuitry) configured as shown. In other implementations, the system 1100 additionally and/or alternatively includes a nonrechargeable battery (e.g., such as the battery 200).

In this example embodiment, the hearing device system 1100 as illustrated includes a "control interface" and a "recharge interface" that utilize separate connection mechanisms; however, as previously mentioned, it should be appreciated that alternatively a single interface or additional interfaces can be provided. Here, in this example implementation, the control interface is provided by and/or utilizes the hearing device connector/control interface 1118 (e.g., such as the connector or interface port 1018, or such as provided/facilitated by the flexible circuit 106) and input mechanism(s)/interface(s) 1140 (e.g., user input mechanism(s), switches, sensors, remote controllers, programmers, etc.). The recharge interface is provided by and/or utilizes the hearing device connector/charger interface 1124 (e.g., such as the connector or charge port 1024) and charger connector/hearing device recharge interface 1150 (e.g., a connector, port, or the like configured to establish or facilitate a recharge interface when operatively connected to the hearing device connector/charger interface 1124). In implementations involving a rechargeable battery (or other rechargeable power source or device), the charger 1160 can include a charging adapter. In example embodiments, an inductive charger may be utilized.

Referring additionally to FIGS. 12-20, example implementations of the hearing device system 1100 and the electronics/circuitry 1114, in particular, are now described. It should be noted that as used herein the term "very low power" refers to electronics/circuitry configured such that a quiescent current associated with an output signal generated by the electronics/circuitry is less than 40 μA. Example embodiments relate to hearing devices (e.g., deep in the canal hearing aids), which operate for long periods of time (e.g., greater than one to three months). The longevity of the device requires very low power consumption. The volume of the battery is limited to the volume of a user's ear canal, and hence battery volume is limited by the user's ear canal dimensions. As previously mentioned, in such example embodiments, a suitable battery (or other power source) should provide sufficient capacity (e.g., at least 70 mAh) and have a sufficiently low output impedance (e.g., with a magnitude of impedance of up to 200 Ohms at audio frequencies) to power a hearing device for minimum amounts of time (e.g., periods exceeding one month and, in some instances, three months). For a lifetime of three months, the quiescent current must be lower than 40 μA. The quiescent current must be considerably lower than the number prescribed above to allow for additional power to flow into the receiver so as to be transconducted into sound, preferably less than 30 μA. Other example embodiments relate to hearing devices with rechargeable batteries (which have significantly less capacity, e.g., at least 8 mAh). In such example embodiments, to achieve a week and a half device lifetime, quiescent current is limited to less than 30 μA. As used herein, the term "ultra-low power" refers to electronics/circuitry configured such that a quiescent current associated with an output signal generated by the electronics/circuitry is less than 10 μA. In example embodiments, the electronics/circuitry 1114 include very low power electronics/circuitry and/or ultra-low power electronics/circuitry suitable for one or more of the hearing device/hearing device system implementations described herein.

In example embodiments, the electronics/circuitry 1114 may include one or more of: a variable gain amplifier, a compound transistor, biasing circuitry, gain compression circuitry, and input filtering circuitry. For example, referring to FIG. 12, the electronics/circuitry 1114 can include or utilize (in whole or in part) electronics/circuitry 1200 which include a variable gain amplifier 1212 and compression circuitry 1213 (e.g., including an envelope filter). In this example embodiment, the electronics/circuitry 1200 additionally include a capacitor 1211 at the input of the variable gain amplifier 1212, a current mirror 1218 between the output of the microphone 1116 and the capacitor 1211, an amplifier 1214 at the output of the variable gain amplifier 1212, a capacitor 1215 between the output of the amplifier 1214 and the input of the receiver 1112, and a battery or power source 1217. Throughout this description, unless discussed otherwise, gate bias potentials are developed or provided, for example, with current mirrors (not shown).

Figure 13:
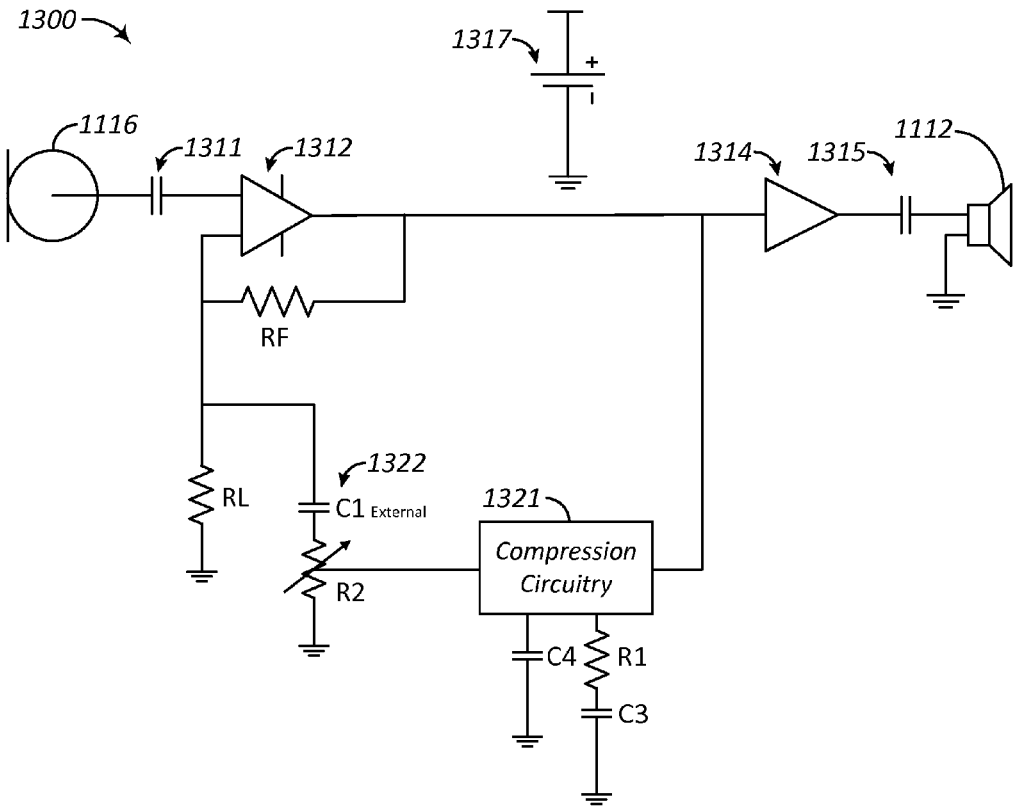
FIG. 13 is an electrical schematic showing an example embodiment of circuitry/electronics for a hearing device, the circuitry/electronics including an amplifier, compression circuitry, and an adjustable high pass filter.

As an additional example, referring to FIG. 13, the electronics/circuitry 1114 can include or utilize (in whole or in part) electronics/circuitry 1300 which include an amplifier 1312 (e.g., a compression amplifier configured with resistor RF connected between the output to an input of the amplifier as shown), compression circuitry 1321 (e.g., including an envelope filter), and an adjustable high pass filter 1322. In this example embodiment, the electronics/circuitry 1300 additionally include a capacitor 1311 at the input of the amplifier 1312, an amplifier 1314 at the output of the compression amplifier 1312, a capacitor 1315 between the output of the amplifier 1314 and the input of the receiver 1112, and a battery or power source 1317.

The electronics/circuitry 1300 provide a single channel compression and limiting amplifier. In this example embodiment, gain compression and limiting are adjusted by controlling the resistance of R2. By way of example, an adjustable resistor (or adjustable resistance component or circuitry) R2 can be employed using a zero bias bipolar transistor, by a MOSFET operating in the linear regime, or by a feedback circuit emulating a resistor (e.g., a variable biased operational transconductance amplifier). In an example embodiment, a zero biased bipolar transistor is used to generate a logarithmic compression curve using a bias current of less than 1 to 4 μA. The electronics/circuitry 1300 can include a fixed resistor RL in parallel with the variable resistor R2 to reduce distortion and power requirements.

In example embodiments, sound is amplified from the microphone 1116 to the receiver 1112 using adjustable gain, adjustable input signal dependent gain compression, and adjustable output signal dependent gain limiting (e.g., as discussed below in greater detail). In this illustrated embodiment, an adjustable high pass filter is also applied to the signal.

The input signal, which can be created by a biased microphone (e.g., as discussed below in greater detail), is AC coupled through the capacitor 1311, then amplified by the compression amplifier 1312. The gain of the compression amplifier 1312 is controlled by the compression circuitry 1321. In this example embodiment, the circuitry 1321 is configured to provide adaptive compression utilizing R1, C3, and C4 and to consume minimal power (as discussed below in greater detail) so as to be compatible with a long device lifetime. The output of the compression amplifier 1312 is buffered by the amplifier 1314. In example embodiments, the output buffer drives a receiver (or speaker) 1112, which is placed near the tympanic membrane. The small volume driven by the receiver 112 allows for high sound pressures from a smaller voltage and current (from the battery). In example embodiments, the battery or power source 1317 includes or constitutes a single battery or a single cell battery, and the electronics/circuitry 1300 are powered from the single battery or a single cell battery. In example embodiments, the electronics/circuitry 1300 are configured to operate powered by a unipolar supply (0–Vcc, as opposed to bipolar +/−Vcc). In example embodiments, the electronics/circuitry 1300 are configured to run powered by low voltages (e.g., around 1 to 1.5 V). Such voltages can be generated, for example, by a current mirror (e.g., configured such as the current mirror 1218 of FIG. 12).

Example methodologies and technologies described herein involve or facilitate biasing a component (e.g., a compound transistor) of electronics/circuitry such that a quiescent current associated with an output signal generated by the electronics/circuitry is limited or controlled. To this end, referring to FIG. 14, the electronics/circuitry 1114 can include or utilize (in whole or in part) electronics/circuitry 1400 which include a variable gain amplifier 1412, compression circuitry 1432 (e.g., including an envelope filter), a compound transistor 1424, and biasing circuitry 1433 (e.g., a DC servo loop) configured for biasing the compound transistor. In this example embodiment, the compound transistor 1424 is provided by a Sziklai pair (Q1 and Q2) configured as shown, however, in alternative implementations a compound transistor other than a Sziklai pair can be utilized. In example embodiments, electronics/circuitry (for a hearing device/hearing device system) include input buffering circuitry including a compound transistor or other input stage such as described herein. In this example embodiment, the electronics/circuitry 1400 additionally include a capacitor 1411 at the input of the amplifier 1412, filtering circuitry 1434 at the amplifier output, an amplifier 1414 at the output of the filtering circuitry 1434, a capacitor 1415 between the output of the amplifier 1414 and the input of the receiver 1112, an adjustable high pass filter 1422, and a battery or power source 1417.

In relation to providing a deep canal extended wear hearing aid, for example, electronics/circuitry (for a hearing device/hearing device system) are configured in example embodiments to satisfy all four of the following operational/performance criteria.

1. Current Consumption: The hearing aid must consume a quantity of current commensurate with state of the art batteries, constrained by a volume equal to the available volume in a patient's ear canal, such that a "non-rechargeable" single battery or a single cell battery, provides an operating lifetime that meets or exceeds a minimum specified duration (amount of time). By way of example, for a 3 month lifetime, this current is less than 30 μA.
2. Compression Range: The hearing aid must amplify "quiet sounds" with a high gain on the order of 40 dB, while amplifying "loud sounds" with a small gain, or no gain at all. A "quiet sound" is defined as a sound on the order of 40 dB relative to 20 μPa, while a "loud sound" is defined as a sound on the order of 100 dB relative to 20 μPa. The required compression range is then 40 dB, adjusting the gain from a maximum of 40 dB in quiet environments to a minimum of 0 dB in loud environments.
3. Noise: The hearing aid must not add significant random noise to the amplified signal. To satisfy this requirement, an input referred integrated noise signal should be less than 30 dB relative to 20 μPa integrated from 200 Hz to 5 kHz.
4. Distortion: Low distortion is required, which is defined as less than 5% total harmonic distortion for both loud and quiet input signals as defined above.

In example embodiments, electronics/circuitry (for a hearing device/hearing device system) are configured to operate on a voltage (e.g., generated by a unipolar supply) of approximately 1.0 to 1.5 V. In example embodiments, electronics/circuitry (for a hearing device/hearing device system) are powered by a power source/power source assembly (e.g., the battery or power source 1317) that includes or constitutes a single battery or a single cell battery. In example embodiments, a hearing device/hearing device system battery (or other power source) has a sufficiently low output impedance (e.g., with a magnitude of impedance of up to 200 Ohms at audio frequencies) to power the hearing device/hearing device system for minimum amounts of time (e.g., periods exceeding one month and, in some instances, three months).

In relation to electronics/circuitry satisfying the four previously mentioned operational/performance criteria, and referring for example to the electronics/circuitry 1400, the input buffer circuitry/compound transistor 1424 buffers the input signal from microphone 1116. Moreover, in example embodiments, the compound transistor 1424 includes a Sziklai pair (Q1 and Q2) configured to provide a low current low distortion variable gain amplifier. To this end, in this example embodiment, the electronics/circuitry 1400 additionally include current sources 1425 and 1435 configured as shown and such that Q1 is biased by the current source 1425 to provide very low noise, while Q2 is biased by the current source 1435 through the base of Q1 to provide lower distortion. In this example embodiment, the biasing circuit 1433 (e.g., provided utilizing a DC feedback servo loop) is used to control the current source 1435, which controls the current of Q2. The output of Q1/Q2 is a current, mirrored by Q3. The filter 1434 (optional, for some implementations) can be provided, for example, by external or internal resistors and capacitors. By way of example, the filtering circuitry 1434 can be a high pass filter (e.g., a current mode high-pass filter). In example embodiments, the filtering circuitry 1434 is configured to operate independent of signal level. In example embodiments, the filtering circuitry 1434 is or includes one or more current mode filters. In example embodiments, the adjustable high pass filter 1422 (additionally) provides high pass filtering. In this example implementation, the filter 1422 includes adjustable resistance R2 and a capacitor C1 (provided, for example, by one or more of the components 1010 external to the electronics/circuitry 1006) configured as shown (between the compression circuitry 1432 and the compound transistor 1424), with an output of the compression circuitry 1432 being utilized to control the adjustable resistance R2.

The high impedance of a battery (or other power source) of a hearing device/hearing device system can produce distortion in device electronics/circuitry due to signal dependent power supply fluctuations. Typically this is accounted for by using cascade circuits which regulate the voltage in the gain circuitry at the cost of higher power supply voltages, more power, and worsened noise. In this example embodiment, the very efficient Sziklai pair, Q1 and Q2, could potentially suffer from poor power supply rejection at very high gains. This potential problem is overcome, by way of example, by configuring the electronics/circuitry 1400 such that an overall negative gain of the electronics/circuitry is applied (i.e., the input signal at the microphone 1116 and the output signal at the receiver 1112 are 180 degrees out of phase). The majority of power supply ripple is typically a result of current flowing from the battery or power source 1417 through the receiver 1112. If the overall gain of the electronics/circuitry is negative, then the power supply ripple acts to create a negative feedback amplifier. The loop gain of this amplifier then acts to reduce the distortive effects of signal dependent battery voltage fluctuations. This method of operation further facilitates low power operation while accommodating a range of batteries or other power sources with high output impedances.

In this example embodiment, output buffering is provided by the amplifier 1414 (e.g., a class A/B output stage) and R3 configured as shown to form a transimpedance amplifier to convert the current output of Q3 (and filter 1434, if included) into a voltage at a high open loop gain, resulting in a quiescent current (in the amplifier 1414) which allows the amplifier 1414 to drive the receiver 1112 with a "very low distortion level" which, as used herein, is defined as 3% or less even for "high sound levels" which, as used herein, are defined as 100 dB SPL or greater. In relation to providing a deep canal extended wear hearing aid, for example, the close proximity of the receiver 1112 to the tympanic membrane allows the receiver 1112 (which has a smaller volume to drive as compared to when the receiver is positioned a greater distance from the tympanic membrane) to be smaller in size and have additional magnetic windings applied. Additional windings applied to the receiver 1112 increases the DC resistance of the receiver, which decreases the required quiescent bias current in the amplifier 1414. For a deep canal implementation, with reference to FIG. 14 (for example), the electronics/circuitry 1400 are configured in example embodiments such that the amplifier 1414 operates with a quiescent bias current less than 40 μA and, in some configurations, less than 30 μA or 10 μA.

In example embodiments, electronics/circuitry (for a hearing device/hearing device system) include output buffering circuitry including a transimpedance amplifier (or current-to-voltage converter) or other output stage such as described herein.

Figure 14:
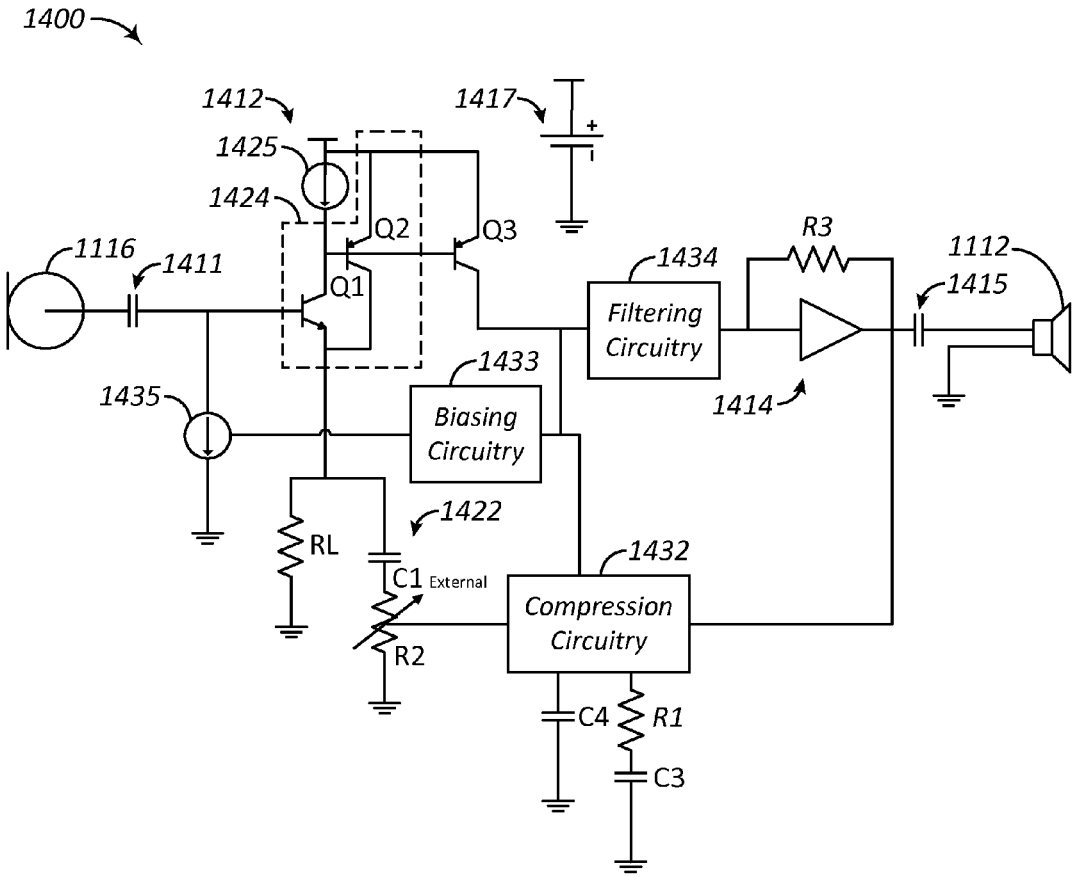
FIG. 14 is an electrical schematic showing an example embodiment of circuitry/electronics for a hearing device, the circuitry/electronics including a variable gain amplifier, an envelope filter, a compound transistor, and a DC servo loop configured for biasing the compound transistor.

Example methodologies and technologies described herein involve or facilitate reducing power consumption by combining input and output compression into one circuit (e.g., a single integrated circuit). Referring to FIG. 14, in example embodiments, the compression circuitry 1432 includes an input and output compressor (e.g., implemented into one circuit). The compression circuitry 1432 can be configured to simultaneously provide input and output compression, for example, by creating a rectified or envelope following signal, which is then logarithmically compressed to control the value of R2 by using the logarithmic properties of a bipolar transistor $V_{BE}$ (e.g., utilizing a bipolar transistor within the compression circuitry 1432). See also U.S. Pat. No. 5,131,046 to Killion et al., which is incorporated herein by reference. The electronics/circuitry 1400 can include a fixed resistor RL in parallel with the variable resistor R2 to reduce distortion and power requirements.

Figure 18:
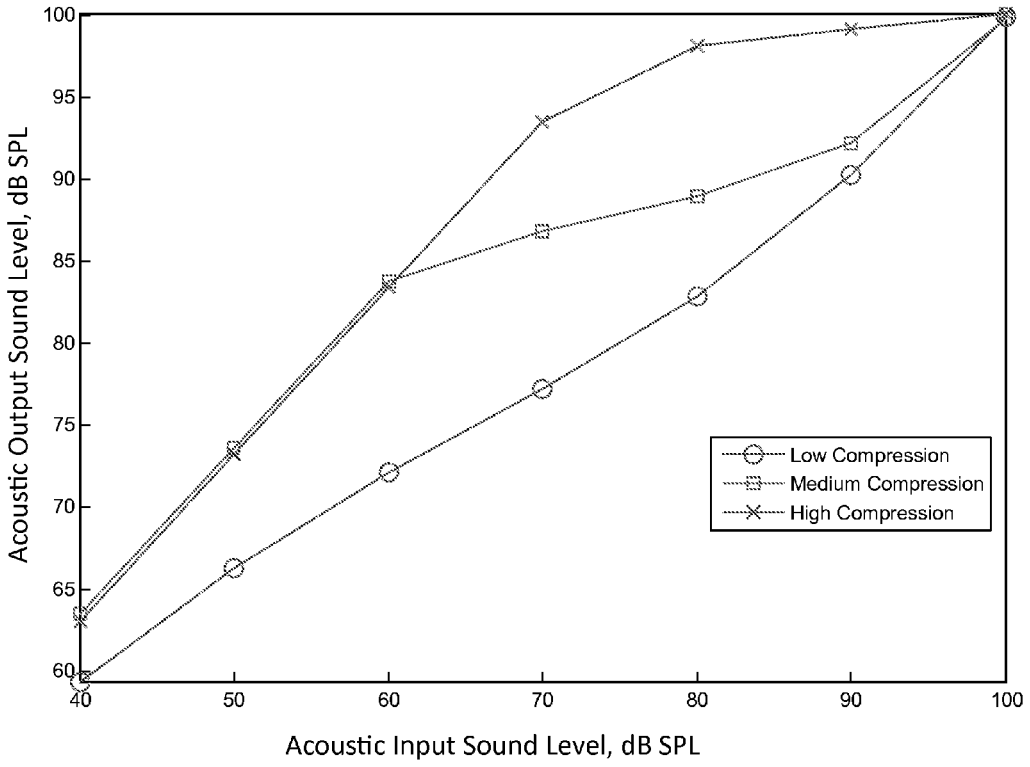
FIG. 18 is a diagram showing variable user selectable compression ratio plots of acoustic output sound level vs. acoustic input sound level at low compression, medium compression, and high compression, respectively.

For hearing device/hearing device system implementations involving (user) adjustable gain, with reference to FIG. 14, the electronics/circuitry 1400 can be configured such that the output current of the compression circuitry 1432 may be (digitally or otherwise) selected so as to control the value of R2 to adjust the gain of the hearing instrument to fit the particularly user's hearing loss profile. In example embodiments, a hearing device/hearing device system is configured to allow a user to provide one or more inputs (e.g., to select or vary a compression ratio). For example, the input mechanism(s)/interface(s) 1140 (e.g., user input mechanism(s), switches, sensors, remote controllers, programmers, etc.) can be utilized to provide one or more user inputs to the electronics/circuitry 1114 via the hearing device connector/control interface 1118. The one or more user inputs can be used to control one or more aspects of the operation of a hearing device/hearing device system (e.g., to facilitate electronics/circuitry operation(s) that are responsive to a user selection and/or modification of a compression ratio). For example, a control interface can be provided that allows a user to select between low compression, medium compression, and high compression. As a diagrammatic example of such a scheme, FIG. 18 shows variable user selectable compression ratio plots of acoustic output sound level vs. acoustic input sound level at low compression, medium compression, and high compression, respectively.

Thus, in an example embodiment, a hearing device includes a hearing device core including an acoustic-to-electric transducer or sensor (e.g., a microphone) that converts sound into an electrical signal (input signal), a receiver (speaker), and electronics configured to receive the electrical signal as an input signal and generate an output signal provided to the receiver, the electronics including a variable gain amplifier with input buffering circuitry including a compound transistor (e.g., a Sziklai pair that receives the input signal), the electronics being configured to bias the compound transistor such that a quiescent current associated with the output signal is limited or controlled. The hearing device core can be configured (shaped) such that the receiver or windings thereof fits deeply in the ear canal in proximity to the tympanic membrane (e.g., in direct acoustic contact with the air cavity between the receiver and tympanic membrane). In example embodiments, the hearing device core is configured (shaped) such that the receiver or windings thereof is positionable in the ear canal in direct acoustic contact with the air cavity between the receiver and the tympanic membrane. In example embodiments, the hearing device core is configured (shaped) such that the receiver or windings thereof is positionable in the ear canal about 4 mm from the umbo of the tympanic membrane. In example implementations, described in relation to FIG. 8, the receiver sound port (at the medial end of the core 60) faces and is in close proximity to the tympanic membrane 14 (i.e., about 4 mm from the umbo of the tympanic membrane). By way of example, a hearing device core suitable for such implementations defines a medial-lateral axis length of about 12 mm, a minor axis length of 3.75 mm or less, and a major axis dimension of 6.35 mm or less. In example embodiments, the hearing device core includes an exterior portion that is custom-shaped and/or sized to support the hearing device within the ear canal.

In example embodiments, the hearing device further includes a seal apparatus on the hearing device core (e.g., configured to support the hearing device core within the ear canal bony portion). The seal apparatus can be configured, for example, to substantially conform to the shape of walls of the ear canal, maintain an acoustical seal between a seal surface and the ear canal, and retain the hearing device securely within the ear canal.

In example embodiments, the electronics are configured (e.g., to bias the compound transistor) such that the quiescent current is less than 10 μA, and the receiver (or receiver winding) is a "high impedance type", which as used herein means having a DC impedance greater than 1 kΩ. In example embodiments, the receiver or receiver winding is a high impedance type (e.g., includes a high impedance receiver winding), with a DC impedance greater than 1 kΩ (to generate sufficiently large sound pressures when operating the receiver close to the tympanic membrane). Since receiver current consumption is inversely related to the number of magnetic turns in the receiver, this has a significant impact of reducing the power consumed of the battery. Additionally, the higher receiver impedance facilitates an amplifier output stage biased at a lower current. In example embodiments, the amplifier operates at substantially less current than 40 μA (e.g., less than 30 μA) and/or operates off of a single battery or a single cell battery (e.g., generating 1 to 1.5 V).

In example embodiments, the hearing device further includes the hearing device core includes a rechargeable battery. In some implementations, device power consumption requirements/criteria are less stringent than those associated with, for example, a deep canal hearing device configured for a 3 month lifetime and with a nonrechargeable battery. For example, a hearing device/hearing device system including a rechargeable battery can include electronics/circuitry configured to drive a low impedance receiver and provide higher acoustical output power (e.g., compared to the aforementioned 3 month device). In implementations of hearing devices including a rechargeable battery, in example embodiments the electronics are configured (e.g., to bias the compound transistor) such that the quiescent current is less than 40 μA (or, alternatively, 30 μA). In example embodiments, the receiver (or receiver winding) is a "low impedance type" (e.g., includes a low impedance receiver winding), which as used here means having a DC impedance less than 1 kΩ. In example embodiments, the electronics are configured to provide an acoustical pressure greater than 100 dB SPL. In example embodiments, the hearing device core includes an exterior portion that is custom-shaped and/or is provided in the form of a hard shell.

In example implementations, the hearing device core includes a battery that is one or more of rechargeable and constituted of a single battery or a single cell battery.

In example embodiments, the electronics include an adjustable resistance component or circuitry (e.g., current-controlled adjustable resistance circuitry) coupled to the compound transistor, the adjustable resistance component or circuitry being configured to facilitate adjusting gain compression and limiting (e.g., adjustable input signal dependent gain compression and adjustable output signal dependent gain limiting) for the variable gain amplifier. By way of example, the adjustable resistance component or circuitry includes (or is implemented utilizing) a current-controlled adjustable resistance circuitry, a zero biased bipolar transistor (e.g., a zero biased bipolar transistor is used to generate a logarithmic compression curve using a bias current of less than 1 to 4 μA), a MOSFET operating in the linear regime, or a feedback circuit emulating a resistor (e.g., a variable biased operational transconductance amplifier). In example embodiments, the electronics include a feedback loop that includes one or more of: a DC servo loop, a compression circuit (e.g., an input and output compression circuit), a high-pass filter, and an adjustable resistor (or resistance). In example embodiments, the electronics include an adjustable component or circuitry electrically coupled to the input buffering circuitry. For example, the electronics in some implementations include a variable (e.g., current-controlled and/or adjustable) resistance component or circuitry (e.g., a variable resistor) electrically coupled to the input buffering circuitry. In example embodiments, the electronics include a capacitor (e.g., a variable capacitor, or switch-controlled capacitor bank) or a filter (e.g., an adjustable high pass filter) between the variable resistance component and the input buffering circuitry (e.g., a filter directly at the input of the amplifier).

Figure 15:
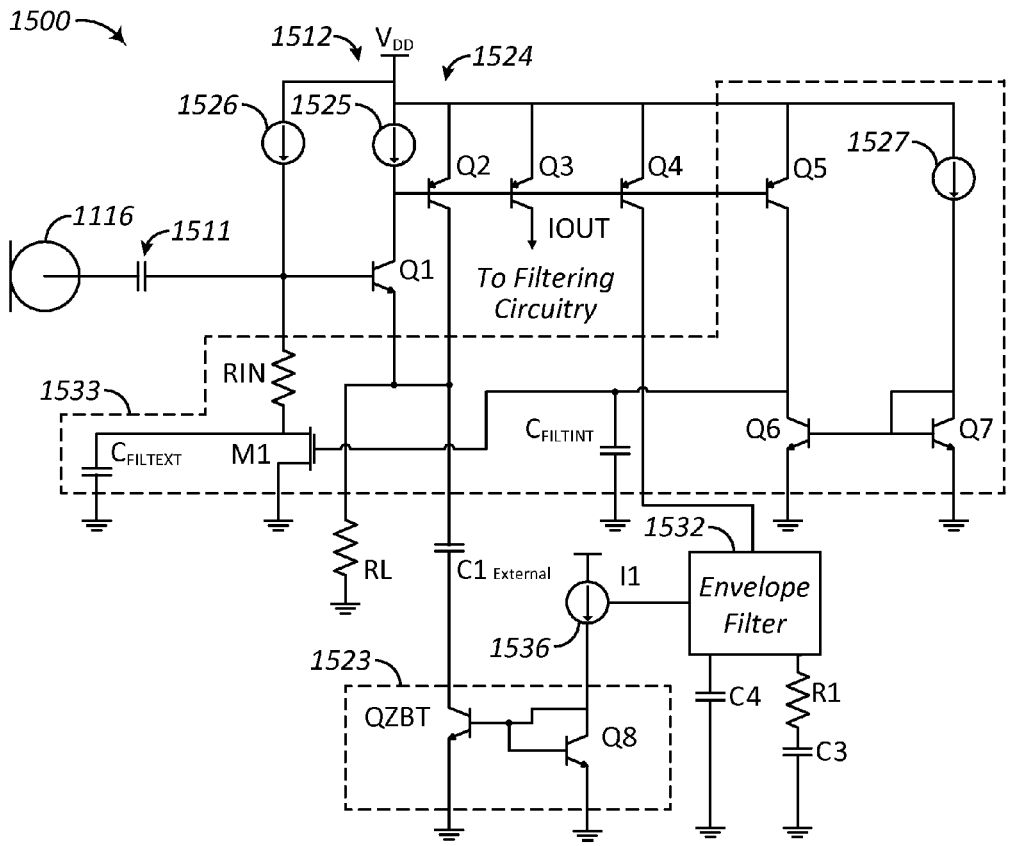
FIG. 15 is an electrical schematic showing an example embodiment of circuitry/electronics for a hearing device, the circuitry/electronics including a variable gain amplifier, an envelope filter, a compound transistor, and variable resistance circuitry configured for biasing the compound transistor.

Further in relation to electronics/circuitry satisfying the four previously mentioned operational/performance criteria, referring to FIG. 15, the electronics/circuitry 1114 can include or utilize (in whole or in part) electronics/circuitry 1500 which include a variable gain amplifier 1512, an envelope filter 1532, a compound transistor 1524, and a variable gain element or circuitry 1523 configured for biasing the compound transistor. As used herein, current values indicated in association with a transistor/device refer to output (collector) current unless otherwise described or illustrated in the figures, and "m" is the multiplicity parameter (or factor), i.e., the number of transistors/devices configured in parallel. In this example embodiment, the compound transistor 1524 is provided by a Sziklai pair Q1 (e.g., 1 μA) and Q2 (e.g., 1.6 μA, m=4) configured as shown, however, in alternative implementations a compound transistor other than a Sziklai pair can be utilized. In this example embodiment, the electronics/circuitry 1500 include transistors Q3 (e.g., 1.6 μA, m=4) and Q4 (e.g., 400 nA, m=1), which are electrically connected at their outputs to the filtering circuitry 1434 (FIG. 14) and the envelope filter 1532.

In relation to electronics/circuitry satisfying the four previously mentioned operational/performance criteria, and referring for example to the electronics/circuitry 1500, the input buffer circuitry/compound transistor 1524 buffers the input signal from microphone 1116. Moreover, in example embodiments, the compound transistor 1524 includes a Sziklai pair (Q1 and Q2) configured to provide a low current low distortion variable gain amplifier. To this end, in this example embodiment, the electronics/circuitry 1500 additionally include current sources 1525 (e.g., 1.1 μA) and 1526 (e.g., 300 nA) configured as shown and such that the current source 1526 provides the appropriate base current for Q1.

The electronics/circuitry 1500 include biasing circuitry 1533 in the form of a DC servo loop, which in this example embodiment includes current source 1527 (e.g., 400 nA), transistor Q5 (e.g., 400 nA, m=1), transistors Q6 and Q7 (e.g., 400 nA), $C_{FILTINT}$ (e.g., 600 μF), n-channel MOSFET M1, $C_{FILTEXT}$ (e.g., 1 μF), and RIN (e.g., 250 kΩ) configured as shown. In this example embodiment, the electronics/circuitry 1500 additionally include a capacitor 1511 at the input of the amplifier 1512, as well as a battery or power source and output components not shown in FIG. 15 for clarity (e.g., such as previously described with reference to the electronics/circuitry 1400).

In this example implementation, a capacitor C1 (provided, for example, by one or more of the components 1010 external to the electronics/circuitry 1006) is configured as shown between the variable gain element or circuitry 1523 and the compound transistor 1524. In example implementations, both C1 and $C_{FILTEXT}$ are external (e.g., to a main integrated circuit of the electronics/circuitry); however, in other embodiments C1 and/or $C_{FILTEXT}$ are integrated/internal or internally implemented (e.g., using one or more feedback techniques). An output of the envelope filter 1532 is utilized to control the variable gain element or circuitry 1523 (as described below in greater detail). The electronics/circuitry 1500 can include a resistor RL (e.g., 150 kΩ) in parallel with the variable gain element or circuitry 1523 to reduce distortion and power requirements.

The variable gain element or circuitry 1523 includes, in this example embodiment, a zero bias transistor pair (Q8/QZBT). In this example implementation, a diode-tied transistor Q8 (e.g., m=1) is connected to the base of transistor QZBT (e.g., m=11) as shown. Configured in this manner, the additional transistor, Q8, acts to linearize QZBT with only a modest amount of additional power being dissipated. In example embodiments, the dynamic range requirements of QZBT are very high, e.g., adjustable from about 1 kΩ up to more than 1 MΩ, a range of more than 60 dB, accommodating signals from a few μVs up to several hundred mVs. The logarithmic properties of one or more zero biased transistors can be utilized to facilitate various implementations of the methodologies and technologies described herein.

The electronics/circuitry can include a current controlled variable resistance, zero biased transistor. In this example embodiment, a current source 1536, electrically connected to the variable gain element or circuitry 1523 as shown, is controlled by an output (I1) of the envelope filter 1532 (e.g., controlling the current source 1536 to provide current of 1 nA to 4 μA). Conventionally, power and distortion limitations attendant to the utilization of a single transistor as a current controlled resistor make it (the transistor) unusable for a very low power circuit. To overcome these limitations, in addition to providing/configuring the zero bias transistor pair (Q8/QZBT) as described above, the ratio of Q8 to QZBT has been beneficially optimized at 1:11 both to save power and to provide sufficient distortion performance for louder sounds. In this example configuration, the current fed into the base of QZBT and collector/base of Q8 totals 4 μA at the highest gain, providing power consumption levels sufficiently low to accommodate the lifetime requirements (previously discussed) of an extended wear hearing device/hearing device system.

Example methodologies and technologies described herein involve or facilitate a current controlled resistor (resistance) implemented in a bipolar transistor. Such a current controlled resistor can be implemented, for example, as shown in relation to the electronics/circuitry 1500, utilizing a small number of biased transistors (e.g., only two in the amplifier 1512, plus one for the current controlled resistor 1523), substantially reducing current consumption. In this example implementation, the high feedback gain of the Sziklai pair (Q1 and Q2) reduces distortion at high signal levels. The noise is dominated only by the input transistor at high gain levels, generating a very favorable noise figure. The output of the circuit is a current generated in compliance with the four previously mentioned operational/performance criteria, a current which is favorable for analog processing in an integrated circuit die. In example implementations, the electronics/circuitry reduce static quiescent current levels to around 25 μA (which is lower by a factor of about 10 as compared to prior systems) while also operating on high amplitude signals above 100 dB relative to 20 μPa with minimal distortion and amplifying small signals with low noise levels.

Thus, in example embodiments, electronics/circuitry for a hearing device/hearing device system include a compound transistor that includes only two biased transistors. In example embodiments, electronics/circuitry for a hearing device/hearing device system include a Sziklai pair combined with a variable resistor (or resistance) and a high pass filter directly in the input stage. In example embodiments, electronics/circuitry for a hearing device/hearing device system include a current controlled resistor (or resistance component or circuitry) coupled to a compound transistor. In example embodiments, the current controlled resistor (or resistance component or circuitry) is implemented in a bipolar transistor. In example embodiments, the current controlled resistor (or resistance component or circuitry) includes only one biased transistor.

The Sziklai pair (Q1 and Q2) allows low noise, low distortion performance at sufficiently low powers, for example, on 1 V batteries. However, in order to achieve the foregoing and other advantageous aspects of the electronics/circuitry, the Sziklai pair has to be properly held at the correct DC bias. Since the DC gain of the pair is very high (approximately Beta squared), as shown in FIG. 15 with reference to this example embodiment, the biasing circuitry 1533 (e.g., a DC servo loop with very high gain) is used to set the appropriate DC bias at the base of Q1. By using semiconductor process matching, the current of Q5 is exactly ¼ of the current in Q3 as the ratio of transistor collectors is 4:1. This matched current is compared to Q6 (e.g., a 400 nA current source), the difference of which is amplified by the n-channel MOSFET M1. The collector of Q6 is filtered by a smaller internal capacitor, $C_{FILTERINT}$ to remove higher frequency AC components. The drain of M1 is filtered again by $C_{FILTEREXT}$ to remove any AC component, down to very low sub-audible frequencies, and then fed to the input of Q1 through a large resistor, RIN (e.g., 250 kΩ). Current source 1526 provides the appropriate base current for Q1, and any left over current (i.e., current not used to bias Q1) biases M1. In this way, the advantageous performance of the Sziklai pair is achieved at a very small current overhead for biasing of less than 1 μA.

Figure 17:
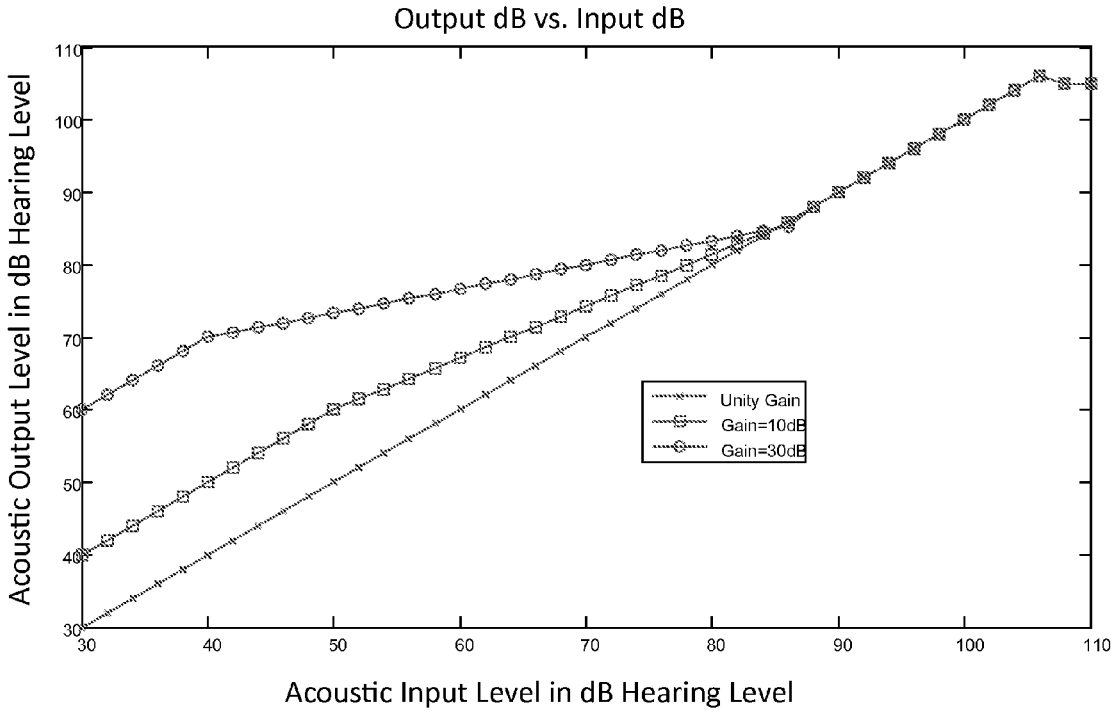
FIG. 17 is a diagram showing low power deep canal hearing aid gain curve plots of acoustic output level vs. acoustic input level at unity gain, gain=10 dB, and gain=30 dB, respectively.

The envelope filter 1532 can be configured, in an example implementation, to take the time average envelope of the microphone signal and adjust the gain of the circuit based on the aforementioned envelope utilizing selected or otherwise determined attack and release times. In example embodiments (as discussed below in greater detail), the envelope filter 1532 is able to adjust the gain of the circuit with a full 40 dB of gain compression, meaning that it can adjust the gain from a maximum of 40 dB for quiet sounds down to 0 dB for loud sound. The extended 40 dB of gain compression ensures that the hearing instrument does not produce clipping for loud sounds in excess of 100 dB SPL due to the combination of the single cell battery operation and high impedance receiver winding (e.g., to reduce power consumption for an extended wear device). In example implementations, the gain is always adjusted to 0 dB for very loud sounds, even if the hearing instrument is set (by the user) to a high gain setting. Setting the gain to 0 dB for loud sounds provides the additional benefit of reducing dynamic power consumption. In example embodiments, the envelope filter 1532 is configured to provide a low distortion linear-in-log AGC input-output curve at very low power. As a diagrammatic example of such a scheme (which can be implemented incorporating and/or responsive to user inputs such as variable user selectable gain), FIG. 17 shows an example of gain input-output curves (gain curve plots of acoustic output level vs. acoustic input level at unity gain, gain=10 dB, and gain=30 dB, respectively) preferred for deep in the canal extended wear hearing aids. In example hearing device/hearing device system implementations, the gain at high acoustic levels is reduced (to limit or reduce user discomfort).

Figure 16:
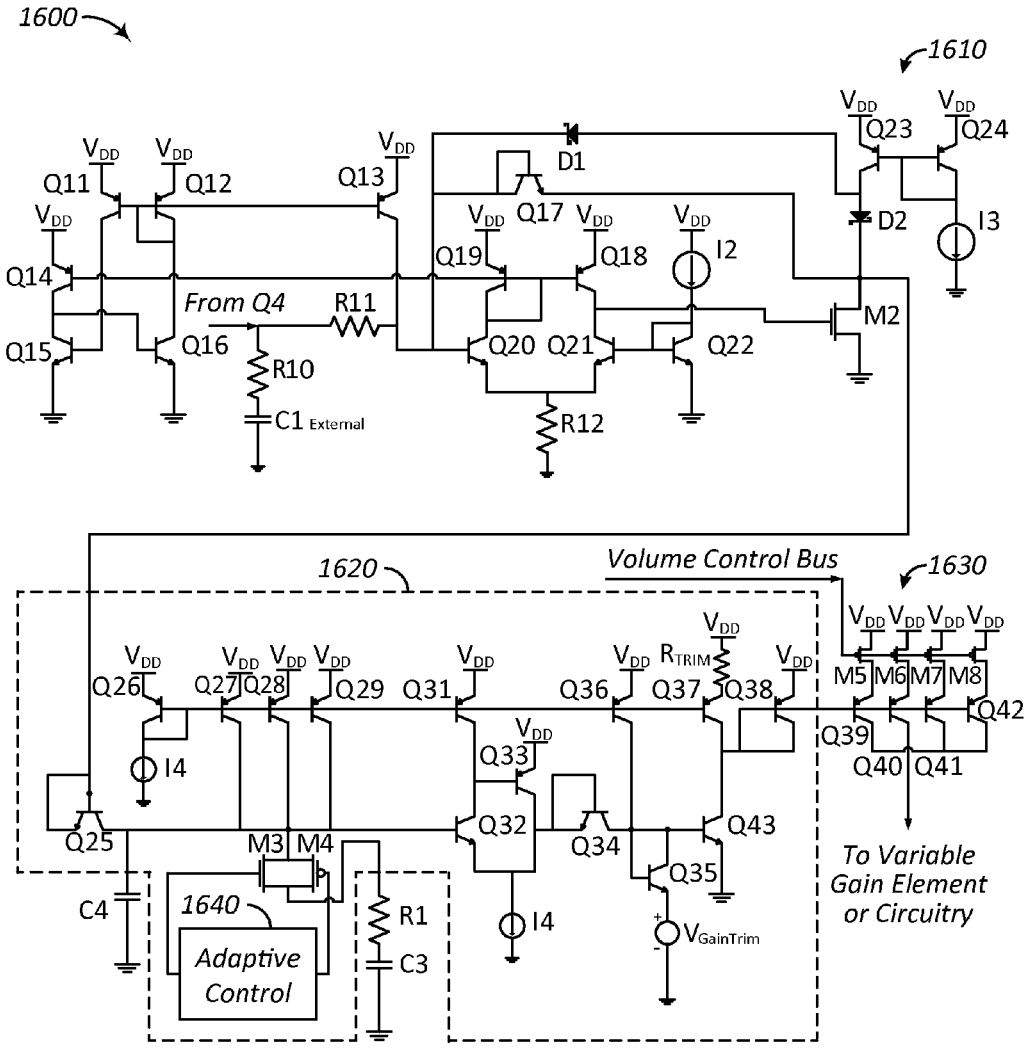
FIG. 16 is an electrical schematic showing an example implementation of the envelope filter.

The compression circuitry and envelope filters described herein can include and/or utilize electronics/circuitry in various implementations. Referring to FIG. 16, the electronics/circuitry 1114 can include or utilize (in whole or in part) an envelope filter 1600 (e.g., including the illustrated circuitry/components configured as shown). In this example implementation, the input of the envelope filter 1600 is fed as a current from Q4 to R10 and R11, which provide filtering to compensate for the real ear resonance existing in any human of ear of magnitude 20 dB at a frequency 2.7 kHz. The transistor Q13 provides base current compensation to the differential pair of Q20 and Q21 which form a differential amplifier with a reference voltage set by Q22 and I2. The input current is converted to a logarithmic voltage using the base emitter junction of Q17. The output is buffered by M2, which is able to drive to GND without saturating. This circuit forms a positive peak logarithmic current to voltage converter 1610 (which includes components at the upper right portion of FIG. 16). D1 and D2 prevent saturation on the negative peaks which are not sampled.

In this example embodiment, the envelope filter 1600 includes an envelope detector 1620 (e.g., including the illustrated circuitry/components configured as shown). In this example implementation, the output of M2 is fed into the envelope detector 1620. The transistor Q25 detects the negative peaks of M2, and is envelope filtered by C4 or the combination of R1/C3 and C4 using adaptive attack and release times (e.g., as described in U.S. Pat. No. 4,718,099 to Hotvet, which is incorporated herein by reference. In this example implementation, the envelope filter 1600 is configured such that the adaptive attack and release times can be switched on or off by the user utilizing M3 and M4 through adaptive control (or controller) 1640. The transistors Q32 and Q33 buffer the voltage at C4 with a very high input impedance. In this example implementation, the envelope filter 1600 is configured such that the transistors Q34, Q35, and Q43 provide 40 dB of gain compression using minimal power. In this regard, Q35 sets the minimum $V_{BE}$ of Q43 at quiet sounds. The voltage $V_{GainTrim}$ trims out process variations in Q43 to establish the maximum available gain. As the amplitude of the acoustic input signals increases, the voltage on C4 decreases and, in turn, the voltage on the emitter of Q34 also decreases. This in turn reduces the voltage on the base of Q43 and reduces the current flowing out of Q43 into Q38. The current in Q38 is mirrored by the arrangement 1630 of transistors Q39-Q42 and is passed to the zero bias transistor pair Q8/QZBT. In this example arrangement of transistors, Q39-Q42, which set the user adjustable gain, only four are drawn for clarity; however, in example embodiments, there can be more logarithmically arranged transistors in the array Q39-Q42. Selecting only one active transistor sets the minimum quiet level gain, while activating all transistors sets the maximum quiet level gain. The transistor Q37 ensures that for loud sounds, Q39-Q42 are completely off to minimize distortion in Q8/QZBT. In this example implementation, the gain set by the envelope filter is completely defined by NPN transistors, Q17, Q22, Q25, Q32, Q34, Q35, Q43, and Q8/QZBT, allowing the gain to be very accurately controlled (e.g., utilizing/in conjunction with semiconductor process matching). This advantage further reduces power consumption by eliminating or minimizing circuitry that is sometimes conventionally required to handle process variations.

Thus, in an example embodiment, an amplification method includes providing a variable gain amplifier (e.g., for a hearing device) with input buffering circuitry that includes a Sziklai pair (or, more generally, a compound transistor), and biasing the Sziklai pair such that a quiescent current associated with an output signal generated by the variable gain amplifier is limited or controlled. In example embodiments, biasing the Sziklai pair includes one or more of, for example: controlling a current source of (one of) the Sziklai pair, using a DC servo loop (or a DC feedback loop) to set a bias of the Sziklai pair, and using a feedback loop (e.g., a DC servo loop with a very high gain) to set a DC bias (e.g., at the base of Q1) of the Sziklai pair.

In an example amplification method, biasing the Sziklai pair includes: comparing a matched current associated with the variable gain amplifier (e.g., such as the current of Q5) with a current source (such as Q6) to provide a difference signal, removing high (higher) frequency AC components from the difference signal to provide a filtered difference signal, amplifying the filtered difference signal (e.g., utilizing n-channel MOSFET M1) to provide an amplified feedback signal, and removing AC components from the amplified feedback signal down to very low sub-audible frequencies to provide a feedback signal for the input buffering circuitry. In example embodiments, biasing the Sziklai pair includes providing a base current for the Sziklai pair (e.g., for Q1) at a current overhead of less than 1 μA for biasing.

The amplification method can also include one or more of, for example: filtering input signals (e.g., utilizing an envelope detector), adjusting gain utilizing a logarithmic compression scheme, linearizing a transistor of a variable gain element (e.g., at the output of gain compression circuitry) such that current fed into the transistor (e.g., the base of transistor QZBT) and circuitry effecting said linearization (e.g., collector/base of Q8) is limited or controlled (e.g., totals 4 μA at the highest gain), and controlling both gain compression and limiting utilizing a variable resistance element.

In an example embodiment, an amplifier (or circuit) for a hearing device includes electronics (e.g., within a hearing device core) configured to receive an electrical signal as an input signal and generate an output signal for driving a receiver of the hearing device, the electronics including a variable gain amplifier with an input stage that includes a Sziklai pair, and circuitry adapted to bias the Sziklai pair such that a quiescent current associated with an output signal generated by the variable gain amplifier is limited or controlled (e.g., such that the quiescent current is less than 10 μA).

In example embodiments, the Sziklai pair receives the input signal. In example embodiments, the Sziklai pair is combined with a variable resistor and a high pass filter directly in the input stage. In example embodiments, the Sziklai pair includes only two biased transistors.

In example embodiments, the electronics include a current controlled resistor (or resistance component or circuitry) coupled to a compound transistor (e.g., the Sziklai pair). In example embodiments, the current controlled resistor (or resistance component or circuitry) is implemented in a bipolar transistor. In example embodiments, the current controlled resistor (or resistance component or circuitry) includes only one biased transistor. In example embodiments, the current controlled resistor is coupled to a Sziklai pair that includes only two biased transistors.

In example embodiments, the electronics include a feedback loop (e.g., including a DC servo loop) configured to set a DC bias of the Sziklai pair.

In an example embodiment, a method of facilitating hearing for a hearing device that includes a variable gain amplifier and a receiver that is positionable in the ear canal includes providing the receiver with a high impedance receiver winding (e.g., with a DC impedance greater than 1 kΩ), positioning the receiver or windings thereof in the ear canal in direct acoustic contact with the air cavity between the receiver and the tympanic membrane (e.g., about 4 mm from the umbo of the tympanic membrane), and limiting or controlling a quiescent current associated with an output signal generated by the variable gain amplifier. For example, limiting or controlling a quiescent current includes biasing an output stage (e.g., a class A/B output stage) of the variable gain amplifier to operate with a very low quiescent bias current (e.g., a quiescent bias current lower than 10 μA). In example embodiments, limiting or controlling a quiescent current includes operating an output stage of the variable gain amplifier as a transimpedance amplifier. In an example implementation involving a high impedance receiver located close to the tympanic membrane, a low quiescent current (<10 μA) output stage (e.g., operating as a transimpedance amplifier) can be biased at considerable lower currents as compared to low impedance receiver implementations.

Figure 22:
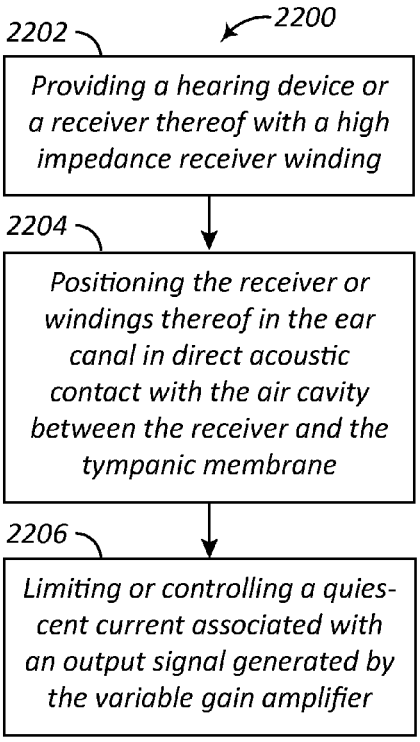
FIG. 22 is a flow chart showing an example method of facilitating hearing.

In summary, and referring to FIG. 22, an example method 2200 of facilitating hearing includes (at 2202) providing a hearing device or a receiver thereof with a high impedance receiver winding. At 2204 and 2206, the method further includes positioning the receiver or windings thereof in the ear canal in direct acoustic contact with the air cavity between the receiver and the tympanic membrane, and limiting or controlling a quiescent current associated with an output signal generated by the variable gain amplifier, In an example embodiment (involving gain compression), a hearing device includes a hearing device core including an acoustic-to-electric transducer or sensor (e.g., a microphone) that converts sound into an electrical signal (input signal), a receiver, and electronics configured to receive the electrical signal as an input signal and generate an output signal provided to the receiver, the electronics including a variable gain amplifier with circuitry utilizing a logarithmic compression scheme (or curve) (e.g., a log compression envelope filter designed to lower the gain for loud signals and increase the quiet signals in a logarithmic fashion) to provide gain compression. The circuitry can include, for example, an envelope filter and a variable gain element (e.g., including a linearized zero biased transistor) coupled thereto. In example embodiments, the envelope filter is configured to provide filtering to compensate for the real ear resonance.

In relation to example embodiments of hearing devices/hearing device systems described herein, the hearing device core can be configured (shaped) such that the receiver or windings thereof fits deeply in the ear canal in proximity to the tympanic membrane (e.g., in direct acoustic contact with the air cavity between the receiver and tympanic membrane). In example embodiments, the hearing device core is configured (shaped) such that the receiver or windings thereof is positionable in the ear canal in direct acoustic contact with the air cavity between the receiver and the tympanic membrane. In example embodiments, the hearing device core is configured (shaped) such that the receiver or windings thereof is positionable in the ear canal about 4 mm from the umbo of the tympanic membrane. In example implementations, described in relation to FIG. 8, the receiver sound port (at the medial end of the core 60) faces and is in close proximity to the tympanic membrane 14 (i.e., about 4 mm from the umbo of the tympanic membrane). By way of example, a hearing device core suitable for such implementations defines a medial-lateral axis length of about 12 mm, a minor axis length of 3.75 mm or less, and a major axis dimension of 6.35 mm or less. In example embodiments, the hearing device core includes an exterior portion that is custom-shaped and/or sized to support the hearing device within the ear canal.

In example embodiments, the hearing device further includes a seal apparatus on the hearing device core (e.g., configured to support the hearing device core within the ear canal bony portion). The seal apparatus can be configured, for example, to substantially conform to the shape of walls of the ear canal, maintain an acoustical seal between a seal surface and the ear canal, and retain the hearing device securely within the ear canal.

In example embodiments, the electronics are configured such that a quiescent current associated with the output signal is less than 10 μA, and the receiver (or receiver winding) is a high impedance type, with a DC impedance greater than 1 kΩ. In example embodiments, the receiver or receiver winding is a high impedance type (e.g., includes a high impedance receiver winding), with a DC impedance greater than 1 kΩ.

In example embodiments, the hearing device core includes a rechargeable battery. In some implementations, device power consumption requirements/criteria are less stringent than those associated with, for example, a deep canal hearing device configured for a 3 month lifetime and with a nonrechargeable battery. For example, a hearing device/hearing device system including a rechargeable battery can include electronics/circuitry configured to drive a low impedance receiver and provide higher acoustical output power (e.g., compared to the aforementioned 3 month device). In implementations including a rechargeable battery, in example embodiments the electronics are configured such that a quiescent current associated with the output signal is less than 40 μA (or, alternatively, 30 μA). In example embodiments, the receiver (or receiver winding) is a low impedance type, with a DC impedance less than 1 kΩ. In example embodiments, the electronics are configured to provide an acoustical pressure greater than 100 dB SPL. In example embodiments, the hearing device core includes an exterior portion that is custom-shaped and/or is provided in the form of a hard shell.

In example implementations, the hearing device core includes a battery that is one or more of rechargeable and constituted of a single battery or a single cell battery.

In example embodiments, the circuitry has a compression ratio that is adjustable by a user of the hearing device/hearing device system (e.g., configured to facilitate adjustable input signal dependent gain compression and adjustable output signal dependent gain limiting). In example embodiments, sound is amplified from the microphone to the receiver using adjustable gain, adjustable input signal dependent gain compression and adjustable output signal dependent gain limiting.

In an example embodiment, an amplifier (or circuit) for a hearing device includes electronics (e.g., within a hearing device core) configured to receive an electrical signal as an input signal and generate an output signal for driving a receiver of the hearing device, the electronics including a variable gain amplifier with circuitry configured to provide gain compression, the circuitry including an envelope filter and a variable gain element including a linearized zero biased transistor that provides gain. In example embodiments, the electronics are configured such that a quiescent current associated with the output signal is less than 10 μA. In example embodiments, the circuitry is configured to facilitate adjustable input signal dependent gain compression and adjustable output signal dependent gain limiting.

The electronics/circuitry, in example implementations, includes (or utilizes) a bipolar transistor and is configured to convert the input current to a logarithmic voltage using the base emitter junction of the bipolar transistor (e.g., such as Q17).

In relation to example embodiments of hearing devices/amplifiers described herein, the envelope filter (e.g., a log compression envelope filter) can include circuitry (e.g., a positive peak logarithmic current to voltage converter) configured to provide filtering to compensate for the real ear resonance and to convert input current (e.g., representing sampled positive peaks) to a logarithmic voltage using the logarithmic properties of a bipolar transistor $V_{BE}$. The envelope filter can include an envelope detector configured to filter the logarithmic voltage (e.g., the buffered output of the logarithmic current to voltage converter) using adaptive attack and release times (e.g., operating on an overall detected signal envelope). The envelope detector can include an adjustable voltage source. In example implementations, the envelope detector includes a first arrangement of transistors configured such that as the amplitude of the (acoustic) input signals increases, a voltage on the emitter of one of the transistors (e.g., such as Q34) decreases reducing the current flowing out of the arrangement of transistors (e.g., to provide the 40 dB of gain compression using minimal power). In example implementations, the first arrangement of transistors includes a transistor (e.g., such as Q35) configured to set the minimum $V_{BE}$ at quiet sounds which are defined as less than 60 dB SPL for an output transistor (e.g., such as Q43) of the arrangement. In example embodiments, the envelope filter further includes a second arrangement of transistors (e.g., an array of logarithmically arranged transistors) coupled to the first arrangement of transistors and configured to set an adjustable gain (e.g., a user adjustable gain). In example implementations, the first arrangement of transistors is configured such that the second arrangement of transistors is completely turned off for loud sounds which are defined as greater than 90 dB SPL (e.g., to minimize distortion in a variable gain element such as Q8/QZBT).

In example embodiments, the gain set by the envelope filter is completely defined by NPN transistors (e.g., such as NPN transistors, being Q17, Q22, Q25, Q32, Q34, Q35, Q43, and Q8/QZBT).

In example embodiments, the envelope filter is configured to provide the variable gain amplifier with a full 40 dB of gain compression (meaning that it can adjust the gain from a maximum of 40 dB for quiet sounds down to 0 dB for loud sounds). In example embodiments, the variable gain element includes a single transistor (e.g., such as QZBT) configured as a current controlled resistor, and an additional diode-tied transistor (e.g., such as Q8) added to the base of QZBT (to linearize the single transistor).

In example embodiments, the variable gain element includes a single (e.g., zero biased bipolar) transistor configured as a current controlled resistor, and a linearizing circuit or element configured to linearize the single transistor (e.g., a diode-tied transistor connected to the base of the single transistor). For example, the current fed into the base of the single transistor (e.g., such as QZBT) and a collector/base of another transistor (e.g., of the linearizing circuit or element) is limited or controlled (e.g., totals 4 μA at the highest gain). In example embodiments, the linearizing circuit or element is a diode-tied transistor connected to the base of the single transistor, and the envelope filter and a variable gain element are configured such that the current fed into the base of the single transistor (e.g., such as QZBT) and the collector/base of the diode-tied transistor (e.g., such as Q8) totals no more than 4 μA at a highest gain (e.g., defined by 40 dB acoustic gain, 55 dB electric gain).

In example embodiments, the hearing device (or amplifier) further includes input buffering circuitry including a compound transistor (e.g., a Sziklai pair that receives the input signal), the electronics being configured to bias the compound transistor such that a quiescent current associated with the output signal is limited or controlled. In example embodiments, the variable gain element is coupled to the input buffering circuitry.

Example methodologies and technologies described herein involve or facilitate gain compression that reduces power consumption. To this end, example embodiments of electronics/circuitry (as previously discussed) are configured to facilitate a hearing device/hearing device system that can utilize a highly sensitive low power microphone, while simultaneously accepting large signals without significant distortion. In an example implementation (e.g., involving a hearing aid) the electronics/circuitry provide high fidelity sound while powered from a single battery or single cell battery. Such a hearing device can be configured to provide customizable filtering and gain settings to fit a particular user's hearing loss and to be remotely digitally programmable. Thus, in an example embodiment, a method for reducing hearing device power consumption includes, in circuitry that provides gain compression for a hearing device, filtering input signals to the hearing device utilizing an envelope detector configured such that as the amplitude of the (acoustic) input signals increases, a voltage on the emitter of a transistor (e.g., such as Q34) associated with the envelope detector decreases reducing the current flowing out of an arrangement of transistors (such as, for example, out of Q43 into Q38) to provide gain compression (e.g., 40 dB of gain compression using minimal power).

Example methodologies and technologies described herein involve or facilitate linearizing a single transistor of a variable gain element or circuitry (and thereby reducing power consumption). In an example embodiment, a method for reducing hearing device power consumption includes, in circuitry that provides logarithmic compression for a hearing device, the circuitry including a variable gain element, linearizing a transistor (e.g., a single transistor) of the variable gain element such that current fed into the transistor (e.g., current fed into the base of a transistor such as QZBT) and circuitry effecting the linearization (e.g., current fed into the collector/base of Q8) is limited or controlled (e.g., totals 4 μA at the highest gain).

Example methodologies and technologies described herein involve or facilitate combining an input and output compressor into one circuit (and thereby reducing power consumption). In an example embodiment, a method for reducing hearing device power consumption includes, in circuitry that provides gain compression for a hearing device, the circuitry including an envelope filter, configuring a variable resistance element at an output of the envelope filter such that both gain compression and limiting are controlled by adjusting the variable resistance element.

Figure 21:
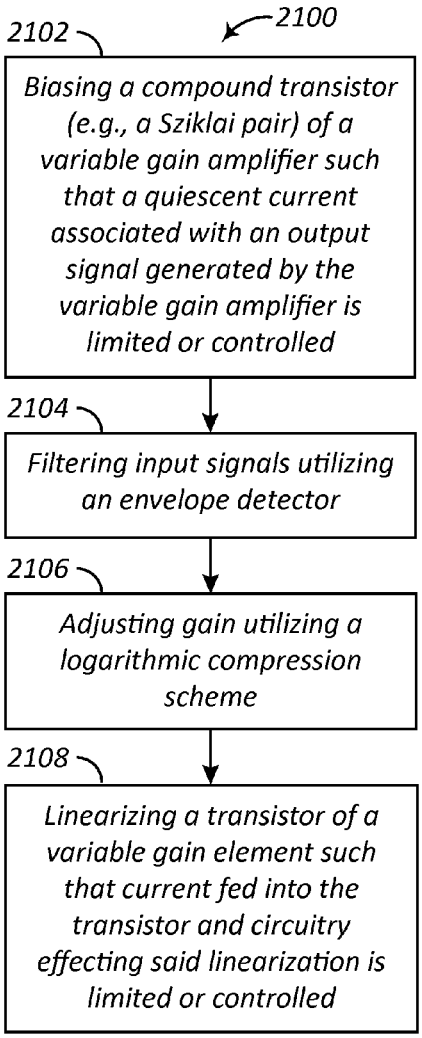
FIG. 21 is a flow chart showing an example method of processing an input signal that represents sound.

In summary, and referring to FIG. 21, an example method 2100 of processing an input signal that represents sound includes (at 2102) biasing a compound transistor (e.g., a Sziklai pair) of a variable gain amplifier such that a quiescent current associated with an output signal generated by the variable gain amplifier is limited or controlled. At 2104 and 2106, the input signals are filtered utilizing an envelope detector and gain is adjusted utilizing a logarithmic compression scheme. At 2108, the method further includes linearizing a transistor of a variable gain element such that current fed into the transistor and circuitry effecting said linearization is limited or controlled.

Figure 19:
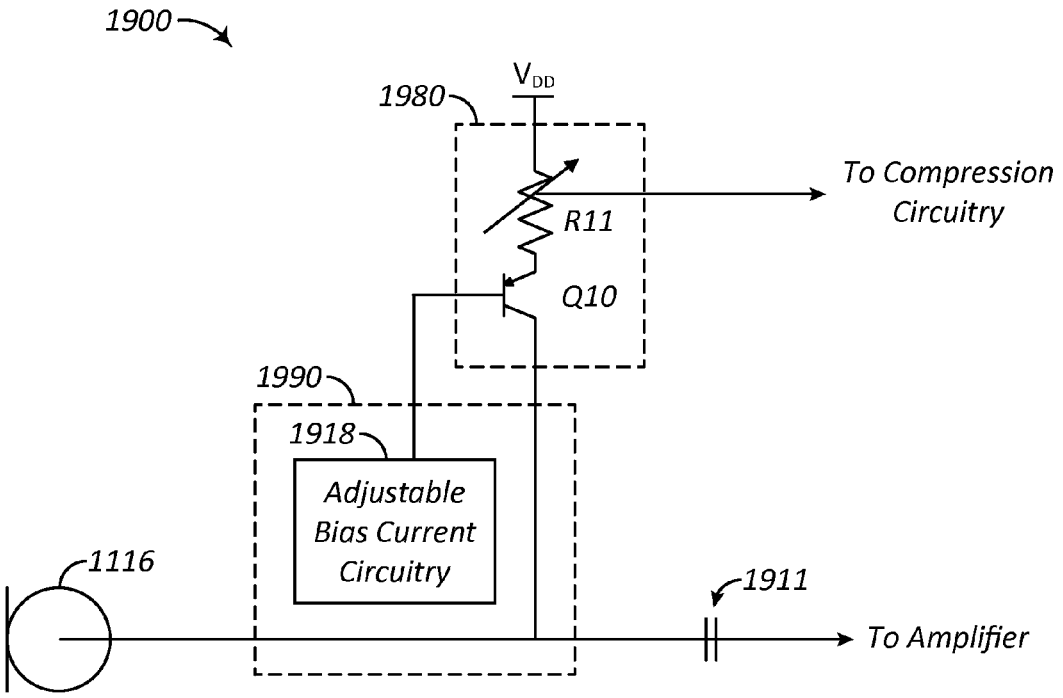
FIG. 19 is an electrical schematic showing an example embodiment of circuitry/electronics for biasing the microphone of a hearing device, the circuitry/electronics including adjustable bias current and adjustable source degeneration circuitry.

Example methodologies and technologies described herein involve or facilitate microphone biasing. Referring to FIG. 19, the electronics/circuitry 1114 can include or utilize (in whole or in part) electronics/circuitry 1900 which include adjustable source degeneration circuitry 1980 and adjustable bias current circuitry 1918 (e.g., configured to provide variable input attenuation). The adjustable source degeneration circuitry 1980 is connected between the microphone 1116 and a battery/power source (e.g., a single cell battery) that powers the circuit (e.g., providing $V_{DD}$ of around 1 to 1.5V). In this example implementation, the adjustable source degeneration circuitry 1980 includes a transistor Q10 and a source degeneration resistor (or resistance) R11, which is used to lower noise at small signal levels (generated by Q10). The transistor Q10 is connected (at the output of microphone 1116) to capacitor 1911, which electrically couples the electronics/circuitry 1900 to the amplifier (e.g., such as the variable gain amplifier 1412). The electronics/circuitry 1900 are configured such that Q10 receives a biasing input from the adjustable bias current circuitry 1918. In this example embodiment, the source degeneration resistor R11 is adjustable and adjusts under control of an output provided by the compression circuitry (e.g., such as the compression circuitry 1432). In other example embodiments, R11 is static (non-adjustable).

The adjustable bias current circuitry 1918 can include or utilize, by way of example, current mirror circuitry configured to be controllable (e.g., by the user) to lower the bias level during a unity gain mode. In some electronics/circuitry implementations, the adjustable bias current circuitry 1918 is not included or optional.

The input signal is generated by the microphone 1116 which is biased by the adjustable bias current circuitry 1918. As previously mentioned, in this example embodiment, the adjustable bias current circuitry 1918 is configured to provide a biasing input to the adjustable source degeneration circuitry 1980, the resistor R11 of which adjusts under control of an output provided by the compression circuitry. In example embodiments, the source degeneration resistor R11 is adjustable and adjusts under control of an output provided by an envelope filter (e.g., such as described herein). By way of example, a compression circuitry/envelope filter output is used to decrease the resistance of R11 (e.g., to achieve beneficial distortion levels at specified signal levels) and to increase the resistance of R11 (e.g., to lowered noise at low signal levels). The microphone 1116, biased per this example implementation, requires a bias voltage of around 0.5 V, combined with signal levels up 0.3 V, which leaves very little headroom for Q10. In example embodiments, R11 is varied (or adjusted) based on the signal level to ensure that the transistor Q10 stays in the active region by ensuring sufficient $V_{CE}$ voltage.

In this example embodiment, the adjustable resistor R11 and transistor Q10 are electrically connected (e.g., as shown) to the microphone output. These connections are provided or facilitated via a microphone interface 1990 which, in this example implementation, additionally includes the aforementioned connection between the adjustable bias current circuitry 1918 and the base of Q10.

Thus, in an example embodiment, a method for biasing a microphone of a hearing device including adjustable source degeneration circuitry (e.g., coupled to the microphone) includes controlling (varying) an adjustable component (or element) of the adjustable source degeneration circuitry (e.g., source degeneration resistor or resistance) depending upon a detected signal envelope associated with sounds impinging upon the microphone (e.g., to ensure that a transistor of the adjustable source degeneration circuitry stays in the active region).

In an example embodiment, the method further includes using the output of an envelope filter (e.g., a log compression envelope filter) to control (vary) the adjustable source degeneration circuitry (e.g., to achieve beneficial distortion levels at signal levels by reducing the source degeneration resistor or resistance, and lowered noise at low signal levels by increasing the source degeneration resistor or resistance.) In example embodiments, the electronics/circuitry are configured such that the output of the envelope filter compensates for the real ear resonance. In example embodiments, the output of the envelope filter is generated by converting input current (e.g., representing sampled positive peaks) to a logarithmic voltage (e.g., using the logarithmic properties of a bipolar transistor $V_{BE}$). In example embodiments, the output of the envelope filter is generated using adaptive attack and release times (e.g., which can be switched on or off by the user), operating on an overall detected signal envelope (rather than a detected peak).

In an example embodiment, the method further includes providing an adjustable bias current to the adjustable source degeneration circuitry (e.g., using current mirror circuitry to lower the bias level during a unity gain mode). In example embodiments, the adjustable bias current is provided using an interface (e.g., a two-wire microphone interface) biased at (a bias level of) 3 μA or less. In an example embodiment, the method further includes adjusting a bias level of the interface (e.g., using a current mirror to lower the bias level during a unity gain mode).

In an example embodiment (involving microphone biasing circuitry), an apparatus for biasing a hearing device microphone (or other acoustic-to-electric transducer or sensor of a hearing device that converts sound into an electrical signal) includes electronics (e.g., within a hearing device core) configured to receive an electrical signal as an input signal and generate an output signal for driving a hearing device receiver, the electronics including adjustable source degeneration circuitry coupled to the hearing device microphone and configured to adjust signal noise responsive to detected sounds impinging upon the hearing device microphone to ensure that a transistor of the adjustable source degeneration circuitry stays in the active region. The electronics may include or utilized an envelope filter (e.g., a log compression envelope filter). In example embodiments, the electronics include one or more of, for example: circuitry (e.g., a positive peak logarithmic current to voltage converter) configured to provide filtering to compensate for the real ear resonance and to convert input current to a logarithmic voltage, and an envelope detector configured to filter the logarithmic voltage (e.g., the buffered output of the logarithmic current to voltage converter) using adaptive attack and release times (e.g., which can be switched on or off by the user), operating on a detected signal envelope.

The apparatus for biasing a hearing device microphone can also include adjustable bias current circuitry configured to provide an adjustable bias current to the adjustable source degeneration circuitry (e.g., using current mirror circuitry). The apparatus can also include an interface (e.g., a two-wire microphone interface) configured to provide an adjustable bias current to the adjustable source degeneration circuitry. In example embodiments, the apparatus/electronics are configured such that the interface is biased at (a bias level of) 3 μA or less.

Figure 23:
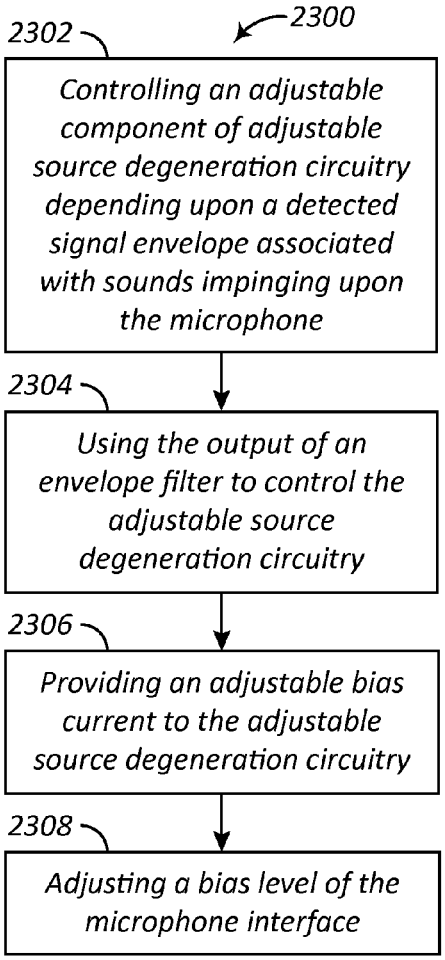
FIG. 23 is a flow chart showing an example method for biasing a microphone of a hearing device.

In summary, and referring to FIG. 23, an example method 2300 for biasing a microphone of a hearing device includes (at 2302) controlling an adjustable component of adjustable source degeneration circuitry depending upon a detected signal envelope associated with sounds impinging upon the microphone. At 2304 and 2306, the method further includes using the output of an envelope filter to control the adjustable source degeneration circuitry and providing an adjustable bias current to the adjustable source degeneration circuitry. At 2308, the method further includes adjusting a bias level of the microphone interface.

Figure 20:
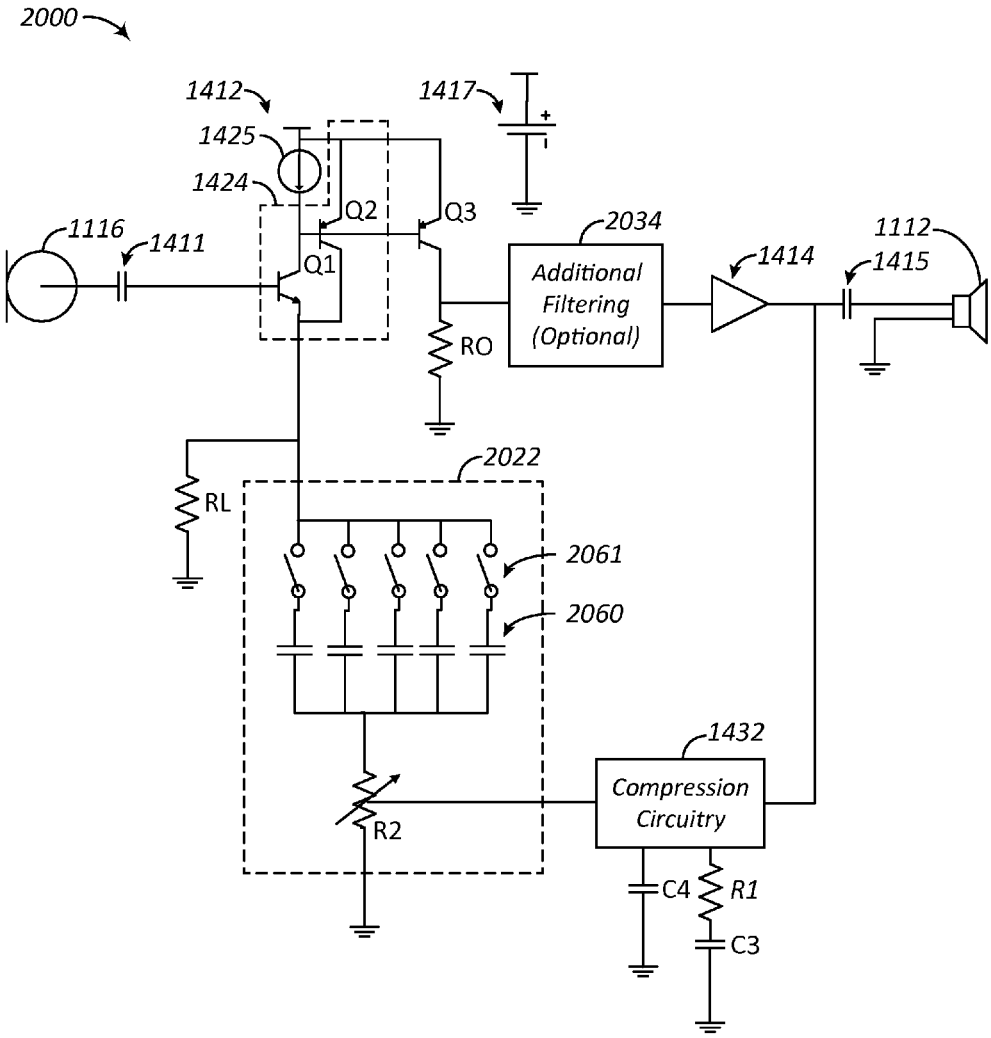
FIG. 20 is an electrical schematic showing an example embodiment of circuitry/electronics for a hearing device, the circuitry/electronics including adjustable circuitry for filtering on the input.

Referring to FIG. 20, the electronics/circuitry 1114 can include or utilize (in whole or in part) electronics/circuitry 2000 which include adjustable capacitance and/or resistance circuitry 2022. In example embodiments, the circuitry can include one or more of, for example: a capacitor or capacitance (e.g., a variable capacitor, or switch-controlled capacitor bank) and a filter (e.g., an adjustable high pass filter). In example embodiments, one or more portions of the electronics/circuitry 2000 (e.g., including the adjustable capacitance and/or resistance circuitry 2022) are configured to filter or facilitate filtering on the input.

Circuit components in electronics/circuitry 2000 having like reference numerals to components in electronics/circuitry 1400 may be provided as previously described, said descriptions being incorporated herein by reference. In this example embodiment, the adjustable capacitance and/or resistance circuitry 2022 includes a variable capacitor (or capacitance) 2060 provided in the form of a capacitor bank and switches 2061. In this example implementation, the circuitry 2022 and variable resistor R2 are arranged in series and electrically connected, respectively, to the compound transistor 1424 and the compression circuitry 1432. The adjustable capacitance and/or resistance circuitry 2022 can be implemented, as in this example embodiment, including or utilizing an adjustable high pass filter having a corner frequency that can be varied by selectively actuating (elements of) the switches 2061. As the low signal gain of the circuit is changed (e.g., by the user), the capacitance changes as well to provide the high pass corner frequency. Moreover, filtering happens directly at the input of the amplifier, and hence does not subject the user to low frequency intermodulation distortion in the circuit resulting from an overload on the input. In this example implementation, the corner frequency can be adjusted independently of gain, in contrast with prior known systems in which the low frequency corner is necessary lowered as the gain is increased. Additionally, in this example implementation, the high pass filter is removed as the signal level increases, providing advantage to the user who has normal hearing for very loud sounds. The circuitry 2022 can be implemented to provide a binary filter bank configured to allow independent selection of filter cutoff frequency and gain.

The capacitor bank 2060 and switches 2061 can be configured to allow selection of various series and/or parallel connections of the capacitors to generate a very large number of capacitance combinations from a small number of capacitors. Here, the circuitry 2022 is shown as including five capacitors; however, it should be appreciated that fewer or a greater number of capacitors can be implemented or otherwise provided. In other implementations, one or more of the capacitors can be emulated from an active circuit that uses smaller on-chip capacitors to synthesize the low frequency corner of the high pass filter. The electronics/circuitry 2000 can include a fixed resistor RL in parallel with the adjustable capacitance and/or resistance circuitry 2022 to reduce distortion and power requirements. In electronics/circuitry 2000, the additional filtering 2034 (between Q3 and amplifier 1414) is optional.

Example methodologies and technologies described herein involve or facilitate a current-mode circuit and/or analog processing of a current signal. In an example embodiment, a hearing device includes a hearing device core including an acoustic-to-electric transducer or sensor (e.g., a microphone) that converts sound into an electrical signal (input signal), a receiver (i.e., speaker), and electronics configured to receive the electrical signal as an input signal and generate an output signal provided to the receiver, the electronics including a compound transistor that receives the input signal and generates a current, and circuitry configured for analog processing of the current. The circuitry can include, for example, an integrated circuit (die) configured for analog processing of the current (signal). In example embodiments, the circuitry includes a current-mode circuit (e.g., a translinear circuit) configured for analog processing of the current (signal). The electronics can be configured to bias the compound transistor such that a quiescent current associated with the output signal is limited or controlled. In example embodiments, the electronics are within the hearing device (e.g., within the hearing device core).

In relation to example embodiments of hearing devices/hearing device systems that involve or facilitate a current-mode circuit and/or analog processing of a current signal, the hearing device core can be configured (shaped) such that the receiver or windings thereof fits deeply in the ear canal in proximity to the tympanic membrane (e.g., in direct acoustic contact with the air cavity between the receiver and tympanic membrane). In example embodiments, the hearing device core is configured (shaped) such that the receiver or windings thereof is positionable in the ear canal in direct acoustic contact with the air cavity between the receiver and the tympanic membrane. In example embodiments, the hearing device core is configured (shaped) such that the receiver or windings thereof is positionable in the ear canal about 4 mm from the umbo of the tympanic membrane. In example implementations, described in relation to FIG. 8, the receiver sound port (at the medial end of the core 60) faces and is in close proximity to the tympanic membrane 14 (i.e., about 4 mm from the umbo of the tympanic membrane). By way of example, a hearing device core suitable for such implementations defines a medial-lateral axis length of about 12 mm, a minor axis length of 3.75 mm or less, and a major axis dimension of 6.35 mm or less. In example embodiments, the hearing device core includes an exterior portion that is custom-shaped and/or sized to support the hearing device within the ear canal.

In example embodiments, the hearing device further includes a seal apparatus on the hearing device core (e.g., configured to support the hearing device core within the ear canal bony portion). The seal apparatus can be configured, for example, to substantially conform to the shape of walls of the ear canal, maintain an acoustical seal between a seal surface and the ear canal, and retain the hearing device securely within the ear canal.

In example embodiments, the electronics are configured such that a quiescent current associated with the output signal is less than 10 μA, and the receiver (or receiver winding) is a high impedance type, with a DC impedance greater than 1 kΩ. In example embodiments, the receiver or receiver winding is a high impedance type (e.g., includes a high impedance receiver winding), with a DC impedance greater than 1 kΩ.

In example embodiments, the hearing device core includes a rechargeable battery. In some implementations, device power consumption requirements/criteria are less stringent than those associated with, for example, a deep canal hearing device configured for a 3 month lifetime and with a nonrechargeable battery. For example, a hearing device/hearing device system including a rechargeable battery can include electronics/circuitry configured to drive a low impedance receiver and provide higher acoustical output power (e.g., compared to the aforementioned 3 month device). In implementations including a rechargeable battery, in example embodiments the electronics are configured such that a quiescent current associated with the output signal is less than 40 μA (or, alternatively, 30 μA). In example embodiments, the receiver (or receiver winding) is a low impedance type, with a DC impedance less than 1 kΩ. In example embodiments, the electronics are configured to provide an acoustical pressure greater than 100 dB SPL. In example embodiments, the hearing device core includes an exterior portion that is custom-shaped and/or is provided in the form of a hard shell.

In example implementations, the hearing device core includes a battery that is one or more of rechargeable and constituted of a single battery or a single cell battery.

In an example embodiment (involving analog processing), an amplifier for a hearing device includes electronics (e.g., within a hearing device core) configured to receive an electrical signal as an input signal and generate an output signal for driving a receiver of the hearing device, the electronics including an input buffering stage (e.g., input buffering circuitry) including a Sziklai pair that receives the input signal and generates a current (signal), and circuitry configured for analog processing of the current to provide the output signal.

The electronics can include, for example, an integrated circuit (die) configured for analog processing of the output signal. In example embodiments, the electronics include a current-mode circuit (e.g., a translinear circuit) configured for analog processing of the output signal. The electronics can be configured such that the current is mirrored by a transistor (e.g., such as Q3) of the input buffering stage.

In example embodiments, the amplifier further includes filtering circuitry (e.g., such as the filtering circuitry 1434) between the input buffering stage and the receiver. The filtering circuitry (e.g., an adjustable high-pass filter) can additionally, or alternatively, be provided on the input of the electronics. The filtering circuitry (e.g., a DC servo loop) can additionally, or alternatively, be provided as part of a feedback loop. In example embodiments, the electronics include an output buffering stage (e.g., including a transimpedance amplifier) configured to convert the current into a voltage at a high open loop gain which is defined as around 60 dB in order to control a quiescent current in the output buffering stage, which drives the receiver with a very low distortion level which is defined as 3% or less even for high sound levels which are defined as 100 dB SPL or greater. In example embodiments, the electronics are configured to provide an overall gain that is negative.

In an example embodiment (involving analog processing), a method of improving sound quality in a hearing device that includes an acoustic-to-electric transducer or sensor (e.g., a microphone) and a receiver (i.e., speaker) includes receiving (an electrical signal as) an input signal provided by the acoustic-to-electric transducer or sensor (e.g., a microphone) that represents sound, generating a current (signal) from the input signal, and analog processing the current to generate an output signal provided to the receiver. In example implementations, the current is generated utilizing a compound transistor (e.g., a Sziklai pair). In such implementations, the method can also include biasing the compound transistor such that a quiescent current associated with the output signal is limited or controlled. In example embodiments, analog processing the current includes performing a current-mode operation. In example embodiments, the current is analog processed utilizing a translinear circuit. In example embodiments, the current is analog processed utilizing an analog integrated circuit (e.g., located within the hearing device).

Figure 24:
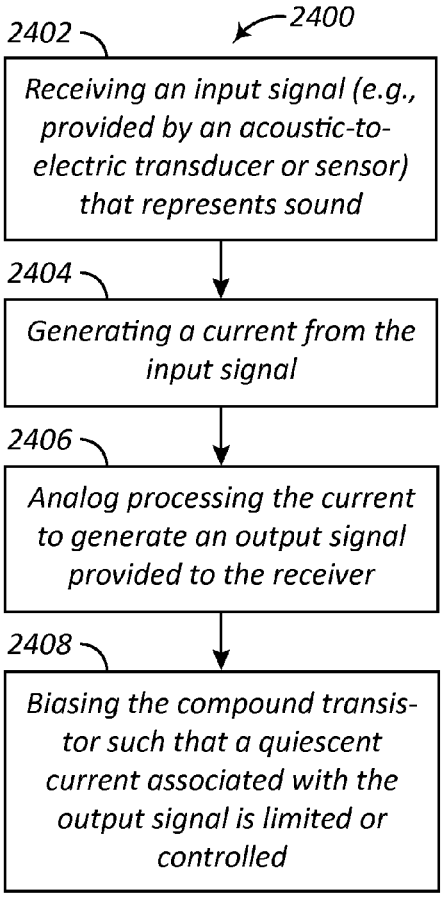
FIG. 24 is a flow chart showing an example method of improving sound quality in a hearing device.

In summary, and referring to FIG. 24, an example method 2400 of improving sound quality in a hearing device includes (at 2402) receiving an input signal (e.g., provided by an acoustic-to-electric transducer or sensor) that represents sound. At 2404 and 2406, the method further includes generating a current from the input signal and analog processing the current to generate an output signal provided to the receiver. At 2408, the compound transistor is biased such that a quiescent current associated with the output signal is limited or controlled.

Example methodologies and technologies described herein involve or facilitate input filtering (filtering on the input). In an example embodiment, a method of improving sound quality for a hearing device includes filtering an input signal provided to a hearing device, the filtering including one or more of the following: filtering directly at the input of a variable gain amplifier of the hearing device (and hence does not subject the user to low frequency intermodulation distortion in the circuit resulting from an overload on the input), varying one or more adjustable components of a filtering circuit in response to changes (e.g., user changes) in gain (e.g., low signal gain), utilizing a filtering circuit that generates a corner frequency independently of gain, utilizing an adjustable high pass filter which is removed as the level of the input signal increases, varying an adjustable component of a filtering circuit depending upon an overall detected signal envelope (rather than a detected peak), and varying an adjustable component of a filtering circuit in response to an output of circuitry (e.g., an envelope filter) utilized to provide gain compression (e.g., utilizing a logarithmic compression scheme).

In an example embodiment (involving input filtering), a hearing device includes a hearing device core including an acoustic-to-electric transducer or sensor (e.g., a microphone) that converts sound into an electrical signal (input signal), a receiver (i.e., speaker), and electronics (e.g., within the hearing device) configured to receive the electrical signal as an input signal and generate an output signal provided to the receiver, the electronics including a variable gain amplifier with filtering circuitry that filters directly at the input of the variable gain amplifier (and hence does not subject the user to low frequency intermodulation distortion in the circuit resulting from an overload on the input).

The filtering circuitry can include one or more components that are adjustable to provide a variable capacitance (e.g., a network a capacitors and switches facilitating multiple different series and/or parallel connections of the capacitors). In other implementations, the filtering circuitry utilizes or is provided by an emulated variable capacitance. In example embodiments, the electronics are configured such that a capacitance associated with the filtering circuitry changes (e.g., to provide the ideal high pass corner frequency) in response to changes (e.g., user changes) in the gain (e.g., low signal gain of the circuit).

The filtering circuitry can include an adjustable high pass filter that generates a corner frequency. For such implementations, in example embodiments, the electronics are configured such that the corner frequency is adjustable independently of gain and/or such that the adjustable high pass filter is removed as the signal level increases (providing advantage to the user who has normal hearing for very loud sounds).

In example embodiments, the filtering circuitry includes an adjustable capacitance component and an adjustable resistance component (e.g., in series), and the electronics are configured to generate an output to control (vary) the adjustable resistance component. For example, the electronics include (or utilize) an envelope filter (e.g., a log compression envelope filter) that generates the output. For such implementations, in example embodiments, the output of the envelope filter is generated by converting input current (e.g., representing sampled positive peaks) to a logarithmic voltage (e.g., using the logarithmic properties of a bipolar transistor $V_{BE}$). For such implementations, in example embodiments, the output of the envelope filter is generated using adaptive attack and release times (e.g., which can be switched on or off by the user), operating on an overall detected signal envelope (rather than a detected peak). In example embodiments, the electronics are configured such that a quiescent current associated with the output signal is limited or controlled.

In relation to example embodiments of hearing devices/hearing device systems that involve or facilitate input filtering (filtering on the input), the hearing device core can be configured (shaped) such that the receiver or windings thereof fits deeply in the ear canal in proximity to the tympanic membrane (e.g., in direct acoustic contact with the air cavity between the receiver and tympanic membrane). In example embodiments, the hearing device core is configured (shaped) such that the receiver or windings thereof is positionable in the ear canal in direct acoustic contact with the air cavity between the receiver and the tympanic membrane. In example embodiments, the hearing device core is configured (shaped) such that the receiver or windings thereof is positionable in the ear canal about 4 mm from the umbo of the tympanic membrane. In example implementations, described in relation to FIG. 8, the receiver sound port (at the medial end of the core 60) faces and is in close proximity to the tympanic membrane 14 (i.e., about 4 mm from the umbo of the tympanic membrane). By way of example, a hearing device core suitable for such implementations defines a medial-lateral axis length of about 12 mm, a minor axis length of 3.75 mm or less, and a major axis dimension of 6.35 mm or less. In example embodiments, the hearing device core includes an exterior portion that is custom-shaped and/or sized to support the hearing device within the ear canal.

In example embodiments, the hearing device further includes a seal apparatus on the hearing device core (e.g., configured to support the hearing device core within the ear canal bony portion). The seal apparatus can be configured, for example, to substantially conform to the shape of walls of the ear canal, maintain an acoustical seal between a seal surface and the ear canal, and retain the hearing device securely within the ear canal.

In example embodiments, the electronics are configured such that a quiescent current associated with the output signal is less than 10 μA, and the receiver (or receiver winding) is a high impedance type, with a DC impedance greater than 1 kΩ. In example embodiments, the receiver or receiver winding is a high impedance type (e.g., includes a high impedance receiver winding), with a DC impedance greater than 1 kΩ.

In example embodiments, the hearing device core includes a rechargeable battery. In some implementations, device power consumption requirements/criteria are less stringent than those associated with, for example, a deep canal hearing device configured for a 3 month lifetime and with a nonrechargeable battery. For example, a hearing device/hearing device system including a rechargeable battery can include electronics/circuitry configured to drive a low impedance receiver and provide higher acoustical output power (e.g., compared to the aforementioned 3 month device). In implementations including a rechargeable battery, in example embodiments the electronics are configured such that a quiescent current associated with the output signal is less than 40 μA (or, alternatively, 30 μA). In example embodiments, the receiver (or receiver winding) is a low impedance type, with a DC impedance less than 1 kΩ. In example embodiments, the electronics are configured to provide an acoustical pressure greater than 100 dB SPL. In example embodiments, the hearing device core includes an exterior portion that is custom-shaped and/or is provided in the form of a hard shell.

In example implementations, the hearing device core includes a battery that is one or more of rechargeable and constituted of a single battery or a single cell battery.

In an example embodiment (involving input filtering), an input circuit for a hearing device includes electronics configured to receive an electrical signal as an input signal and generate an output signal for driving a receiver of the hearing device, the electronics including a variable gain amplifier with filtering circuitry that filters at the input of the variable gain amplifier, the filtering circuitry including an adjustable high pass filter that generates a low frequency corner, the electronics being configured such that the low frequency corner is adjustable independently of gain. The electronics can be configured, for example, such that a capacitance associated with the filtering circuitry changes in response to changes in the gain and/or such that the adjustable high pass filter is removed as the signal level increases (providing advantage to the user who has normal hearing for very loud sounds). In example embodiments, the filtering circuitry filters directly at the input of the variable gain amplifier (and hence does not subject the user to low frequency intermodulation distortion in the circuit resulting from an overload on the input). The filtering circuitry can include one or more components that are adjustable to provide a variable capacitance (e.g., a network a capacitors and switches facilitating multiple different series and/or parallel connections of the capacitors). In other implementations, the filtering circuitry utilizes or is provided by an emulated variable capacitance. In example embodiments, the filtering circuitry includes an adjustable capacitance component and an adjustable resistance component (in series), and the electronics are configured to generate an output to control (vary) the adjustable resistance component. For example, the electronics include (or utilize) an envelope filter (e.g., a log compression envelope filter) that generates the output. For such implementations, in example embodiments, the output of the envelope filter is generated by converting input current (e.g., representing sampled positive peaks) to a logarithmic voltage (e.g., using the logarithmic properties of a bipolar transistor $V_{BE}$). For such implementations, in example embodiments, the output of the envelope filter is generated using adaptive attack and release times (e.g., which can be switched on or off by the user), operating on an overall detected signal envelope (rather than a detected peak). In example embodiments, the electronics are configured such that a quiescent current associated with the output signal is limited or controlled.

Example methodologies and technologies described herein involve or facilitate a hearing device (or hearing device system) with a single battery/cell and ultra-low power electronics. In an example embodiment, a hearing device includes a hearing device core including an acoustic-to-electric transducer or sensor that converts sound into an electrical signal, a receiver, a battery constituted of a single battery or a single cell battery, and electronics configured to receive the electrical signal as an input signal and generate an output signal provided to the receiver, the electronics including a variable gain amplifier configured such that a quiescent current associated with the output signal is less than 10 μA. In example embodiments, the receiver or receiver winding is a high impedance type, with a DC impedance greater than 1 kΩ.

In relation to example embodiments of hearing devices/hearing device systems having a single battery/cell and ultra-low power electronics, the hearing device core can be configured (shaped) such that the receiver or windings thereof fits deeply in the ear canal in proximity to the tympanic membrane (e.g., in direct acoustic contact with the air cavity between the receiver and tympanic membrane). In example embodiments, the hearing device core is configured (shaped) such that the receiver or windings thereof is positionable in the ear canal in direct acoustic contact with the air cavity between the receiver and the tympanic membrane. In example embodiments, the hearing device core is configured (shaped) such that the receiver or windings thereof is positionable in the ear canal about 4 mm from the umbo of the tympanic membrane. In example implementations, described in relation to FIG. 8, the receiver sound port (at the medial end of the core 60) faces and is in close proximity to the tympanic membrane 14 (i.e., about 4 mm from the umbo of the tympanic membrane). By way of example, a hearing device core suitable for such implementations defines a medial-lateral axis length of about 12 mm, a minor axis length of 3.75 mm or less, and a major axis dimension of 6.35 mm or less. In example embodiments, the hearing device core includes an exterior portion that is custom-shaped and/or sized to support the hearing device within the ear canal.

In example embodiments, the hearing device further includes a seal apparatus on the hearing device core (e.g., configured to support the hearing device core within the ear canal bony portion). The seal apparatus can be configured, for example, to substantially conform to the shape of walls of the ear canal, maintain an acoustical seal between a seal surface and the ear canal, and retain the hearing device securely within the ear canal.

Example methodologies and technologies described herein involve or facilitate a hearing device (or hearing device system) with a rechargeable battery and very low power electronics. In an example embodiment, a hearing device includes a hearing device core including an acoustic-to-electric transducer or sensor that converts sound into an electrical signal, a receiver, a rechargeable battery, and electronics configured to receive the electrical signal as an input signal and generate an output signal provided to the receiver, the electronics including a variable gain amplifier configured such that a quiescent current associated with the output signal is less than 40 μA (or, alternatively, 30 μA). In example embodiments, the receiver (or receiver winding) is a low impedance type, with a DC impedance less than 1 kΩ.

In relation to example embodiments of hearing devices/hearing device systems having a rechargeable battery and very low power electronics, the hearing device core can be configured (shaped) such that the receiver or windings thereof fits in the ear canal in proximity to the tympanic membrane (e.g., in direct acoustic contact with the air cavity between the receiver and tympanic membrane). In example embodiments, the hearing device core is configured (shaped) such that the receiver or windings thereof is positionable in the ear canal in direct acoustic contact with the air cavity between the receiver and the tympanic membrane. In example embodiments, described in relation to FIG. 9A, the hearing device core is configured (shaped) such that the receiver or windings thereof is positionable in the ear canal about 6-8 mm from the umbo of the tympanic membrane, and the electronics are configured to provide an acoustical pressure greater than 100 dB SPL. In example embodiments, the hearing device core includes an exterior portion that is custom-shaped and/or is provided in the form of a hard shell.

Although the inventions disclosed herein have been described in terms of the preferred embodiments above, numerous modifications and/or additions to the above-described preferred embodiments would be readily apparent to one skilled in the art. By way of example, but not limitation, the inventions include any combination of the elements from the various species and embodiments disclosed in the specification that are not already described. The claims are not limited to any particular dimensions and/or dimensional ratios unless such dimensions and/or dimensional ratios are explicitly set forth in that claim. It is intended that the scope of the present inventions extend to all such modifications and/or additions and that the scope of the present inventions is limited solely by the claims set forth below.

SUMMARY OF INVENTIVE ASPECTS

The multiple inventions and their embodiments focussing on various aspects of the inventions may be summarized as follows:

1. A hearing device, comprising: a hearing device core including an acoustic-to-electric transducer or sensor that converts sound into an electrical signal, a receiver, and electronics configured to receive the electrical signal as an input signal and generate an output signal provided to the receiver, the electronics including a variable gain amplifier with input buffering circuitry including a compound transistor, the electronics being configured to bias the compound transistor such that a quiescent current associated with the output signal is limited or controlled.

2. The hearing device of inventive aspect 1, wherein the hearing device core is configured such that the receiver or windings thereof fits deeply in the ear canal in proximity to the tympanic membrane.

3. The hearing device of inventive aspect 1, wherein the hearing device core is configured such that the receiver or windings thereof is positionable in the ear canal in direct acoustic contact with the air cavity between the receiver and the tympanic membrane.

4. The hearing device of inventive aspect 1, wherein the hearing device core is configured such that the receiver or windings thereof is positionable in the ear canal about 4 mm from the umbo of the tympanic membrane.

5. The hearing device of inventive aspect 1, wherein the hearing device core defines a medial-lateral axis length of about 12 mm, a minor axis length of 3.75 mm or less, and a major axis dimension of 6.35 mm or less.

6. The hearing device of inventive aspect 1, wherein the hearing device core includes an exterior portion that is custom-shaped and/or sized to support the hearing device within the ear canal.

7. The hearing device of inventive aspect 1, further comprising: a seal apparatus on the hearing device core.

8. The hearing device of inventive aspect 7, wherein the seal apparatus is configured to support the hearing device core within the ear canal bony portion.

9. The hearing device of inventive aspect 7, wherein the seal apparatus is configured to substantially conform to the shape of walls of the ear canal, maintain an acoustical seal between a seal surface and the ear canal, and retain the hearing device securely within the ear canal.

10. The hearing device of inventive aspect 1, wherein the electronics are configured such that the quiescent current is less than 10 μA, and the receiver is a high impedance type, with a DC impedance greater than 1 kΩ.

11. The hearing device of inventive aspect 1, wherein the receiver or receiver winding is a high impedance type, with a DC impedance greater than 1 kΩ.

12. The hearing device of inventive aspect 1, wherein the hearing device core includes a battery that is one or more of rechargeable and constituted of a single battery or a single cell battery.

13. The hearing device of inventive aspect 1, wherein the hearing device core includes a rechargeable battery.

14. The hearing device of inventive aspect 13, wherein the electronics are configured such that the quiescent current is less than 40 μA.

15. The hearing device of inventive aspect 13, wherein the receiver is a low impedance type, with a DC impedance less than 1 kΩ.

16. The hearing device of inventive aspect 13, wherein the electronics are configured to provide an acoustical pressure greater than 100 dB SPL.

17. The hearing device of inventive aspect 13, wherein the hearing device core includes an exterior portion that is custom-shaped and/or is provided in the form of a hard shell.

18. The hearing device of inventive aspect 1, wherein the compound transistor is a Sziklai pair that receives the input signal.

19. The hearing device of inventive aspect 18, wherein the Sziklai pair is combined with a variable resistor and a high pass filter directly in the input stage.

20. The hearing device of inventive aspect 1, wherein the compound transistor includes only two biased transistors.

21. The hearing device of inventive aspect 1, wherein the electronics include a current controlled resistor coupled to the compound transistor.

22. The hearing device of inventive aspect 21, wherein the current controlled resistor includes only one biased transistor.

23. The hearing device of inventive aspect 1, wherein the electronics include an adjustable resistance component or circuitry, the adjustable resistance component or circuitry being configured to facilitate adjusting gain compression and limiting for the variable gain amplifier.

24. The hearing device of inventive aspect 23, wherein the adjustable resistance component or circuitry includes current-controlled adjustable resistance circuitry, a zero biased bipolar transistor, a MOSFET operating in the linear regime, or a feedback circuit emulating a resistor.

25. The hearing device of inventive aspect 1, wherein the electronics include a feedback loop that includes one or more of a DC servo loop, a compression circuit, a high-pass filter, and an adjustable resistor.

26. The hearing device of inventive aspect 1, wherein the electronics include a variable resistance component electrically coupled to the input buffering circuitry.

27. The hearing device of inventive aspect 26, wherein the electronics include a capacitor or a filter between the variable resistance component and the input buffering circuitry.

28. The hearing device of inventive aspect 1, wherein the electronics include an adjustable component or circuitry electrically coupled to the input buffering circuitry.

29. An amplification method, comprising:

providing a variable gain amplifier with input buffering circuitry that includes a Sziklai pair; and biasing the Sziklai pair such that a quiescent current associated with an output signal generated by the variable gain amplifier is limited or controlled.

30. The amplification method of inventive aspect 29, wherein biasing the Sziklai pair includes controlling a current source of the Sziklai pair.

31. The amplification method of inventive aspect 29, wherein biasing the Sziklai pair includes using a DC servo loop to set a bias of the Sziklai pair.

32. The amplification method of inventive aspect 29, wherein biasing the Sziklai pair includes using a feedback loop to set a DC bias of the Sziklai pair.

33. The amplification method of inventive aspect 29, wherein biasing the Sziklai pair includes comparing a matched current associated with the variable gain amplifier to provide a difference signal, removing high frequency AC components from the difference signal to provide a filtered difference signal, amplifying the filtered difference signal to provide an amplified feedback signal, and removing AC components from the amplified feedback signal down to very low sub-audible frequencies to provide a feedback signal for the input buffering circuitry.

34. The amplification method of inventive aspect 29, wherein biasing the Sziklai pair includes providing a base current for the Sziklai pair at a current overhead of less than 1 μA for biasing.

35. The amplification method of inventive aspect 29, further comprising:

filtering input signals utilizing an envelope detector.

36. The amplification method of inventive aspect 29, further comprising: adjusting gain utilizing a logarithmic compression scheme.

37. The amplification method of inventive aspect 29, further comprising: linearizing a transistor of a variable gain element such that current fed into the transistor and circuitry effecting said linearization is limited or controlled.

38. The amplification method of inventive aspect 29, further comprising: controlling both gain compression and limiting utilizing a variable resistance element.

39. An amplifier for a hearing device, the amplifier comprising: electronics configured to receive an electrical signal as an input signal and generate an output signal for driving a receiver of the hearing device, the electronics including a variable gain amplifier with an input stage that includes a Sziklai pair, and circuitry adapted to bias the Sziklai pair such that a quiescent current associated with an output signal generated by the variable gain amplifier is limited or controlled.

40. The amplifier of inventive aspect 39, wherein the electronics are configured to bias the Sziklai pair such that the quiescent current is less than 10 μA.

41. The amplifier of inventive aspect 39, wherein the Sziklai pair receives the input signal.

42. The amplifier of inventive aspect 39, wherein the Sziklai pair is combined with a variable resistor and a high pass filter directly in the input stage.

43. The amplifier of inventive aspect 39, wherein the Sziklai pair includes only two biased transistors.

44. The amplifier of inventive aspect 39, wherein the electronics include a current controlled resistor coupled to the Sziklai pair.

45. The amplifier of inventive aspect 44, wherein the current controlled resistor is implemented in a bipolar transistor.

46. The amplifier of inventive aspect 44, wherein the current controlled resistor includes only one biased transistor.

47. The amplifier of inventive aspect 39, wherein the electronics include a feedback loop configured to set a DC bias of the Sziklai pair.

48. The amplifier of inventive aspect 47, wherein the feedback loop includes a DC servo loop.

49. A method of facilitating hearing, for a hearing device that includes a variable gain amplifier and a receiver that is positionable in the ear canal, the method comprising: providing the receiver with a high impedance receiver winding; positioning the receiver or windings thereof in the ear canal in direct acoustic contact with the air cavity between the receiver and the tympanic membrane; and limiting or controlling a quiescent current associated with an output signal generated by the variable gain amplifier.

50. The method of inventive aspect 49, wherein limiting or controlling a quiescent current includes biasing an output stage of the variable gain amplifier to operate with a very low quiescent bias current.

51. The method of inventive aspect 49, wherein limiting or controlling a quiescent current includes operating an output stage of the variable gain amplifier as a transimpedance amplifier.

52. A hearing device, comprising: a hearing device core including an acoustic-to-electric transducer or sensor that converts sound into an electrical signal, a receiver, and electronics configured to receive the electrical signal as an input signal and generate an output signal provided to the receiver, the electronics including a variable gain amplifier with circuitry utilizing a logarithmic compression scheme to provide gain compression, the circuitry includes an envelope filter and a variable gain element coupled thereto, the envelope filter being configured to provide filtering to compensate for the real ear resonance.

53. The hearing device of inventive aspect 52, wherein the hearing device core is configured such that the receiver or windings thereof fits deeply in the ear canal in proximity to the tympanic membrane.

54. The hearing device of inventive aspect 52, wherein the hearing device core is configured such that the receiver or windings thereof is positionable in the ear canal in direct acoustic contact with the air cavity between the receiver and the tympanic membrane.

55. The hearing device of inventive aspect 52, wherein the hearing device core is configured such that the receiver or windings thereof is positionable in the ear canal about 4 mm from the umbo of the tympanic membrane.

56. The hearing device of inventive aspect 52, wherein the hearing device core defines a medial-lateral axis length of about 12 mm, a minor axis length of 3.75 mm or less, and a major axis dimension of 6.35 mm or less.

57. The hearing device of inventive aspect 52, wherein the hearing device core includes an exterior portion that is custom-shaped and/or sized to support the hearing device within the ear canal.

58. The hearing device of inventive aspect 52, further comprising: a seal apparatus on the hearing device core.

59. The hearing device of inventive aspect 58, wherein the seal apparatus is configured to support the hearing device core within the ear canal bony portion.

60. The hearing device of inventive aspect 58, wherein the seal apparatus is configured to substantially conform to the shape of walls of the ear canal, maintain an acoustical seal between a seal surface and the ear canal, and retain the hearing device securely within the ear canal.

61. The hearing device of inventive aspect 52, wherein the electronics are configured such that a quiescent current associated with the output signal is less than 10 μA, and the receiver is a high impedance type, with a DC impedance greater than 1 kΩ.

62. The hearing device of inventive aspect 52, wherein the receiver or receiver winding is a high impedance type, with a DC impedance greater than 1 kΩ

63. The hearing device of inventive aspect 52, wherein the hearing device core includes a battery that is one or more of rechargeable and constituted of a single battery or a single cell battery.

64. The hearing device of inventive aspect 52, wherein the hearing device core includes a rechargeable battery.

65. The hearing device of inventive aspect 64, wherein the electronics are configured such that a quiescent current associated with the output signal is less than 40 μA (or, alternatively, 30 μA).

66. The hearing device of inventive aspect 64, wherein the receiver is a low impedance type, with a DC impedance less than 1 kΩ.

67. The hearing device of inventive aspect 64, wherein the electronics are configured to provide an acoustical pressure greater than 100 dB SPL.

68. The hearing device of inventive aspect 64, wherein the hearing device core includes an exterior portion that is custom-shaped and/or is provided in the form of a hard shell.

69. The hearing device of inventive aspect 52, wherein the circuitry has a compression ratio that is adjustable by a user of the hearing device.

70. The hearing device of inventive aspect 69, wherein the circuitry is configured to facilitate adjustable input signal dependent gain compression and adjustable output signal dependent gain limiting.

71. The hearing device of inventive aspect 52, wherein the circuitry includes a bipolar transistor and is configured to convert the input current to a logarithmic voltage using the base emitter junction of the bipolar transistor.

72. The hearing device of inventive aspect 52, wherein the envelope filter includes an envelope detector configured to filter the logarithmic voltage using adaptive attack and release times, operating on an overall detected signal envelope.

73. The hearing device of inventive aspect 72, wherein the envelope detector including a first arrangement of transistors configured such that as the amplitude of the input signals increases, a voltage on the emitter of one of the transistors decreases reducing the current flowing out of the arrangement of transistors.

74. The hearing device of inventive aspect 73, wherein the first arrangement of transistors includes a transistor configured to set the minimum $V_{BE}$ at quiet sounds which are defined as less than 60 dB SPL for an output transistor of the arrangement.

75. The hearing device of inventive aspect 74, wherein the envelope detector further includes an adjustable voltage source.

76. The hearing device of inventive aspect 73, wherein the envelope filter further includes a second arrangement of transistors coupled to the first arrangement of transistors and configured to set an adjustable gain.

77. The hearing device of inventive aspect 76, wherein the first arrangement of transistors is configured such that the second arrangement of transistors is completely turned off for loud sounds which are defined as greater than 90 dB SPL.

78. The hearing device of inventive aspect 52, wherein the gain set by the envelope filter is completely defined by NPN transistors.

79. The hearing device of inventive aspect 52, wherein the envelope filter is configured to provide the variable gain amplifier with a full 40 dB of gain compression.

80. The hearing device of inventive aspect 52, wherein the variable gain element includes a single transistor configured as a current controlled resistor, and a linearizing circuit or element configured to linearize the single transistor.

81. The hearing device of inventive aspect 80, wherein the linearizing circuit or element is a diode-tied transistor connected to the base of the single transistor, and the envelope filter and a variable gain element are configured such that the current fed into the base of the single transistor and the collector/base of the diode-tied transistor totals no more than 4 μA at a highest gain.

82. The hearing device of inventive aspect 52, further comprising: input buffering circuitry including a compound transistor, the electronics being configured to bias the compound transistor such that a quiescent current associated with the output signal is limited or controlled.

83. The hearing device of inventive aspect 82, wherein the variable gain element is coupled to the input buffering circuitry.

84. An amplifier for a hearing device, the amplifier comprising: electronics configured to receive an electrical signal as an input signal and generate an output signal for driving a receiver of the hearing device, the electronics including a variable gain amplifier with circuitry configured to provide gain compression, the circuitry including an envelope filter and a variable gain element including a linearized zero biased transistor that provides gain.

85. The amplifier of inventive aspect 84, wherein the electronics are configured such that a quiescent current associated with the output signal is less than 10 μA.

86. The amplifier of inventive aspect 84, wherein the circuitry is configured to facilitate adjustable input signal dependent gain compression and adjustable output signal dependent gain limiting.

87. The amplifier of inventive aspect 84, wherein the envelope filter includes circuitry configured to provide filtering to compensate for the real ear resonance and to convert input current to a logarithmic voltage using the logarithmic properties of a bipolar transistor $V_{BE}$.

88. The amplifier of inventive aspect 87, wherein the circuitry includes a bipolar transistor and is configured to convert the input current to a logarithmic voltage using the base emitter junction of the bipolar transistor.

89. The amplifier of inventive aspect 84, wherein the envelope filter includes an envelope detector configured to filter the logarithmic voltage using adaptive attack and release times, operating on an overall detected signal envelope rather than a detected peak.

90. The amplifier of inventive aspect 89, wherein the envelope detector including a first arrangement of transistors configured such that as the amplitude of the input signals increases, a voltage on the emitter of one of the transistors decreases reducing the current flowing out of the arrangement of transistors.

91. The amplifier of inventive aspect 90, wherein the first arrangement of transistors includes a transistor configured to set the minimum $V_{BE}$ at quiet sounds which are defined as less than 60 dB SPL for an output transistor of the arrangement.

92. The amplifier of inventive aspect 91, wherein the envelope detector further includes an adjustable voltage source.

93. The amplifier of inventive aspect 90, wherein the envelope filter further includes a second arrangement of transistors coupled to the first arrangement of transistors and configured to set an adjustable gain.

94. The amplifier of inventive aspect 93, wherein the first arrangement of transistors is configured such that the second arrangement of transistors is completely turned off for loud sounds which are defined as greater than 90 dB SPL to minimize distortion in the variable gain element.

95. The amplifier of inventive aspect 84, wherein the gain set by the envelope filter is completely defined by NPN transistors.

96. The amplifier of inventive aspect 84, wherein the envelope filter is configured to provide the variable gain amplifier with a full 40 dB of gain compression.

97. The amplifier of inventive aspect 84, wherein the variable gain element includes a single zero biased bipolar transistor configured as a current controlled resistor, and a linearizing circuit or element configured to linearize the single zero biased bipolar transistor.

98. The amplifier of inventive aspect 97, wherein the linearizing circuit or element is a diode-tied transistor connected to the base of the single zero biased bipolar transistor, and the envelope filter and a variable gain element are configured such that the current fed into the base of the single zero biased bipolar transistor and the collector/base of the diode-tied transistor totals no more than 4 μA at a highest gain.

99. The amplifier of inventive aspect 84, further comprising: input buffering circuitry including a compound transistor, the electronics being configured to bias the compound transistor such that a quiescent current associated with the output signal is limited or controlled.

100. The amplifier of inventive aspect 99, wherein the variable gain element is coupled to the input buffering circuitry.

101. A method for reducing hearing device power consumption, the method comprising: in circuitry that provides gain compression for a hearing device, filtering input signals to the hearing device utilizing an envelope detector configured such that as the amplitude of the input signals increases, a voltage on the emitter of a transistor associated with the envelope detector decreases reducing the current flowing out of an arrangement of transistors to provide gain compression.

102. A method for reducing hearing device power consumption, the method comprising: in circuitry that provides logarithmic compression for a hearing device, the circuitry including a variable gain element, linearizing a transistor of the variable gain element such that current fed into the transistor and circuitry effecting said linearization is limited or controlled.

103. A method for reducing hearing device power consumption, the method comprising: in circuitry that provides gain compression for a hearing device, the circuitry including an envelope filter, configuring a variable resistance element at an output of the envelope filter such that both gain compression and limiting are controlled by adjusting the variable resistance element.

104. A method for biasing a microphone of a hearing device including adjustable source degeneration circuitry, the method comprising: controlling an adjustable component of the adjustable source degeneration circuitry depending upon a detected signal envelope associated with sounds impinging upon the microphone.

105. The method of inventive aspect 104, further comprising: using the output of an envelope filter to control the adjustable source degeneration circuitry.

106. The method of inventive aspect 105, wherein the output of the envelope filter compensates for the real ear resonance.

107. The method of inventive aspect 105, wherein the output of the envelope filter is generated by converting input current to a logarithmic voltage.

108. The method of inventive aspect 105, wherein the output of the envelope filter is generated using adaptive attack and release times, operating on an overall detected signal envelope.

109. The method of inventive aspect 104, further comprising: providing an adjustable bias current to the adjustable source degeneration circuitry.

110. The method of inventive aspect 109, wherein the adjustable bias current is provided using an interface biased at 3 μA or less.

111. The method of inventive aspect 110, further comprising: adjusting a bias level of the interface.

112. The method of inventive aspect 109, wherein the adjustable bias current is provided using a two-wire microphone interface.

113. An apparatus for biasing a hearing device microphone, the apparatus comprising: electronics configured to receive an electrical signal as an input signal and generate an output signal for driving a hearing device receiver, the electronics including adjustable source degeneration circuitry coupled to the hearing device microphone and configured to adjust signal noise responsive to detected sounds impinging upon the hearing device microphone to ensure that a transistor of the adjustable source degeneration circuitry stays in the active region.

114. The apparatus of inventive aspect 113, wherein the electronics include an envelope filter.

115. The apparatus of inventive aspect 113, wherein the electronics include circuitry configured to provide filtering to compensate for the real ear resonance and to convert input current to a logarithmic voltage.

116. The apparatus of inventive aspect 113, wherein the electronics include an envelope detector configured to filter the logarithmic voltage using adaptive attack and release times, operating on an overall detected signal envelope.

117. The apparatus of inventive aspect 113, further comprising adjustable bias current circuitry configured to provide an adjustable bias current to the adjustable source degeneration circuitry.

118. The apparatus of inventive aspect 113, further comprising: an interface configured to provide an adjustable bias current to the adjustable source degeneration circuitry.

119. The apparatus of inventive aspect 118, wherein the interface is biased at 3 μA or less.

120. The apparatus of inventive aspect 118, wherein the interface is a two-wire microphone interface.

121. A hearing device, comprising: a hearing device core including an acoustic-to-electric transducer or sensor that converts sound into an electrical signal, a receiver, and electronics configured to receive the electrical signal as an input signal and generate an output signal provided to the receiver, the electronics including a compound transistor that receives the input signal and generates a current, and circuitry configured for analog processing of the current.

122. The hearing device of inventive aspect 121, wherein the circuitry includes an integrated circuit configured for analog processing of the current.

123. The hearing device of inventive aspect 121, wherein the circuitry includes a current-mode circuit configured for analog processing of the current.

124. The hearing device of inventive aspect 121, wherein the electronics are configured to bias the compound transistor such that a quiescent current associated with the output signal is limited or controlled.

125. The hearing device of inventive aspect 121, wherein the electronics are within the hearing device.

126. The hearing device of inventive aspect 121, wherein the hearing device core is configured such that the receiver or windings thereof fits deeply in the ear canal in proximity to the tympanic membrane.

127. The hearing device of inventive aspect 121, wherein the hearing device core is configured such that the receiver or windings thereof is positionable in the ear canal in direct acoustic contact with the air cavity between the receiver and the tympanic membrane.

128. The hearing device of inventive aspect 121, wherein the hearing device core is configured such that the receiver or windings thereof is positionable in the ear canal about 4 mm from the umbo of the tympanic membrane.

129. The hearing device of inventive aspect 121, wherein the hearing device core defines a medial-lateral axis length of about 12 mm, a minor axis length of 3.75 mm or less, and a major axis dimension of 6.35 mm or less.

130. The hearing device of inventive aspect 121, wherein the hearing device core includes an exterior portion that is custom-shaped and/or sized to support the hearing device within the ear canal.

131. The hearing device of inventive aspect 121, further comprising: a seal apparatus on the hearing device core.

132. The hearing device of inventive aspect 131, wherein the seal apparatus is configured to support the hearing device core within the ear canal bony portion.

133. The hearing device of inventive aspect 131, wherein the seal apparatus is configured to substantially conform to the shape of walls of the ear canal, maintain an acoustical seal between a seal surface and the ear canal, and retain the hearing device securely within the ear canal.

134. The hearing device of inventive aspect 121, wherein the electronics are configured such that a quiescent current associated with the output signal is less than 10 μA, and the receiver is a high impedance type, with a DC impedance greater than 1 kΩ.

135. The hearing device of inventive aspect 121, wherein the receiver or receiver winding is a high impedance type, with a DC impedance greater than 1 kΩ.

136. The hearing device of inventive aspect 121, wherein the hearing device core includes a battery that is one or more of rechargeable and constituted of a single battery or a single cell battery.

137. The hearing device of inventive aspect 121, wherein the hearing device core includes a rechargeable battery.

138. The hearing device of inventive aspect 137, wherein the electronics are configured such that a quiescent current associated with the output signal is less than 40 μA.

139. The hearing device of inventive aspect 137, wherein the receiver is a low impedance type, with a DC impedance less than 1 kΩ.

140. The hearing device of inventive aspect 137, wherein the electronics are configured to provide an acoustical pressure greater than 100 dB SPL.

141. The hearing device of inventive aspect 137, wherein the hearing device core includes an exterior portion that is custom-shaped and/or is provided in the form of a hard shell.

142. An amplifier for a hearing device, comprising: electronics configured to receive an electrical signal as an input signal and generate an output signal for driving a receiver of the hearing device, the electronics including an input buffering stage including a Sziklai pair that receives the input signal and generates a current, and circuitry configured for analog processing of the current to provide the output signal.

143. The amplifier of inventive aspect 142, wherein the electronics include an integrated circuit configured for analog processing of the output signal.

144. The amplifier of inventive aspect 142, wherein the electronics include a current-mode circuit configured for analog processing of the output signal.

145. The amplifier of inventive aspect 142, wherein the electronics are configured such that the current is mirrored by a transistor of the input buffering stage.

146. The amplifier of inventive aspect 142, further comprising: filtering circuitry between the input buffering stage and the receiver, on the input of the electronics, and/or provided as part of a feedback loop.

147. The amplifier of inventive aspect 142, wherein the electronics include an output buffering stage configured to convert the current into a voltage at a high open loop gain which is defined as around 60 dB in order to control a quiescent current in the output buffering stage, which drives the receiver with a very low distortion level which is defined as 3% or less even for high sound levels which are defined as 100 dB SPL or greater.

148. The amplifier of inventive aspect 142, wherein the electronics are configured to provide an overall gain that is negative.

149. A method of improving sound quality in a hearing device that includes an acoustic-to-electric transducer or sensor and a receiver, the method comprising: receiving an input signal provided by the acoustic-to-electric transducer or sensor that represents sound; generating a current from the input signal; and analog processing the current to generate an output signal provided to the receiver.

150. The method of inventive aspect 149, wherein the current is generated utilizing a compound transistor.

151. The method of inventive aspect 150, further comprising: biasing the compound transistor such that a quiescent current associated with the output signal is limited or controlled.

152. The method of inventive aspect 149, wherein analog processing the current includes performing a current-mode operation.

153. The method of inventive aspect 149, wherein the current is analog processed utilizing a translinear circuit.

154. The method of inventive aspect 149, wherein the current is analog processed utilizing an analog integrated circuit.

155. A method of improving sound quality for a hearing device, the method comprising: filtering an input signal provided to a hearing device, said filtering including one or more of filtering directly at the input of a variable gain amplifier of the hearing device, varying one or more adjustable components of a filtering circuit in response to changes in gain, utilizing a filtering circuit that generates a corner frequency independently of gain, utilizing an adjustable high pass filter which is removed as the level of the input signal increases, varying an adjustable component of a filtering circuit depending upon an overall detected signal envelope, and varying an adjustable component of a filtering circuit in response to an output of circuitry utilized to provide gain compression.

156. A hearing device, comprising: a hearing device core including an acoustic-to-electric transducer or sensor that converts sound into an electrical signal, a receiver, and electronics configured to receive the electrical signal as an input signal and generate an output signal provided to the receiver, the electronics including a variable gain amplifier with filtering circuitry that filters directly at the input of the variable gain amplifier.

157. The hearing device of inventive aspect 156, wherein the filtering circuitry includes one or more components that are adjustable to provide a variable capacitance.

158. The hearing device of inventive aspect 156, wherein the filtering circuitry utilizes or is provided by an emulated variable capacitance.

159. The hearing device of inventive aspect 156, wherein the electronics are configured such that a capacitance associated with the filtering circuitry changes in response to changes in the gain.

160. The hearing device of inventive aspect 156, wherein the filtering circuitry includes an adjustable high pass filter that generates a corner frequency.

161. The hearing device of inventive aspect 160, wherein the electronics are configured such that the corner frequency is adjustable independently of gain.

162. The hearing device of inventive aspect 160, wherein the electronics are configured such that the adjustable high pass filter is removed as the signal level increases.

163. The hearing device of inventive aspect 156, wherein the filtering circuitry includes an adjustable capacitance component and an adjustable resistance component, and the electronics are configured to generate an output to control the adjustable resistance component.

164. The hearing device of inventive aspect 163, wherein the electronics include an envelope filter that generates the output.

165. The hearing device of inventive aspect 164, wherein the output of the envelope filter is generated by converting input current to a logarithmic voltage.

166. The hearing device of inventive aspect 164, wherein the output of the envelope filter is generated using adaptive attack and release times, operating on an overall detected signal envelope.

167. The hearing device of inventive aspect 156, wherein the electronics are configured such that a quiescent current associated with the output signal is limited or controlled.

168. The hearing device of inventive aspect 156, wherein the electronics are within the hearing device.

169. The hearing device of inventive aspect 156, wherein the hearing device core is configured such that the receiver or windings thereof fits deeply in the ear canal in proximity to the tympanic membrane.

170. The hearing device of inventive aspect 156, wherein the hearing device core is configured such that the receiver or windings thereof is positionable in the ear canal in direct acoustic contact with the air cavity between the receiver and the tympanic membrane.

171. The hearing device of inventive aspect 156, wherein the hearing device core is configured such that the receiver or windings thereof is positionable in the ear canal about 4 mm from the umbo of the tympanic membrane.

172. The hearing device of inventive aspect 156, wherein the hearing device core defines a medial-lateral axis length of about 12 mm, a minor axis length of 3.75 mm or less, and a major axis dimension of 6.35 mm or less.

173. The hearing device of inventive aspect 156, wherein the hearing device core includes an exterior portion that is custom-shaped and/or sized to support the hearing device within the ear canal.

174. The hearing device of inventive aspect 156, further comprising: a seal apparatus on the hearing device core.

175. The hearing device of inventive aspect 174, wherein the seal apparatus is configured to support the hearing device core within the ear canal bony portion.

176. The hearing device of inventive aspect 174, wherein the seal apparatus is configured to substantially conform to the shape of walls of the ear canal, maintain an acoustical seal between a seal surface and the ear canal, and retain the hearing device securely within the ear canal.

177. The hearing device of inventive aspect 156, wherein the electronics are configured such that a quiescent current associated with the output signal is less than 10 μA, and the receiver is a high impedance type, with a DC impedance greater than 1 kΩ.

178. The hearing device of inventive aspect 156, wherein the receiver or receiver winding is a high impedance type, with a DC impedance greater than 1 kΩ.

179. The hearing device of inventive aspect 156, wherein the hearing device core includes a battery that is one or more of rechargeable and constituted of a single battery or a single cell battery.

180. The hearing device of inventive aspect 156, wherein the hearing device core includes a rechargeable battery.

181. The hearing device of inventive aspect 180, wherein the electronics are configured such that a quiescent current associated with the output signal is less than 40 μA.

182. The hearing device of inventive aspect 180, wherein the receiver is a low impedance type, with a DC impedance less than 1 kΩ.

183. The hearing device of inventive aspect 180, wherein the electronics are configured to provide an acoustical pressure greater than 100 dB SPL.

184. The hearing device of inventive aspect 180, wherein the hearing device core includes an exterior portion that is custom-shaped and/or is provided in the form of a hard shell.

185. An input circuit for a hearing device, comprising: electronics configured to receive an electrical signal as an input signal and generate an output signal for driving a receiver of the hearing device, the electronics including a variable gain amplifier with filtering circuitry that filters at the input of the variable gain amplifier, the filtering circuitry including an adjustable high pass filter that generates a low frequency corner, the electronics being configured such that the low frequency corner is adjustable independently of gain.

186. The input circuit of inventive aspect 185, wherein the electronics are configured such that a capacitance associated with the filtering circuitry changes in response to changes in the gain.

187. The input circuit of inventive aspect 185, wherein the filtering circuitry filters directly at the input of the variable gain amplifier.

188. The input circuit of inventive aspect 185, wherein the filtering circuitry includes a network a capacitors and switches facilitating multiple different series and/or parallel connections of the capacitors.

189. The input circuit of inventive aspect 185, wherein the filtering circuitry utilizes or is provided by an emulated variable capacitance.

190. The input circuit of inventive aspect 185, wherein the electronics are configured such that the adjustable high pass filter is removed as the signal level increases.

191. The input circuit of inventive aspect 185, wherein the filtering circuitry includes an adjustable capacitance component and an adjustable resistance component, and the electronics are configured to generate an output to control the adjustable resistance component.

192. The input circuit of inventive aspect 191, wherein the electronics include a log compression envelope filter that generates the output.

193. The input circuit of inventive aspect 192, wherein the output of the envelope filter is generated by converting input current to a logarithmic voltage using the logarithmic properties of a bipolar transistor $V_{BE}$.

194. The input circuit of inventive aspect 192, wherein the output of the envelope filter is generated using adaptive attack and release times, operating on an overall detected signal envelope rather than a detected peak.

195. A hearing device, comprising: a hearing device core including an acoustic-to-electric transducer or sensor that converts sound into an electrical signal, a receiver, a battery constituted of a single battery or a single cell battery, and electronics configured to receive the electrical signal as an input signal and generate an output signal provided to the receiver, the electronics including a variable gain amplifier configured such that a quiescent current associated with the output signal is less than 10 μA.

196. The hearing device of inventive aspect 195, wherein the receiver or receiver winding is a high impedance type, with a DC impedance greater than 1 kΩ.

197. The hearing device of inventive aspect 195, wherein the hearing device core is configured such that the receiver or windings thereof fits deeply in the ear canal in proximity to the tympanic membrane.

198. The hearing device of inventive aspect 195, wherein the hearing device core is configured such that the receiver or windings thereof is positionable in the ear canal in direct acoustic contact with the air cavity between the receiver and the tympanic membrane.

199. The hearing device of inventive aspect 195, wherein the hearing device core is configured such that the receiver or windings thereof is positionable in the ear canal about 4 mm from the umbo of the tympanic membrane.

200. The hearing device of inventive aspect 195, wherein the hearing device core defines a medial-lateral axis length of about 12 mm, a minor axis length of 3.75 mm or less, and a major axis dimension of 6.35 mm or less.

201. The hearing device of inventive aspect 195, wherein the hearing device core includes an exterior portion that is custom-shaped and/or sized to support the hearing device within the ear canal.

202. The hearing device of inventive aspect 195, further comprising: a seal apparatus on the hearing device core.

203. The hearing device of inventive aspect 202, wherein the seal apparatus is configured to support the hearing device core within the ear canal bony portion.

204. The hearing device of inventive aspect 202, wherein the seal apparatus is configured to substantially conform to the shape of walls of the ear canal, maintain an acoustical seal between a seal surface and the ear canal, and retain the hearing device securely within the ear canal.

205. A hearing device, comprising: a hearing device core including an acoustic-to-electric transducer or sensor that converts sound into an electrical signal, a receiver, a rechargeable battery, and electronics configured to receive the electrical signal as an input signal and generate an output signal provided to the receiver, the electronics including a variable gain amplifier configured such that a quiescent current associated with the output signal is less than 40 μA.

206. The hearing device of inventive aspect 205, wherein the receiver or receiver winding is a low impedance type, with a DC impedance less than 1 kΩ.

207. The hearing device of inventive aspect 205, wherein the electronics are configured to provide an acoustical pressure greater than 100 dB SPL.

208. The hearing device of inventive aspect 205, wherein the hearing device core is configured such that the receiver or windings thereof fits in the ear canal in proximity to the tympanic membrane.

209. The hearing device of inventive aspect 205, wherein the hearing device core is configured such that the receiver or windings thereof is positionable in the ear canal in direct acoustic contact with the air cavity between the receiver and the tympanic membrane.

210. The hearing device of inventive aspect 205, wherein the hearing device core is configured such that the receiver or windings thereof is positionable in the ear canal about 6-8 mm from the umbo of the tympanic membrane.

211. The hearing device of inventive aspect 205, wherein the hearing device core includes an exterior portion that is custom-shaped and/or is provided in the form of a hard shell.

What is claimed is:

1. A hearing device, comprising:

a hearing device core including an acoustic-to-electric transducer or sensor that converts sound into an electrical signal, a receiver, electronics configured to receive the electrical signal as an input signal, the electronics including a variable gain amplifier configured to generate an output signal provided to the receiver, the variable gain amplifier having an input stage including a Sziklai pair that receives the input signal, the Sziklai pair being configured to amplify and buffer the input signal, the electronics being configured to bias the Sziklai pair such that a quiescent current associated with the output signal is limited or controlled, and a battery that is one or more of rechargeable and constituted of a single battery or a single cell battery.

2. The hearing device of claim 1, wherein the receiver or receiver winding is a high impedance type, with a DC impedance greater than 1 kΩ.

3. The hearing device of claim 1, wherein the Sziklai pair is combined with a variable resistor and a high pass filter directly in the input stage.

4. The hearing device of claim 1, wherein the Sziklai pair includes only two biased transistors.

5. The hearing device of claim 1, wherein the electronics include a current controlled resistor coupled to the Sziklai pair.

6. The hearing device of claim 5, wherein the current controlled resistor includes only one biased transistor.

7. The hearing device of claim 1, wherein the electronics include an adjustable resistance component or circuitry, the adjustable resistance component or circuitry being configured to facilitate adjusting gain compression and limiting for the variable gain amplifier.

8. The hearing device of claim 7, wherein the adjustable resistance component or circuitry includes a zero biased bipolar transistor, a MOSFET operating in the linear regime, or a feedback circuit emulating a resistor.

9. The hearing device of claim 1, wherein the electronics include a feedback loop that includes a DC servo loop configured to set a DC bias of the Sziklai pair.

10. The hearing device of claim 1, wherein the Sziklai pair generates a current, and the electronics include circuitry including a current mode circuit configured for analog processing of the current.

11. The hearing device of claim 1, wherein the Sziklai pair generates a current, and the electronics include a transistor configured to mirror the current to generate a current output, and a transimpedance amplifier configured to convert the current output into a voltage at a high open loop gain.

12. A hearing device, comprising:

a hearing device core including an acoustic-to-electric transducer or sensor that converts sound into an electrical signal, a receiver, and electronics configured to receive the electrical signal as an input signal, the electronics including a variable gain amplifier configured to generate an output signal provided to the receiver, the variable gain amplifier having an input stage including a Sziklai pair that receives the input signal, the Sziklai pair being configured to amplify and buffer the input signal, the electronics being configured to bias the Sziklai pair such that a quiescent current associated with the output signal is limited or controlled.

13. The hearing device of claim 12, wherein the hearing device core includes a rechargeable battery.

14. The hearing device of claim 13, wherein the receiver is a low impedance type, with a DC impedance less than 1 kΩ.

15. The hearing device of claim 12, wherein the hearing device core includes a nonrechargeable battery and the receiver or receiver winding is a high impedance type, with a DC impedance greater than 1 kΩ.

16. The hearing device of claim 12, wherein the hearing device core includes a battery that is one or more of rechargeable and constituted of a single battery or a single cell battery.

17. A hearing device, comprising:

a hearing device core including an acoustic-to-electric transducer or sensor that converts sound into an electrical signal, a receiver, and electronics configured to receive the electrical signal as an input signal, the electronics including a variable gain amplifier configured to generate an output signal provided to the receiver, the variable gain amplifier having input buffering circuitry including a Sziklai pair that receives the input signal, the Sziklai pair being configured to amplify and buffer the input signal, the electronics being configured to bias the Sziklai pair such that a quiescent current associated with the output signal is limited or controlled.

18. The hearing device of claim 17, wherein the electronics include a variable resistance component electrically coupled to the input buffering circuitry.

19. The hearing device of claim 18, wherein the electronics include a capacitor or a filter between the variable resistance component and the input buffering circuitry.

20. The hearing device of claim 17, wherein the hearing device core includes a battery that is one or more of rechargeable and constituted of a single battery or a single cell battery.

* * * * *